US006438922B1

(12) United States Patent
DeLeFevre

(10) Patent No.: US 6,438,922 B1
(45) Date of Patent: Aug. 27, 2002

(54) METHOD OF DESIGNING A BUILDING FOR MAXIMUM COMPATABILITY WITH MODULAR FORMS

(76) Inventor: Patrick DeLeFevre, 190 Mt. Auburn St., Apt. 2-2, Watertown, MA (US) 02172

( * ) Notice: Subject to any disclaimer, the term of this patent is extended or adjusted under 35 U.S.C. 154(b) by 0 days.

(21) Appl. No.: 09/405,371

(22) Filed: Sep. 24, 1999

(51) Int. Cl.[7] ..... E04B 1/00
(52) U.S. Cl. ..... 52/741.1
(58) Field of Search ..... 703/1, 7, 6; 706/921, 706/923

(56) References Cited

U.S. PATENT DOCUMENTS

| | | | | | |
|---|---|---|---|---|---|
| 4,370,707 | A | * | 1/1983 | Phillips | 707/104 |
| 4,551,810 | A | * | 11/1985 | Levine | 700/182 |
| 4,653,021 | A | * | 3/1987 | Takagi | 707/5 |
| 4,800,485 | A | * | 1/1989 | Ackroff | 707/104 |
| 4,885,694 | A | * | 12/1989 | Pray | 705/400 |
| 4,964,060 | A | * | 10/1990 | Hartsog | 703/1 |
| 5,227,983 | A | * | 7/1993 | Cox | 703/1 |
| 5,319,541 | A | * | 6/1994 | Blanchard | 705/24 |
| 5,500,802 | A | * | 3/1996 | Morris | 700/182 |
| 5,526,520 | A | * | 6/1996 | Krause | 707/104 |
| 5,557,537 | A | * | 9/1996 | Normann | 703/1 |
| 5,625,827 | A | * | 4/1997 | Krause | 707/502 |
| 5,808,905 | A | * | 9/1998 | Normann | 703/2 |
| 5,907,850 | A | * | 5/1999 | Krause | 707/501 |

OTHER PUBLICATIONS

Autodesk http://www3.autodesk.com.*
AutoCAD 14 Instant Reference, 1995, Omura, George, Sybex.*

* cited by examiner

*Primary Examiner*—Carl D. Friedman
*Assistant Examiner*—Steve Varner
(74) *Attorney, Agent, or Firm*—Robert K Tendler

(57) ABSTRACT

A method is provided for specifying parameters for modular formworks from construction documents which define an original structure, in which the construction documents are either scanned or a CAD version is read out. From the scanned drawings or the CAD information, various elements of the structure to be built are identified and selected in an order specific to a particular modular construction system. After identification and selection, reference numerals are assigned for the selected parts or components, with the numbers representing a component of the building such as what floor is intended, walls, ceilings, and other structural components down to the placement of light switches, HVAC vents, drainage, sinks, and plumbing valves. Thereafter, the components defined by the numbering system are analyzed for discrepancies in the original design defined by the construction documents, and modifications are applied to account for dimensional discrepancies, drawing discrepancies and violations of particular building code guidelines. Thereafter, the dimensions of the various building components are revised to conform to the available modules, whereupon instructions are generated as to how to build the original structure from the available modules.

10 Claims, 39 Drawing Sheets

METHOD OF DESIGNING A BUILDING FOR MAXIMUM COMPATABILITY WITH MODULAR FORMS

FIELD OF INVENTION

This invention relates to modular building systems, and more particularly to a method for identifying, selecting and modifying information from construction documents describing a structure, using the information to select modular formworks, and to instruct artisans in the erection of the modular formworks for the construction of the structure described by the construction documents.

BACKGROUND OF INVENTION

As illustrated in U.S. Pat. Nos. 5,930,970 and 5,833,872 issued to Patrick Delefevre, a modular building system is described in which various panels, floors, ceilings and other structural components are formed through the utilization of formworks provided by prefabricated apertured panels, channels, beams, and buttressing apparatus which are positioned with mating apertures and plugs to eliminate the time consuming measuring associated with prior formworks. The system described in the above patents permit the forming of concrete so as to provide walls, floors and ceilings as well as other structures that make up a building.

Inherent in the above processes is the utilization of modular panels, channels and other components which are standardized in the sense of having predetermined dimensions. There still remains the problem of going from the original structure as defined by an original set of construction documents, drawings and the like, to the construction of the final building structure. It will be appreciated that architects and structural engineers provide architectural, engineering and other types of drawings to specify the type of building to be built. These drawings do not necessarily take into account any modular concepts, at least in so far as the forming of the walls, ceilings, floors and supporting members of the final structure.

In the past, modular buildings have been undesirably similar because of the modules utilized. In most cases, the modules are designed with respect to the final building to be built, as opposed to being universally adaptable for any type of building. Thus, modular buildings tend to look the same and function the same, thereby severely limiting the ability of architects, structural engineers and owners to create new structures while at the same time taking advantage of modular techniques.

It will be appreciated that as many as 10,000 items of information may be necessary to completely specify all of the components in a particular building. For modular buildings, these decisions are pre-made, which is why modular building techniques have limited the ability of the architect and the engineer to alter the appearance, size and shape of the building. As will be appreciated, the shear enormity of numbers of items to be specified for a given building limits the use of modular components by architects and structural engineers, such that modular systems, when employed, were used at the expense of architectural and engineering creativity.

While modular systems have existed in the past, in general, they limit flexibility. The system described in the above patents permits great flexibility, because the dimensions of the formworks can be varied, provided by the nature of the specialized modular elements. For instance, a formwork wall can be compound of a number of uniform panels, with the last panel being of a different width. Alternatively, the channels which meet the panels may be provided with sides to overlap the abutting panels, thus to hide spaces between the end of a panel and the next panel so that a shorter panel can be used.

SUMMARY OF THE INVENTION

Rather than having the modules themselves specify the type of building to be built, in the subject invention, the original construction drawings are used to specify the modular components, with the original drawings being altered to conform to the available modular components. In one embodiment, the original construction drawings are input either by scanning the drawings or using CAD outputs, with each of the building components within the architect's drawings being identified and ordered in a predetermined manner so as to be able to specify the modular formworks utilized to construct the building. Note that identification of building components is automatic if the original construction drawings are done from a CAD process. If drawings are scanned in, then either manual or automatic techniques are used to identify the building components, then dimensions and other characteristics.

To this end, a method is provided to identify such building components in a logical fashion, and to provide the components with specialized reference numerals, with each of the numbers representing a component such as a floor, wall, or ceiling and utility component; the reference numerals also specify what area of the structure these components are to be placed. This is done by virtue of sub-dividing the original drawing into the smallest information possible. For instance, the construction drawings can be subdivided into such items as levels or floors, the type of architectural drawing, the plan number, the volume of the room, the room number, the surfaces of the walls, the corners of the walls, and the intersection lines between surfaces as well as other items. Thus, for instance, a particular wall in a particular room at a particular building level can be specified as to not only the wall, including its dimensions and configuration, but also the reinforcements associated with the wall as well as apertures in the wall for conduits, switch block and other items.

Once the original construction documents have been characterized by reference numerals in a logical fashion, the entire structure can be analyzed for discrepancies of the original documents to be able to make corrections and modifications. For instance, dimensional discrepancies can be ascertained, drawing discrepancies in the scanned in drawings can be detected and building code guidelines can be analyzed to assure that the resulting structure does not violate any local building code. Thereafter, the original construction documents can be corrected. This provides a base line upon which to revise the dimensions of each of the building components involved so as to match them or conform them to the modular components available in the particular modular construction scheme employed.

Thereafter, additional information or alternative designs can be specified, with the additional information and alternatives being a revision to the module-matched information, as opposed to the original construction documents. Finally, instructions are generated to enable an artisan to build the required formworks through the utilization of the available modular formwork components, with the instructions including the operations to be performed, a selection of the modular units and the method by which the components are to be assembled to provide the appropriate formworks so that walls, floors and ceilings can be poured.

The result is that one can go from an idealized concept of what the building should look like, to the specification of the particular modular formwork components usable to construct this building through the utilization of a series of method steps involving a particular ordering of the different types of information available from the construction documents. In this manner, not only can unlimited flexibility be provided to the architectural engineer or designer, he can be assured that the advantages of modular construction can be afforded to his design. This can be done in an exceedingly rapid fashion, once the architect and the engineer have specified the building that they wish to build. Through the utilization of the subject method, every building component specified by the architect and engineer can be transformed into a conforming set of modular formwork components, and the building constructed with the efficiencies afforded by the utilization of these modular formwork components.

As described in the aforementioned patents, buildings which heretofore have taken months to construct can now be constructed in a months time. The construction efficiencies are provided through the utilization of the modular formwork components, which in one embodiment are erected through the utilization of apertures in the panels, channels and braces, such that cumbersome and time consuming measurement techniques are eliminated.

In one embodiment, the final instructions from the subject method relate to the apertures which are utilized in the alignment procedures for the various formwork components, with the formwork components being aligned and positioned through the combination of the apertures and pegs involved. Thus, the instructions in one embodiment include specification of which of the apertures in a formwork component are to be connected to other apertures in an adjacent formwork component by the pegs; which apertures and pegs should be used and the location of the apertured components that make up the formworks.

In one embodiment, the instructions include the alphanumeric indication of which formwork components are to be co-located, colors of color-coded plugs and apertures, with numbers indicating position of matching formwork components. For instance, each panel may be given a separate identifying number, with each aperture in each panel being given an identifying number. An alignment channel may be given a particular identifying number with its apertures also having particular identifying numbers. The system for instruction is not limited to merely providing numbers for adjacent elements, but also can be color-coded as well as providing alphanumeric indices on the formwork components to permit rapid assembly.

In summary, a method is provided for specifying parameters for modular formworks from construction documents which define an original structure, in which the construction documents are either scanned or a CAD version is read out. From the scanned drawings or the CAD information, various elements of the structure to be built are identified and selected in an order specific to a particular modular construction system. After identification and selection, reference numerals are assigned for the selected parts or components, with the numbers representing a component of the building such as what floor is intended, walls, ceilings, and other structural components down to the placement of light switches, HVAC vents, drainage, sinks, and plumbing valves. Thereafter, the components defined by the numbering system are analyzed for discrepancies in the original design defined by the construction documents, and modifications are applied to account for dimensional discrepancies, drawing discrepancies and violations of particular building code guidelines. Thereafter, the dimensions of the various building components are revised to conform to the available modular units, whereupon instructions are generated as to how to build the original structure from the available modular components.

BRIEF DESCRIPTION OF THE DRAWINGS

These and other features of the Subject Invention will be better understood in connection with the Detailed Description taken in conjunction with the Drawings of which.

DETAILED DESCRIPTION OF THE DRAWINGS

It will be appreciated that the purpose of the subject invention is to be able to scan or read out construction drawings, and to specify modular components or elements of a formworks which can be used in generating the structure specified by the construction drawings. The architect, in general, specifies a building in terms of construction drawings to have a certain look, feel and functionality, which satisfies the architectural desires of not only the architect, but the customer as well.

Figure 1:
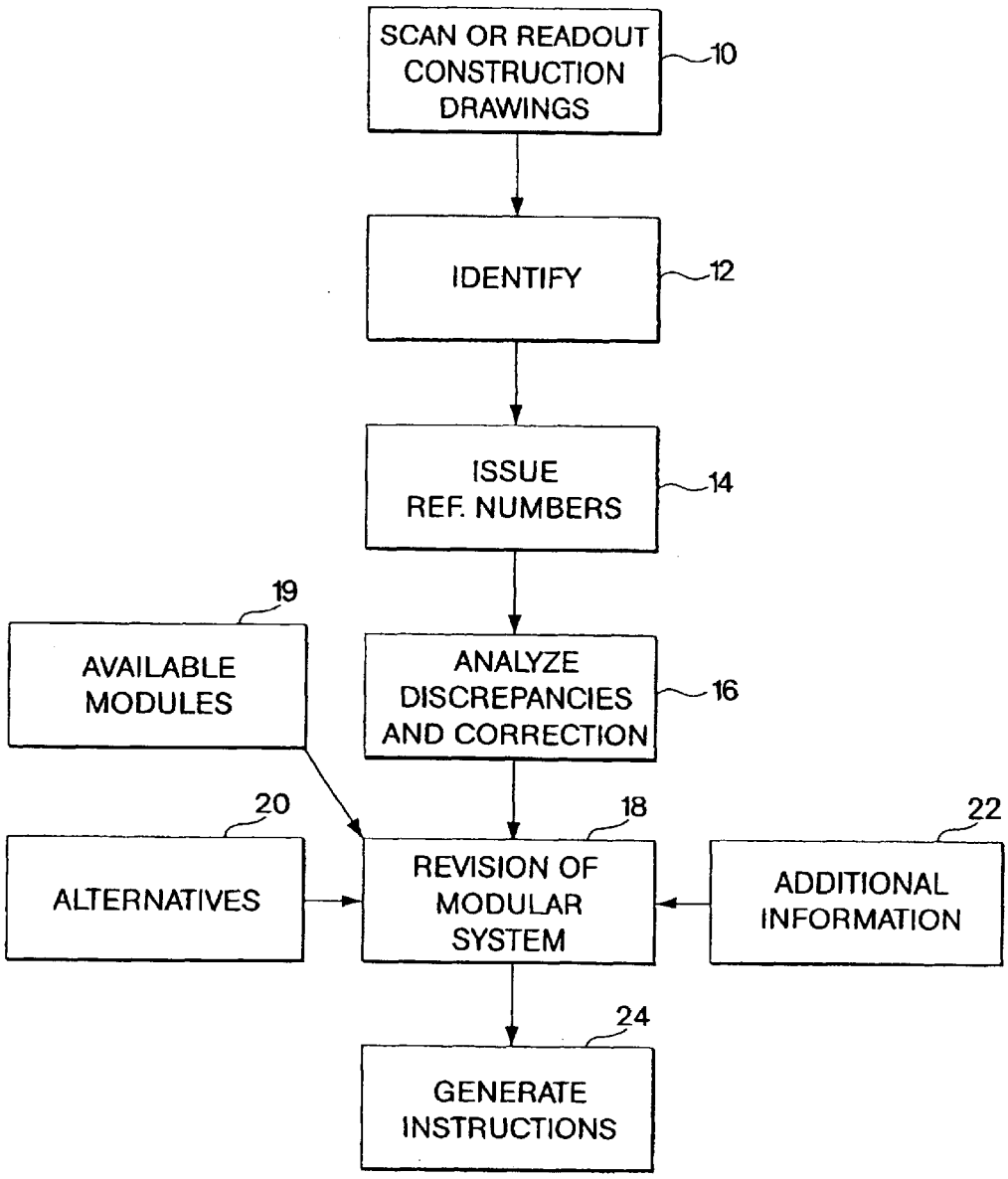
FIG. 1 is a flow chart illustrating the subject method in which construction drawings are scanned or read into the system, with features of the structure to be built identified and reference numerals issued, followed by analysis of discrepancies and correction, followed by revision of the description of the building components to accommodate a particular modular formworks system.

On the other hand, modular construction techniques tend to limit the architect in what the architect can design because the modular elements are preset. Unlike prior construction techniques, in the subject invention and as illustrated in FIG. 1, construction drawings as illustrated at 10 may either be scanned into the system, or if in CAD form can be read out into the system. The construction drawings which include architectural drawings, structural drawings, mechanical drawings, electrical drawings and other types of drawings define each and every element of the building structure. For purposes of the subject invention, while building structures will be referred to, it will be appreciated that any type of structure can be specified to be produced with modular formworks through the utilization of the subject method.

As illustrated at 12, each of the elements of the building structure are identified. These elements range from such things as roofs, ceilings, and floors, to such things as alcove shapes, column configurations and even electrical conduit placement and in fact, light switches and doorknobs.

As illustrated at 14, reference numerals are issued for each of these building components to uniquely identify not only the component, but also its location within the structure. Also, the numbers are utilized to indicate various characteristics of the building element, such as for instance, thickness, or strength.

In one embodiment a specialized numbering system is utilized to be able to specify all of the information contained in the construction drawings. In this system numerals are used to identify particular building elements in the construction drawings used to specify the structure to be built.

The information identified by a number is in a numerical string, either a location, measurement or some limitation for the building element.

EXAMPLE: (.1.3.8.5.02.2)

A dot means an end or beginning of a unit of information.

A numeral between two consecutive dots is a unit of information.

"1", "2", "3". . . "n" between two consecutive dots means there is a particular unit of information called "position".

"0" means that there is no information at that position.

"0.01" means that there is a subdivision of the preceding unit of information.

It will be noted that the information represented by a numeral in a numerical string depends upon previous numerals in the string, such that a numeral at a given position in a string can specify different information. For instance, for the strings 1.01.1.1.2.1.4.2 and .1.01.1.2.1.2.1.2. Although the last numeral being in the $7^{th}$ position for both strings is the same (namely 2), in the first instance relates to the second drawing of the architectural section of the second basement of the first block of the structure to be built, whereas in the second instance relates to the second drawing of the structural floor plans of the first ground floor of the first block.

The following is a list of the positions used by the subject system:

TABLE I

| Position | |
|---|---|
| 1. | Information about Blocks. |
| 2. | Information about Levels. |
| 3. | Information about what type of level (e.g. basement). |
| 4. | Information about what subdivision of the type of level (e.g. first basement). |
| 5. | Information about what kind of drawing (e.g. architectural). |
| 6. | Information about what type of drawing (e.g. floor plans). |
| 7. | Information about which drawing number (e.g. drawing #1). |
| 8. | Information about volumes. |
| 9. | Information about what type of volume (e.g. positive volume). |
| 10. | Information about what kind of volume (e.g. a rooms). |
| 11. | Information about which volume number (e.g. first volume). |
| 12. | Information about surfaces. |
| 13. | Information about what kind of surface (e.g. plain surface). |
| 14. | Information about corners (coordinates) of surfaces (e.g. first corner). |
| 15. | Information about intersection lines of surfaces (e.g. first intersection). |
| 16. | Information about computed data (e.g. inclination and direction of intersection line). |
| 17. | Information about discrepancies. |
| 18. | Information about what kind of discrepancy (e.g. dimensional). |
| 19. | Information about corrections. |
| 20. | Information about what kind of corrections (e.g. regulations). |
| 21. | Information about revisions of modularization. |
| 22. | Information about what kind of revisions (e.g. volumes). |
| 23. | Information about identification of modular formwork elements. |
| 24. | Information about what kind of modular formwork elements (e.g. base guides). |
| 25. | Information about operations. |
| 26. | Information about what kind of operation (e.g. laying the walls). |
| 27. | Information about instructions. |
| 28. | Information about what kind of instructions (e.g. laying the walls). |

All of the above categories completely specifies the elements of the original construction drawings as described in the proceeding example.

Example I

A revised width of the bedroom #4 in block #1 on the first floor is uniquely described by (1.01.1.4.1.1.1.2.1.1.1 .4.1.1.01.02.04.1.02,.03.04.05.1.02.04.0.1.3.01 .1.4.03.1 .3.02.04.01.01).

This is interpreted as follows:

| Position | |
|---|---|
| 1 | .1 Block |
| | .01 Block #1 |
| 2 | .1 Level |
| 3 | .4 Floor |
| 4 | .1 1st Floor |
| 5 | .1 Architectural Drawing |
| 6 | .1 Plans |
| 7 | .2 Second |
| 8 | .1 Volume |
| 9 | .1 (+) Volume |
| 10 | .1 Room |
| 11 | .4 Bedroom #4 |
| 12 | .1 Surface |
| 13 | .1 Plain Surface |
| | .01 Wall |
| | .02 & .04 No. 2 and No. 4 walls (this means it is rectangular) |
| 14 | .1 corners |
| | .02, .03, .04, .05 Corners (coordinates) |
| 15 | .1 Intersection Lines |
| | Surface floor to wall |
| | Surface ceiling to wall |
| | .02, .04 Width of the room |
| 16 | .0 No other information is needed at this point |
| 17 | .1 Discrepancy Yes |
| 18 | .3 Drawing |
| | .01 Denotation |
| 19 | .1 Correction |
| 20 | .4 Consistency |
| | .03 Correct Denotation |
| 21 | .1 Revision |
| 22 | .3 Intersection Line |
| | .02 & .04 Intersection line identification |
| | .01 Width |
| | .01 Minimize to nearest module |

After all of the building elements have been specified in terms of a universal numbering m which will be described hereinafter, each of the elements is analyzed, as illustrated at 16, for discrepancies. Discrepancies can be of a wide range of characteristics, such as errors in dimensions, non-code structures, directional ambiguities, or anything which is either non-code conforming or which is in error in the original construction drawings. Moreover, discrepancies referred to herein also include a lack of synchronization between the various elements, such that when placed together, errors occur. For instance, in the comparison of drawings, one can ascertain that a comer is supposed to be at one location as specified in one drawing, but is a centimeter or two removed in another drawing.

The sum total of the discrepancy detection and correction refers to the corrections associated with correcting the original construction drawings. Once the original construction drawings are corrected, it is a feature of the subject invention, that various dimensions and features of each of the building elements are revised so that they may be made with modular formworks. What this means is that the ordered information available as an output of the module which analyzes discrepancies and corrects the original construction drawings is modified, so as to be able to select a modular formworks element such as a panel, a predetermined length channel which holds the panel, or in fact, any of a variety of modular elements utilized to construct the formworks which in turn are utilized to construct the walls, ceilings, floors and other elements to be able to produce a structure corresponding to the original construction drawings.

It will be appreciated that a changing of dimensions, surfaces, comers or other features of a structure element so as to be manufacturable by the use of modular formworks permits the architect to design a structure without regard to the particular modular formworks structure employed in erecting the building. Thus, for example, if the original construction drawings would specify a wall having an arbitrary length, width and height, it would be apparent that it may not be possible to build such a wall with modular formworks due to the size of the modular formwork elements used in making the formworks. There may, for instance, be a one or two-inch difference between what is specified by the architect/engineer and that which is possible through the utilization of the modular formwork elements. It is at the point of the revision of the information corresponding to the construction drawings which alters, however slightly, the building or structural elements specified by the construction drawings to those which are manufacturable or erectable through modular formworks having predetermined modular elements.

It will be appreciated that the subject method depends on available modules, here shown at 19, so that the revision of the information from the original construction drawings can proceed. Alternative solutions to any given problem posed by revisions or otherwise can, as illustrated in 20, be added to the revised description of the building blocks; whereas additional information which affects the construction can be added as illustrated at 22. The alternatives and additional information are employed to alter the revised descriptions of the building blocks and therefore, add a level of flexibility such that the changes required by the alternatives and the additional information need not be made to the original construction drawings, but are rather made to the ordered information which has been revised to accommodate the particular modular elements in a modular formworks construction method.

Once having derived the revisions to the building or structural elements, there is nonetheless a necessity to generate instructions so that an artisan with very little training can assemble the modular formworks, thereby to permit the forming of concrete walls and the erection of a structure.

The modular formworks are described in the aforementioned two patents and include amongst many things the identification of the formwork elements through the utilization of an alphanumeric and color-coding system, such that instructions can be given to the artisan to merely select a modular formwork element having the prescribed number, and being connected to adjacent formwork elements through the utilization of pegs and apertures which are specified not only alphanumerically, but also conveniently specified by color coding. Thus, the artisan can put together an appropriately dimensioned and accurately positioned series of modular formwork elements through instructions generated at 24, so that by merely attaching the appropriate pegs to the appropriate apertures in the formwork modules, the artisan can provide an automatically aligned and automatically positioned set of formwork elements, whereby the pouring of concrete can commence in days as opposed to weeks.

Figure 2:
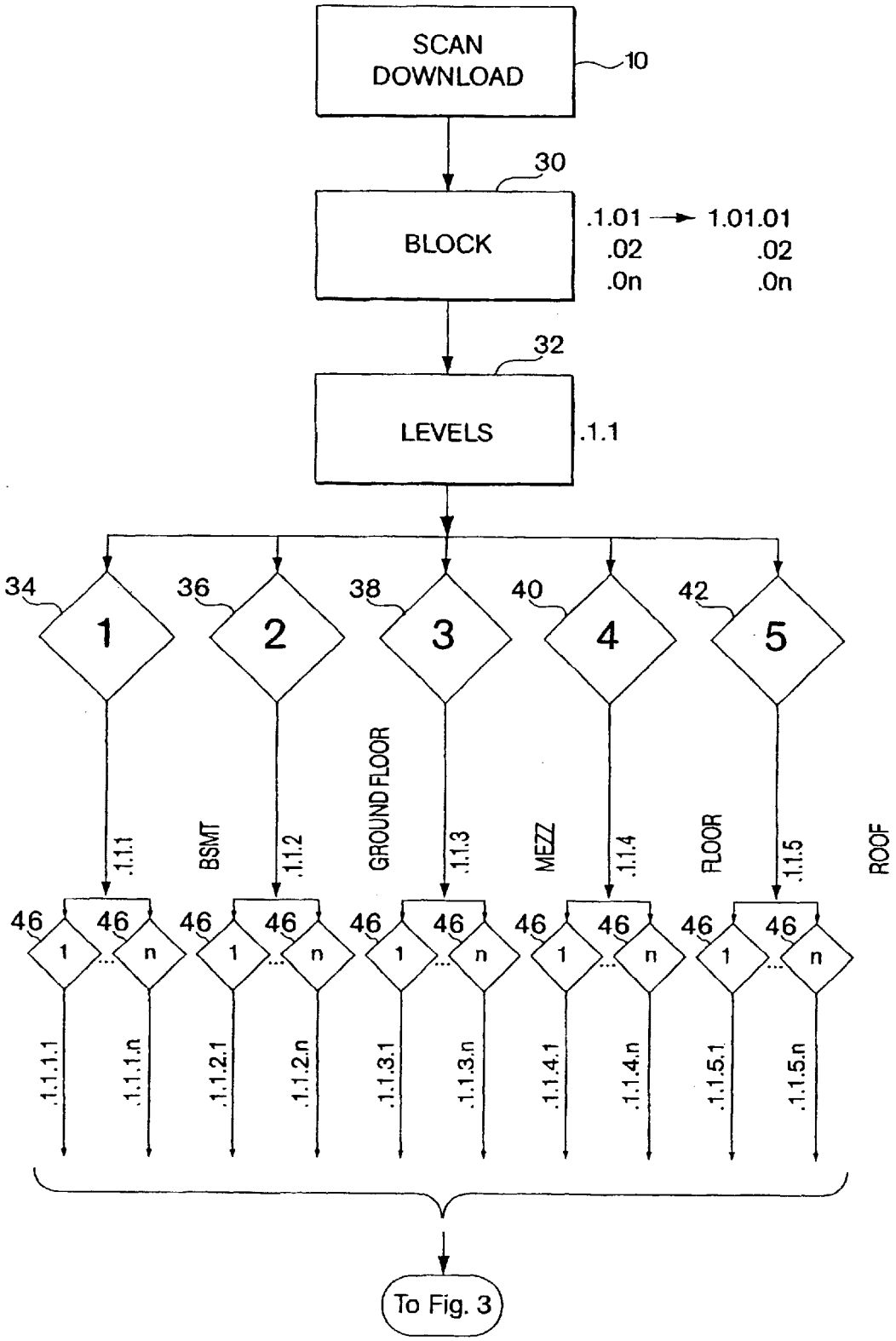
FIG. 2 is a flowchart showing the identification of the building elements from the scanned or downloaded construction documents, indicating the assigning of each block with a number and identifying levels in the physical structure of the building, followed by identification of which level is the basement, ground floor, mezzanine, above ground floor, or roof, with each of these levels being further subdivided into which levels are intended.

How the subject method operates, in one example is now discussed starting with FIG. 2. It will be appreciated that the system described requires the assigning of reference numerals in an ordered system so as to be able to completely specify each building block, both as to its location, and as to its configuration so that a completed set of information regarding all of the elements in the building can be uniquely specified through the numbering system.

Referring now to FIG. 2, the scanning or downloading available at 10 includes the identification at 30 of a block. In this context, a block refers to a separate structure within a building such as for instance a garage, an annex, an HVAC out building, or garage room. These blocks are identified by the reference numeral 1.01, meaning that the block 1 is subdivided into a block .01, which is in turn divided into further subdividing block .01 such that the item in question is designated by .01.01. Thus for instance, a shed .01 is in a garage .01 which is defined by "1" as a construction block.

After having described the various blocks which make up a building or building structure, as illustrated at 32, it then is incumbent upon the system to assign a level to the particular block. For instance, it might be said that the garage is on the ground level. It could be said that the garage may be in a sub-basement, or the garage may actually be at some level above ground level. The levels are described in terms of the reference numerals 1.1.1 indicating for instance a basement, as illustrated in FIG. 2 by reference numeral 34, a ground floor is indicated by reference numeral 36, a mezzanine is indicated by reference numeral 38, a floor indicted by reference numeral 40 or a roof indicated by reference numeral 42. It will be appreciated that the basement information is contained by the reference numerals 1.1.1 where the last numeral indicates the basement as being .1, the ground floor .2; the mezzanine .3, the floor .4 and the roof .5.

As can be seen in FIG. 2, further information about which floor the block is to be on is indicated by the next numeral to the right of reference numeral 4. Thus for instance, the second floor would be indicated by the reference numerals 1.1.4.2. For each of the designators for levels, the particular level within the level is indicated by the series of subdivision blocks 46.

It can thus be seen that building blocks can have every single one of its levels specified down to a fairly fine degree through the subject a subdividing technique.

Figure 3:
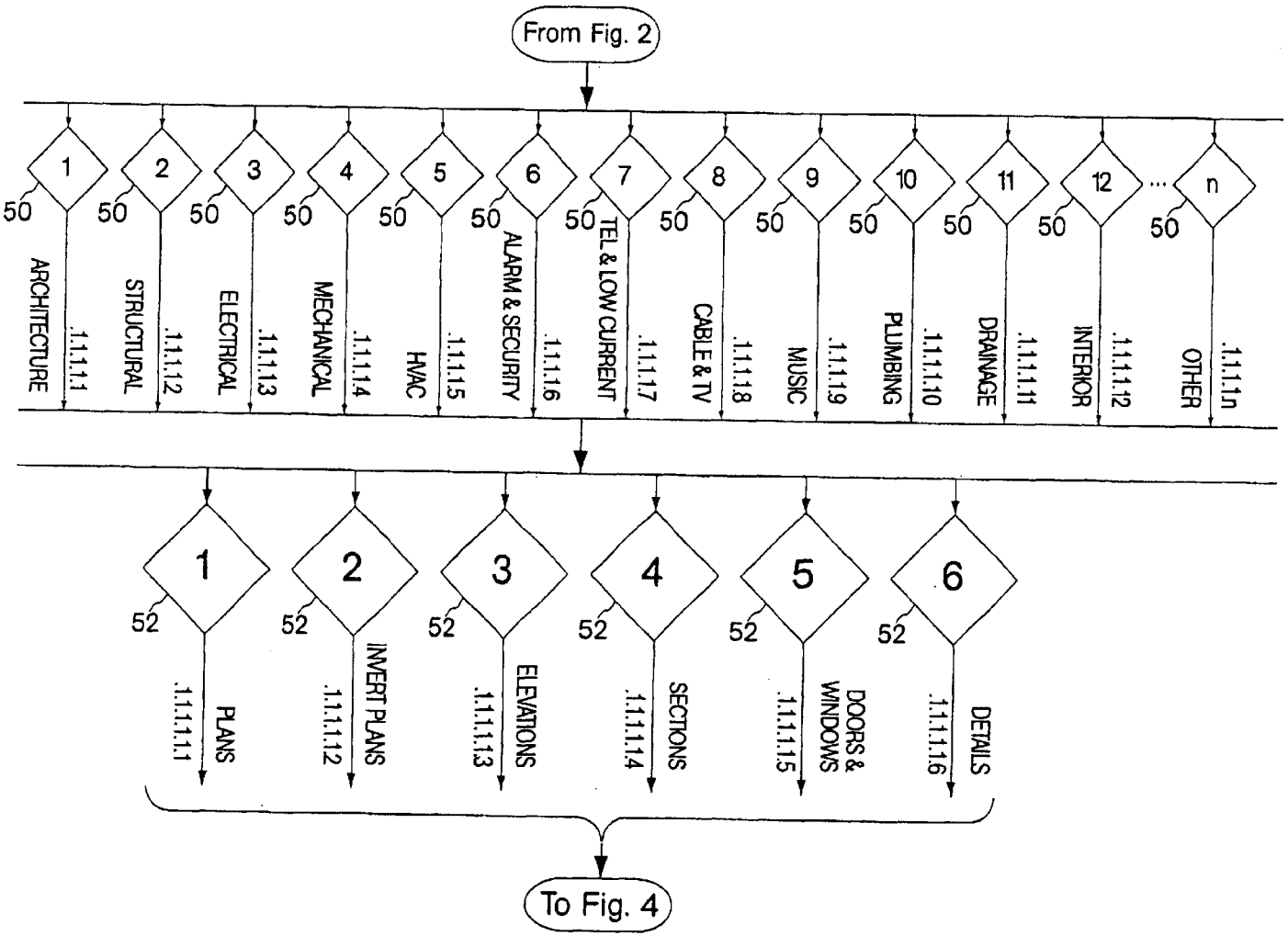
FIG. 3 is a flow chart indicating the type of drawings associated with the particular level or floor, illustrating architectural, structural, electrical, mechanical, HVAC, alarm and security, telephone and low current, cable TV, music, plumbing, drainage, interior, and other types of drawings, followed by the particular kind of drawing identified such as plans, invert plan, elevation, section doors windows, or details.

Referring now to FIG. 3, having described the blocks and levels, type of information relating to these blocks is now specified. For instance, if the building block at a predetermined level has architectural information, structural information, electrical information, mechanical information, HVAC information, alarm and security information, telephone and low current information, cable TV information, music related information, plumbing related information, drainage related information, interior related information, or other information, this information is coded through the addition of a numeral to the already formed chain. Thus, each of the subdividing blocks 50 is used to provide an ordered series of information in which each of the building blocks is related to some particular type of information. As can be seen, for instance, the HVAC information is for building block 1, level 1 of a basement 1, which is indicated by the reference numeral 5, indicating that the information is in fact HVAC information.

Thereafter, as illustrated by subdividing blocks 52, each of the particular information is located in either plans, invert plans, elevations, sections, doors and windows, or details so that the HVAC of the basement is specified by information related to the plans or elevations or sections or whatever is required. Thus, the reference numeral 3 added to 1.01.1.1.1.5 that blocks are the item which is considered ".01" indicates which block is considered ".1" indicates that levels are being considered. ".1" indicates which level in this case a basement ".1" indicates which basement. ".5" indicates HVAC drawings. ".3" means the elevation drawings.

Figure 4:
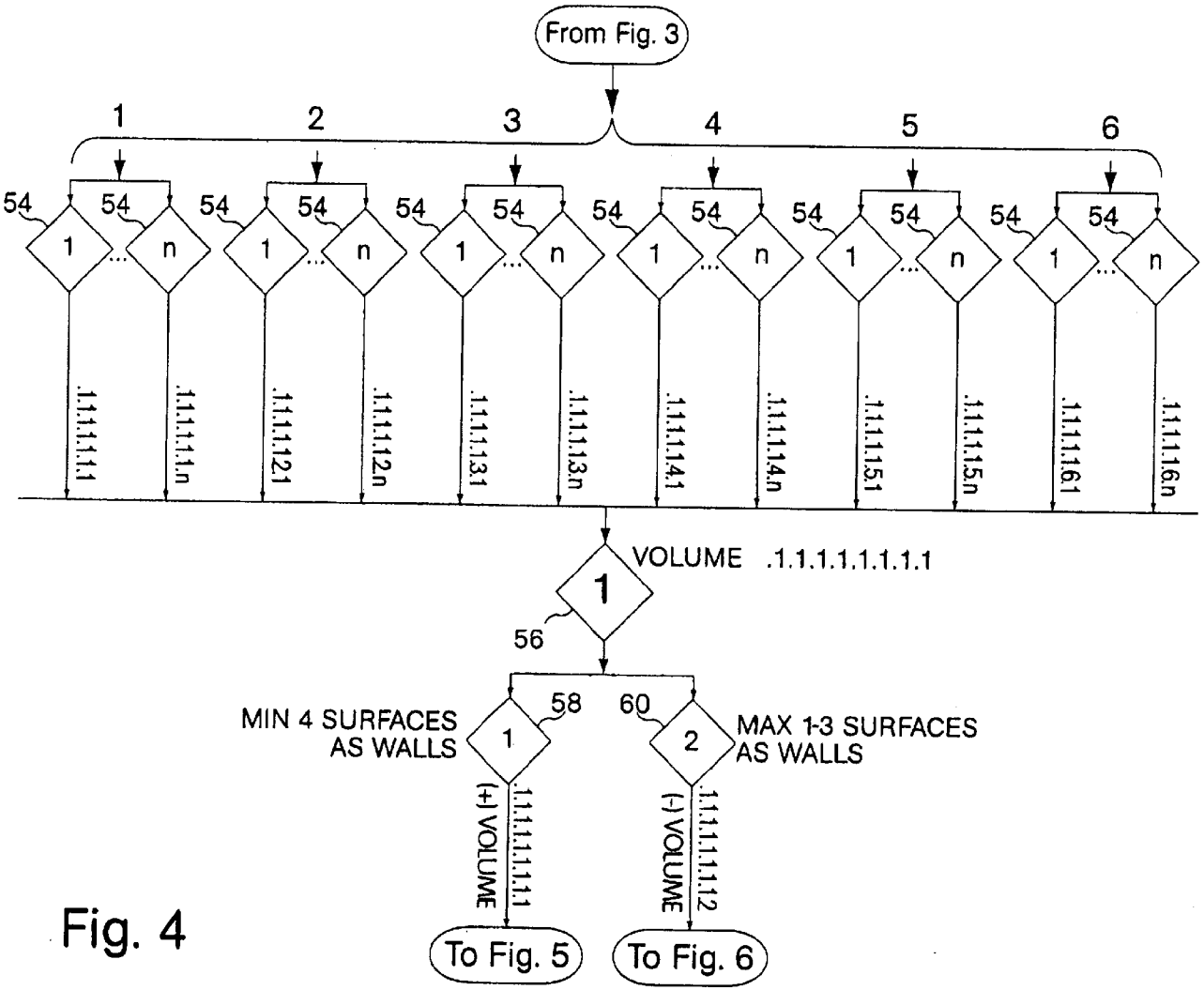
FIG. 4. is a flow chart showing the subdivision of each of the types of the drawings into the drawing number, also showing identification of the volume associated with the building component of the drawing, followed by whether or not the volume is a positive or negative volume.

Referring now to FIG. 4, subdivision blocks 54 refer to which drawing is of interest. Thus, for instance, as illustrated by, 1.1.1.1.5.3.1–n refers to for this instance, the fact that the section for the HVAC has a drawing associated with it from 1 to n.

Thereafter, which volume is intended is ascertained at 56. Here, seven identifying reference numerals have preceded this point, with the eighth position specifying that volume information is intended. Here it can be seen that the number 1 means volume. Volume refers to the volume of a particular room or enclosed structure which houses, for instance, the HVAC. As can be seen here, the volume is specified either as an enclosed structure having a minimum of four surfaces such as walls or a maximum of 1–3 surfaces such as walls. This refers to the characterization of the volume as being either positive or negative such that subdividing block 58 indicates a positive volume, whereas block 60 indicates a negative volume. The reference numeral position indicating a positive volume by a 1 is in the $9^{th}$ position, whereas a negative volume is a 2 in the $9^{th}$ position.

Figure 5:
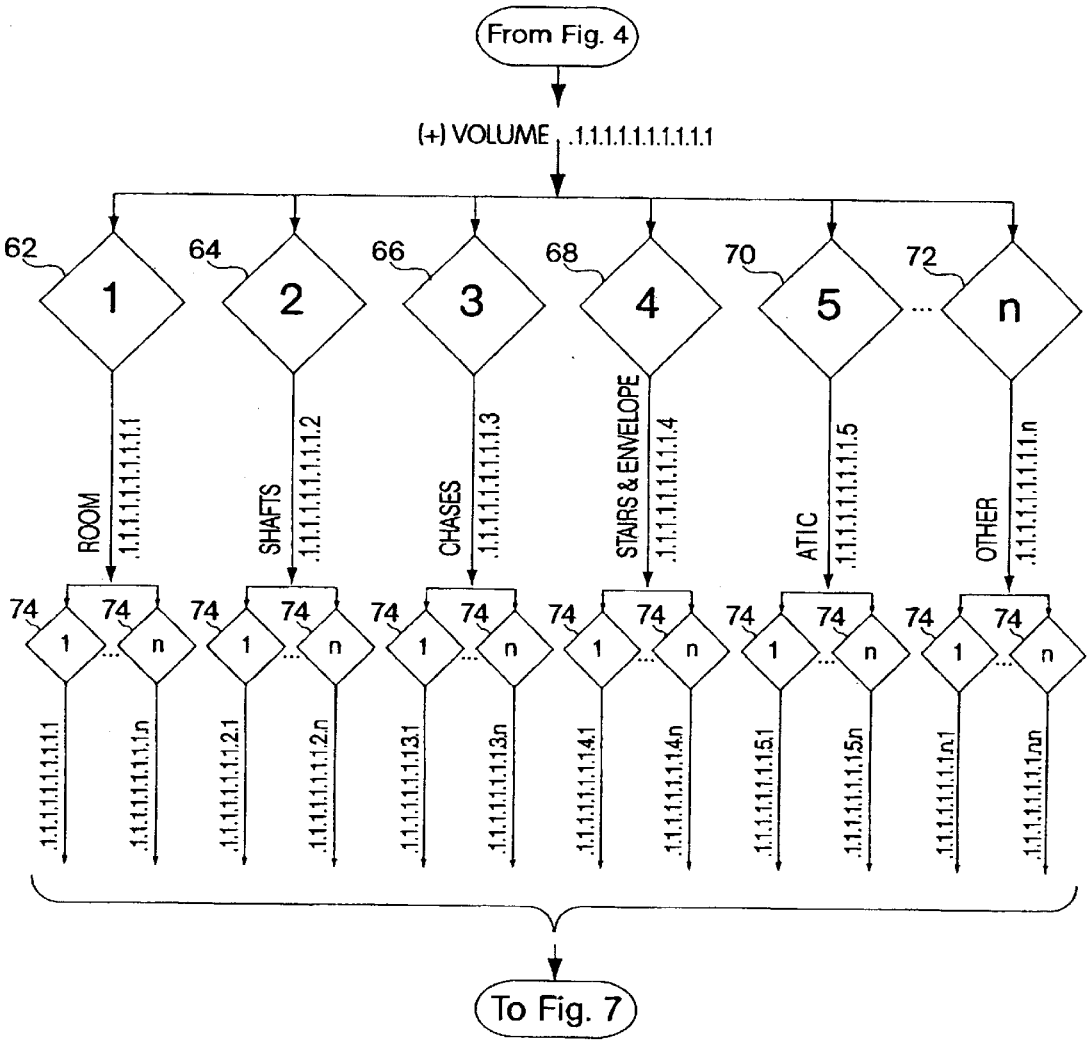
FIG. 5 is a flow chart showing a subdivision of the positive volume into for instance, rooms, shafts, chases, stairs, attic, or other items, again subdivided into which room, which shaft, which chase, which stairs or envelope, which attic, or other things identified.

Referring now to FIG. 5 and taking for instance a positive volume, subdividing blocks 62–72 refer to the volume in the case of "1" being a room, "2" being a shaft, "3" being a chase, "4" being stairs or an envelope, "5" being an attic, or "n" being some other volume. Thus, a room is specified in the $10^{th}$ position as being ".1", whereas a shaft is indicated as being ".2", a chase is indicated as being ".3", stairs and envelope is indicated by ".4", an attic is indicated by ".5", or other structures indicated by ".n". Each of these volumes is in turn subdivided at the subdividing blocks 74 to subdivide the volume corresponding to a room into a number of rooms, whereas the other subdividing block 74 indicates subdividing the shafts into numbers of shafts, the chases into numbers of chases, the stairs and envelopes into numbers of stairs and envelopes, the attics into numbers of attics and so forth.

Thus, the $11^{th}$ position defined by subdividing block 74 refers to the number of the rooms, shafts, chase, stairs, attic and so on. For instance, the room number may also refer to whether the room is a kitchen, a bath, a bedroom, and so on.

Figure 6:
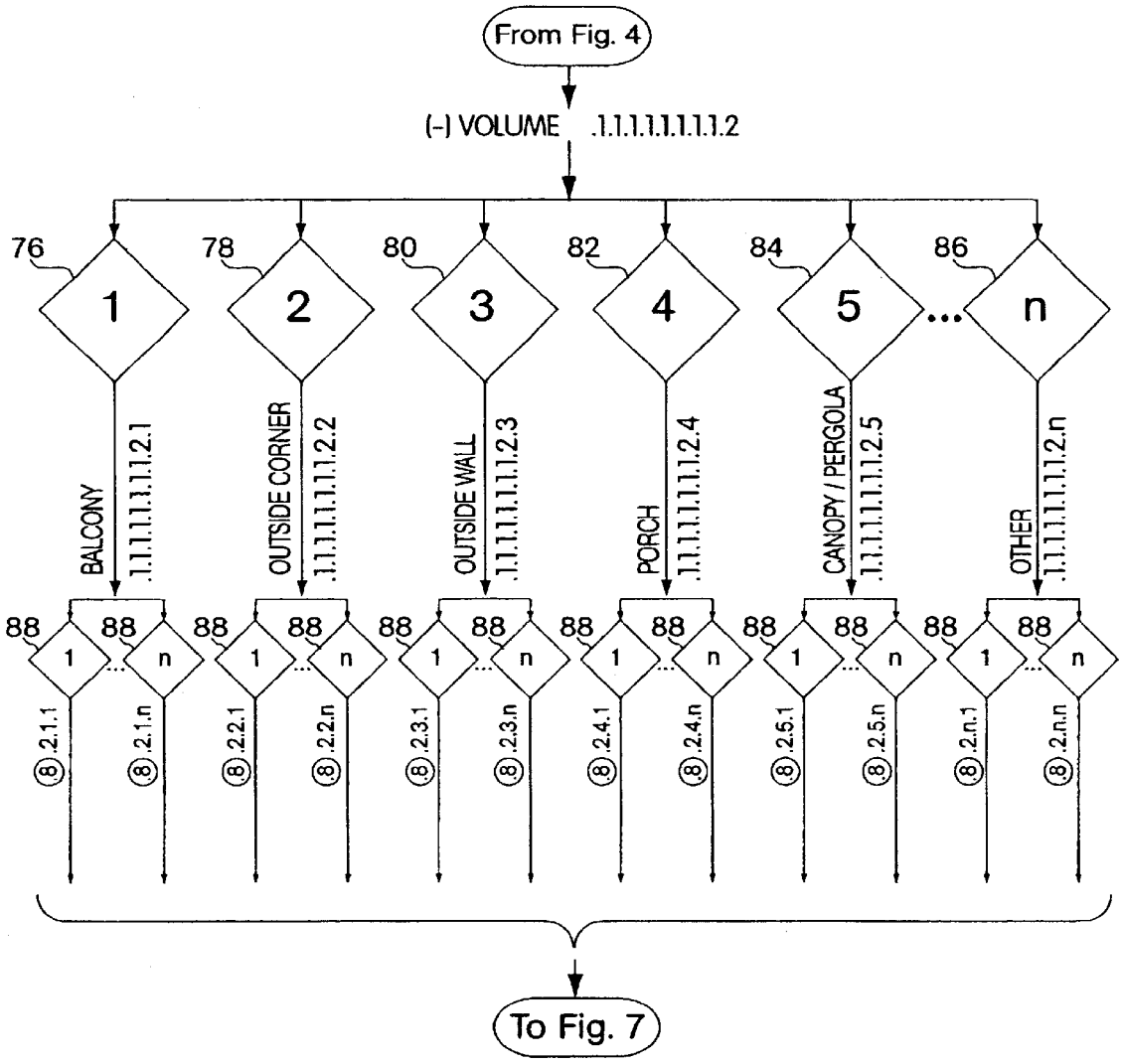
FIG. 6 is a flow chart of the subdivision of the negative volume into for instance, balconies, outside corners, outside walls, porches, canopies, or other items, with these items further being subdivided to which balcony or item is identified.

Referring now to FIG. 6, the same is established for negative volumes, with subdividing blocks 76–86 referring respectively to balconies, outside corners, outside walls, porches, canopies/pergola, and other negative volume structures. Again, as illustrated by subdividing block 88, which balcony, which outside comer, which outside wall, which outside porch, which canopy/pergola, or which other structure is described or identified in the $11^{th}$ reference numeral position in the string.

Figure 7:
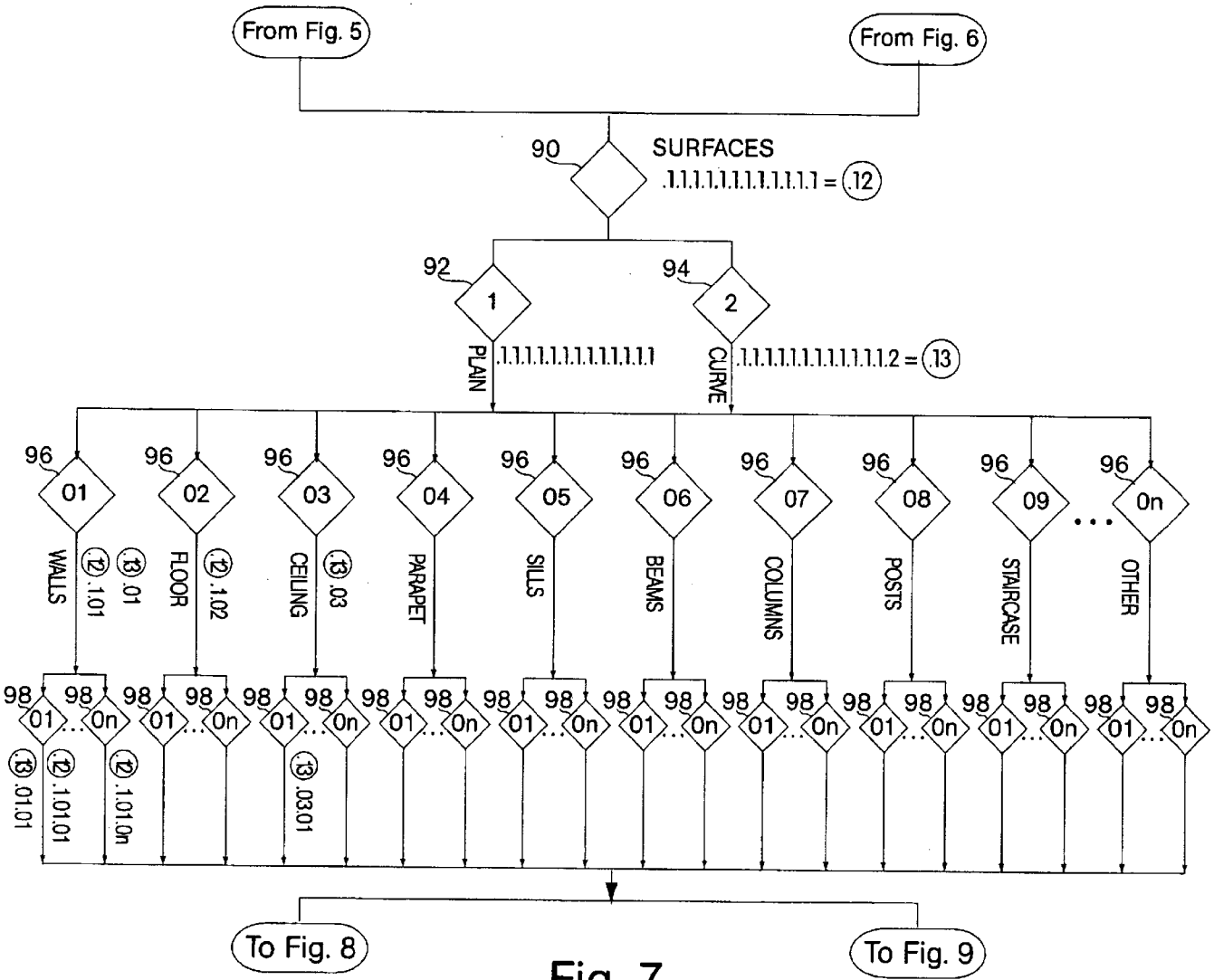
FIG. 7 is a flow chart identifying the surfaces of the volumes of the flow charts from FIG. 5 or 6, along with the assigning of either a plane or curved surface to the particular volume, followed by the identification or subdivision of what kind of surface is identified, be it a wall, floor, ceiling, parapet, sill, beam, column, post, staircase, or other component, with these components being further subdivded as to which wall, floor, ceiling, parapet, sill, beam, column, post, or staircase identified.

Referring now to FIG. 7, having characterized the volumes it then is incumbent upon the system to characterize the surfaces. This is accomplished at 90 in the $12^{th}$ reference numeral position, "1" as illustrated at 92 refers to a plain wall, whereas a "2" in this position as illustrated 94 refers to a curved wall. Thereafter, as indicated in subdividing block 96 refers to walls, floors, ceilings, parapets, sills, beams, columns, posts, staircases, and other elements, such that the surface defining such elements can be specified as either plain or curved. Thereafter, as illustrated in subdividing which wall, floor, ceiling, parapet, sill, beam, column, post, staircase or other element is identified by a subdivision after the $13^{th}$ reference numeral position. Thus, the $12^{th}$ reference numeral position defines that it is a surface which is intended, and the $13^{th}$ reference numeral position defines whether the surface is plain or curved. The nomenclature 13(.01) refers to a subdivision of 13 and defines what the surface is, be it a wall, floor, ceiling, parapet, sill, beam, column, post, staircase or other element. The 13.01(.01)

nomenclature refers to a subdivision of 13.01 and defines what wall floor, ceiling, parapet, sill, beam, column, post, staircase or other element is intended.

Figure 8:
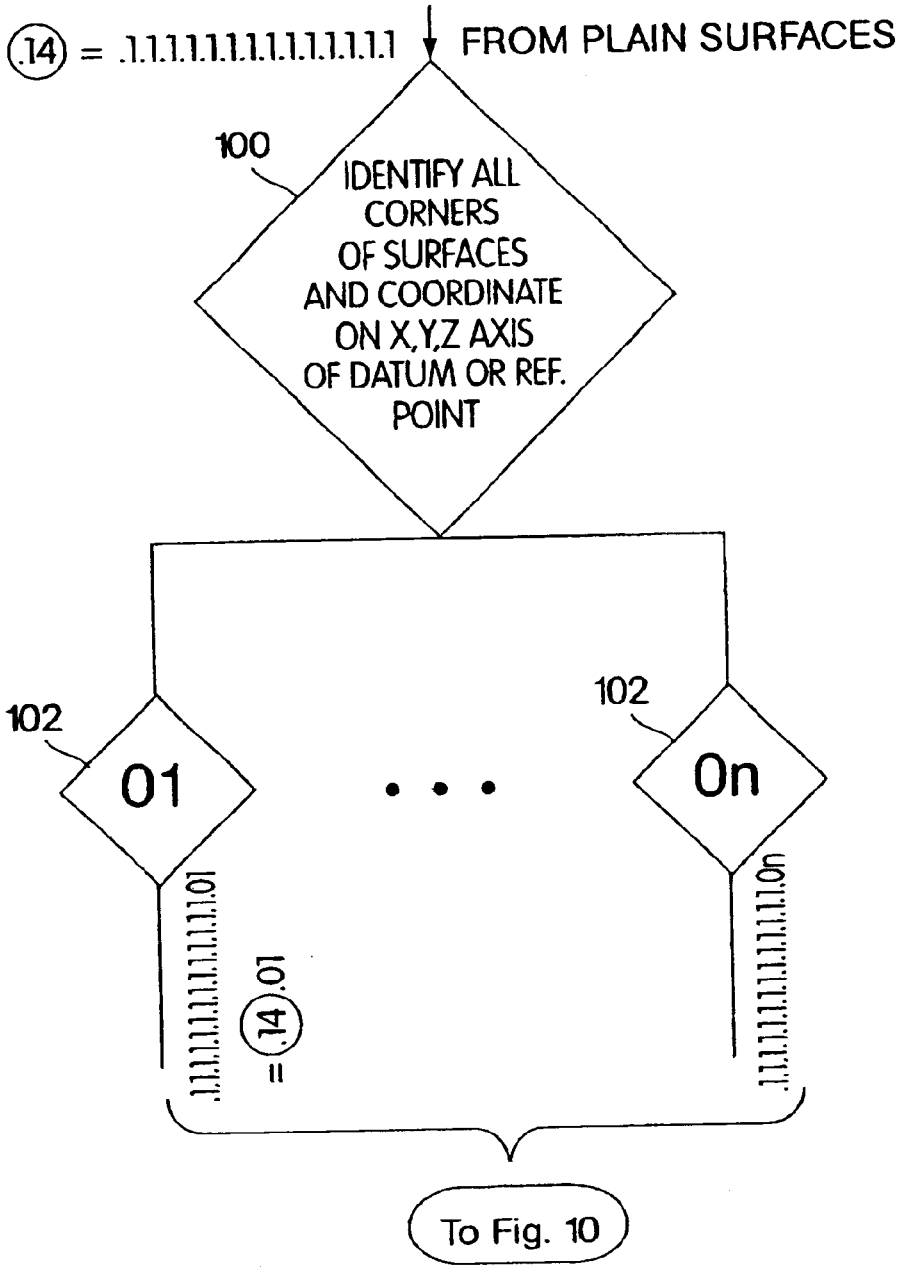
FIG. 8 is a flow chart illustrating the identification of the comers of the surfaces; also indicating the identification of which corner is identified.

Referring now to FIG. 8, from plain surfaces, the $14^{th}$ position identifies all of the corners of the surfaces, and the coordinates on an X, Y, and Z-axis of a datum or reference point. This is illustrated at subdividing block 100. Thus the $14^{th}$ reference numeral position defines the comers, whereas the subdividing block here as illustrated at 102 defines which corner is intended.

Figure 9:
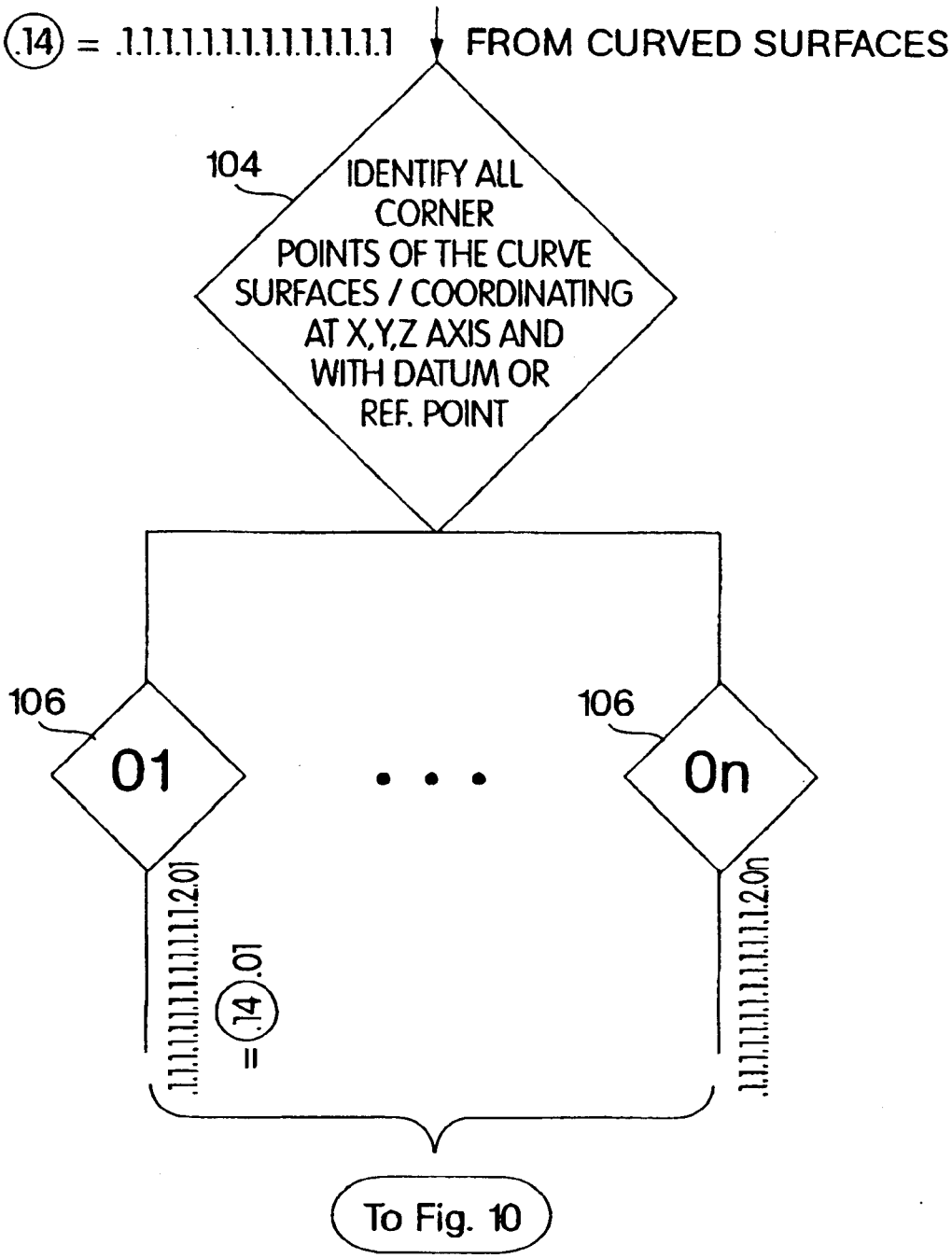
FIG. 9 is a flow chart illustrating the identification of the comers associated with curved surfaces, also identifying which corner is identified.

Referring now to FIG. 9, while in FIG. 8 plain surfaces had corners identified, in this figure, curved surfaces have their corner points identified as illustrated at 104. Which curved surface is intended is illustrated by subdividing block 106 such that the $14^{th}$(.01) reference numeral position identifies which corners of the curved surface are intended.

Figure 10:
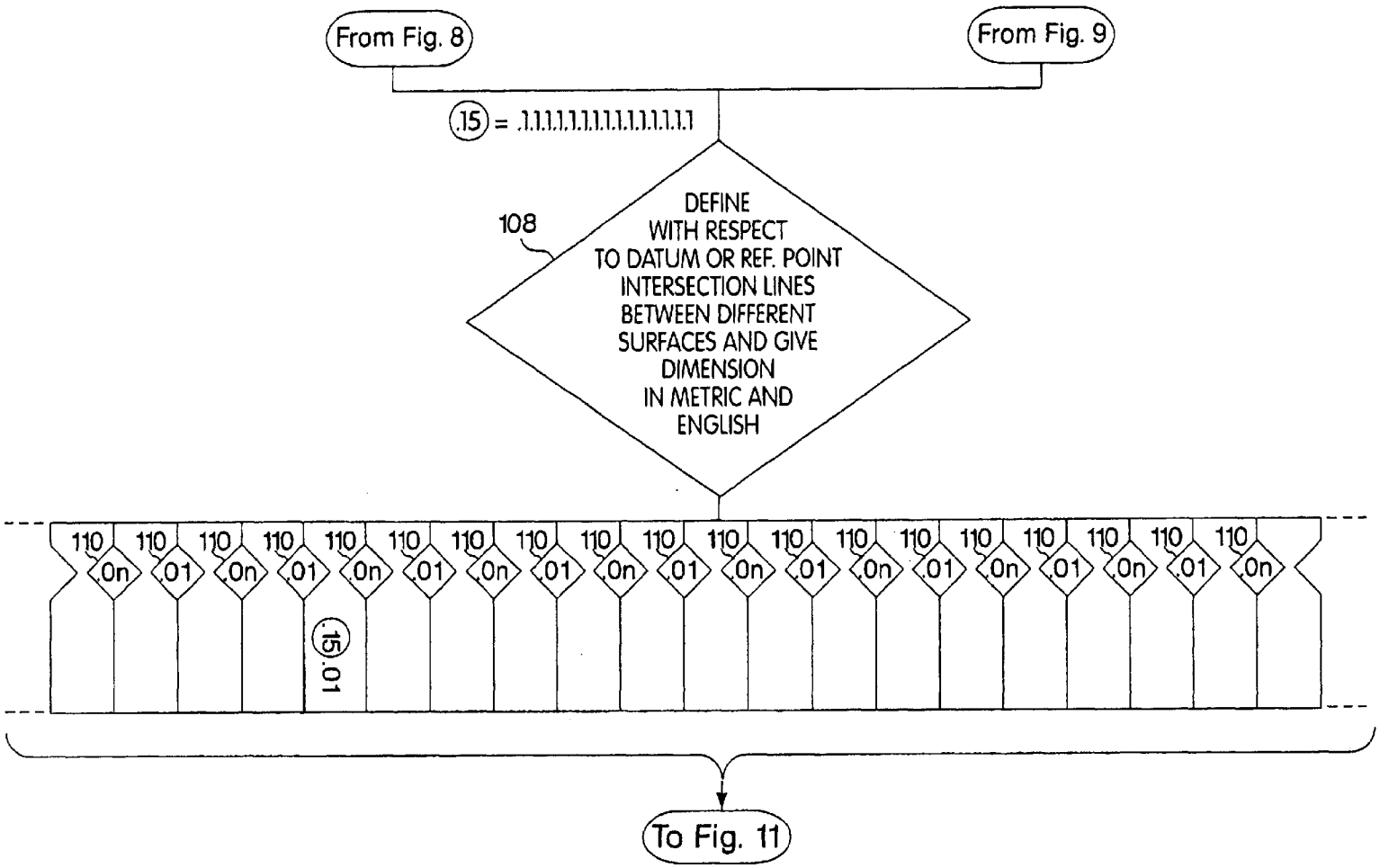
FIG. 10 is a flow chart for defining with respect to a datum or reference point, all intersection lines between different surfaces, and to provide the dimension of the intersection lines for the particular numbered intersection lines indicated.

Referring now to FIG. 10, once having defined the corners, the $15^{th}$ reference numeral position represents the intersection lines between different surfaces and gives the dimensions of the surfaces in either English or metric units. This is illustrated at 108, with the subdividing block 110 determining in the $15^{th}$(.01) reference numeral position, which intersection line is intended.

Figure 11:
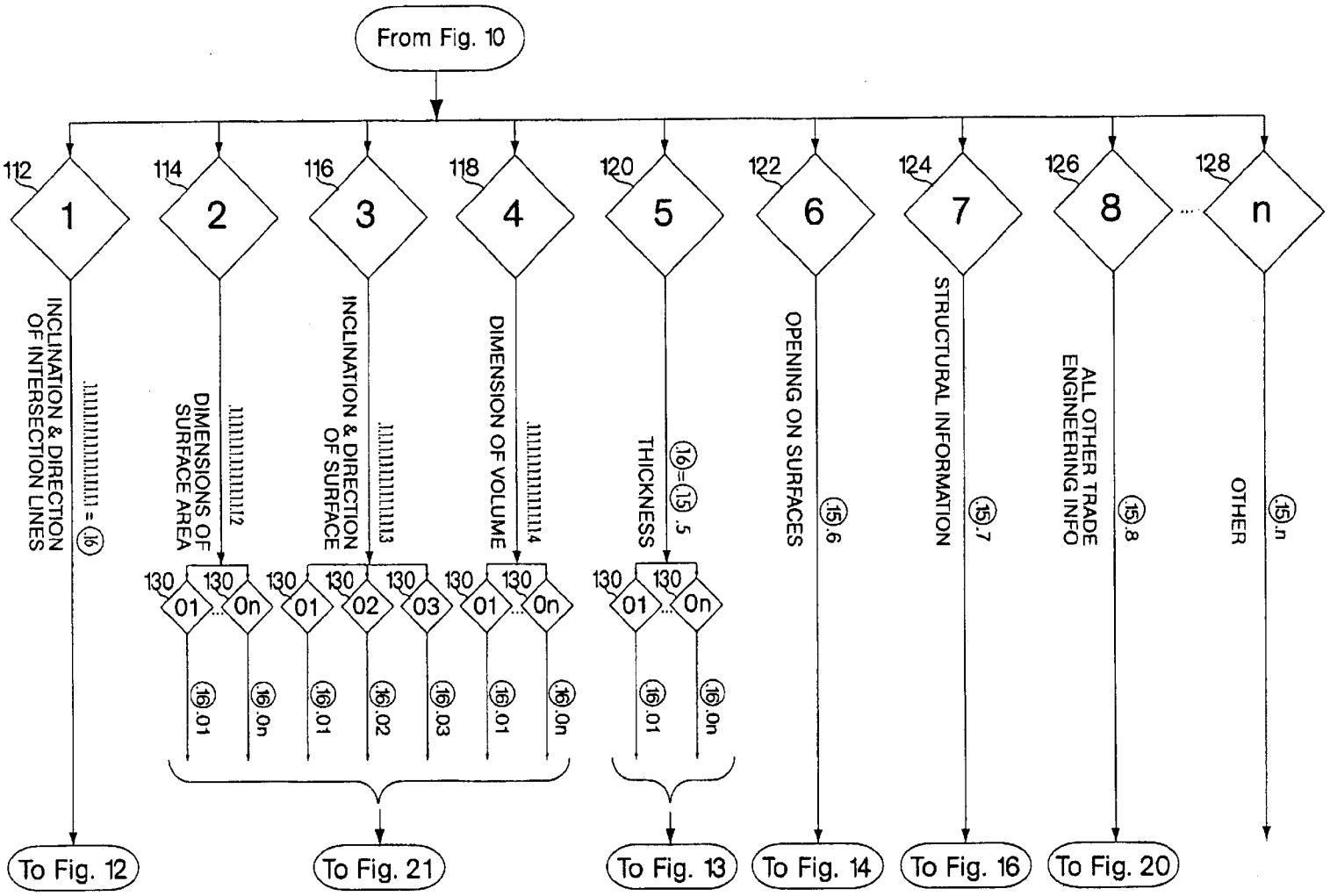
FIG. 11 is a flow chart showing the assigning of inclination and direction of intersection lines, the dimensions of the surface area, the inclination and direction of surfaces, the dimensions of volumes, the thickness, the opening on surfaces, other structural information, and all other trade engineering information based on the intersection lines related to coordinates.

Referring now to FIG. 11, once having defined the intersecting lines, all of the information is collected such as information about inclination and direction of intersection lines as illustrated by "1" as here shown by subdividing block 112, whereas the dimensions of a surface area are collected at block "2" here illustrated at 114, the inclination and direction of a surface illustrated at "3" illustrated at block 116, the dimension of a volume as illustrated at "4" at block 118, the thickness of a wall or surface at "5" at block 120, the openings on surfaces at "6" at block 122, structural information at "7" at 124, all other trade engineering information at "8" at block 126, and other information at "n" as illustrated at 128. The type of information is available at the $16^{th}$ reference numeral position so that all of the aforementioned surfaces can be defined by intersecting lines, comers, directions, and thickness as well as dimensions of the volume. All other trade engineering information refers to in one instance, electrical information, mechanical information, HVAC information, plumbing information, and other types of engineering information. The type of information is specified in the $16^{th}$ reference numeral position with subdivisions occurring in one embodiment as illustrated by subdividing block 130 for dimensions of particular surface areas, inclination and direction of particular surfaces, and dimensions of particular volumes. This information is carried in the $16^{th}$(.01) reference numeral position. Likewise, thickness of particular surfaces is identified in reference numeral position $16^{th}$.

Figure 12:
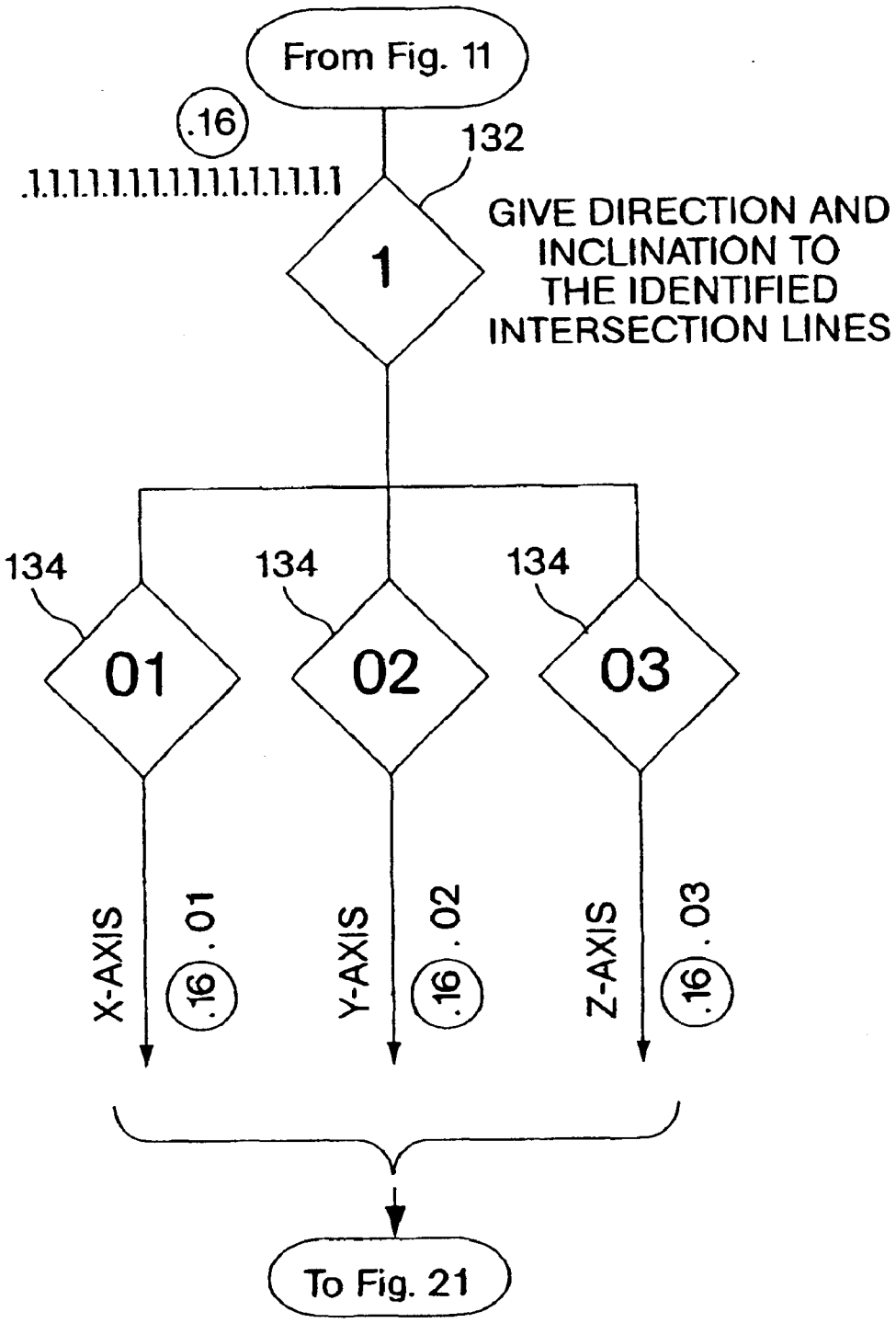
FIG. 12 is a flow chart showing the subdividing of the inclination and direction of intersection lines into an X axis, Y axis and Z axis.

Referring now to FIG. 12, direction and inclination to the identified intersection lines is given as illustrated at 132 to be in the $16^{th}$ reference numeral position, with subdividing block 134 providing the X-axis, Y-axis and Z-axis identifications in the $16^{th}$(.01)–(.03) reference numeral positions.

Here ".01" refers to the X-axis, ".02" refers to the Y-axis, and ".03" refers to the Z-axis.

Figure 13:
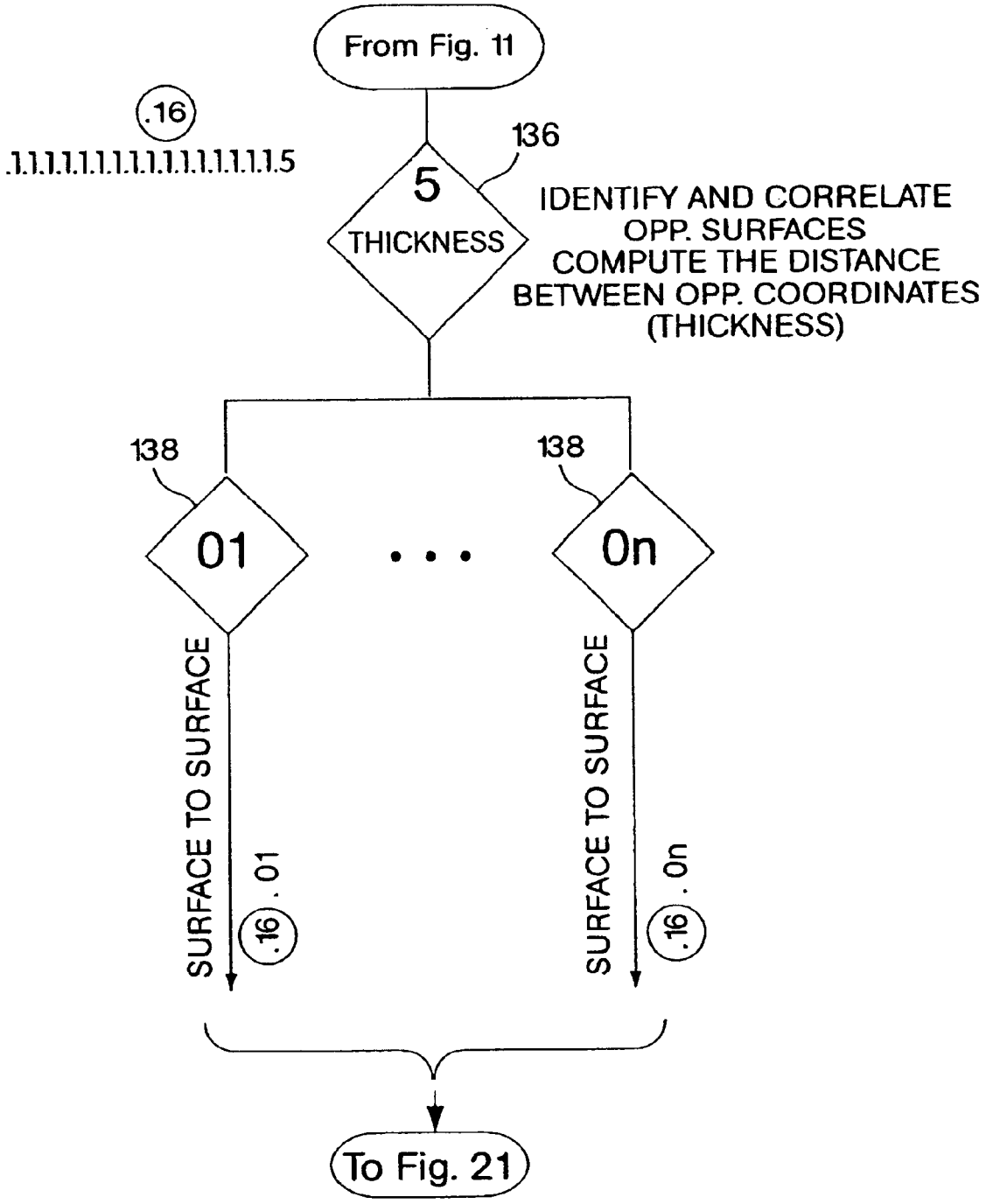
FIG. 13 is a flow chart showing the subdivision of the thickness of a given building component into surface to surface thickness for different surfaces.

Referring now to FIG. 13, as to thickness, as indicated in the $16^{th}$ reference numeral position, the thickness may be identified. This is accomplished as illustrated at 136, with the "5" indicating thickness, and with subdividing block 138 indicating surface-to-surface thickness of the indicated surface. The indicated surface is at the $16^{th}$(.0 1–.0n) reference numeral position.

Figure 14:
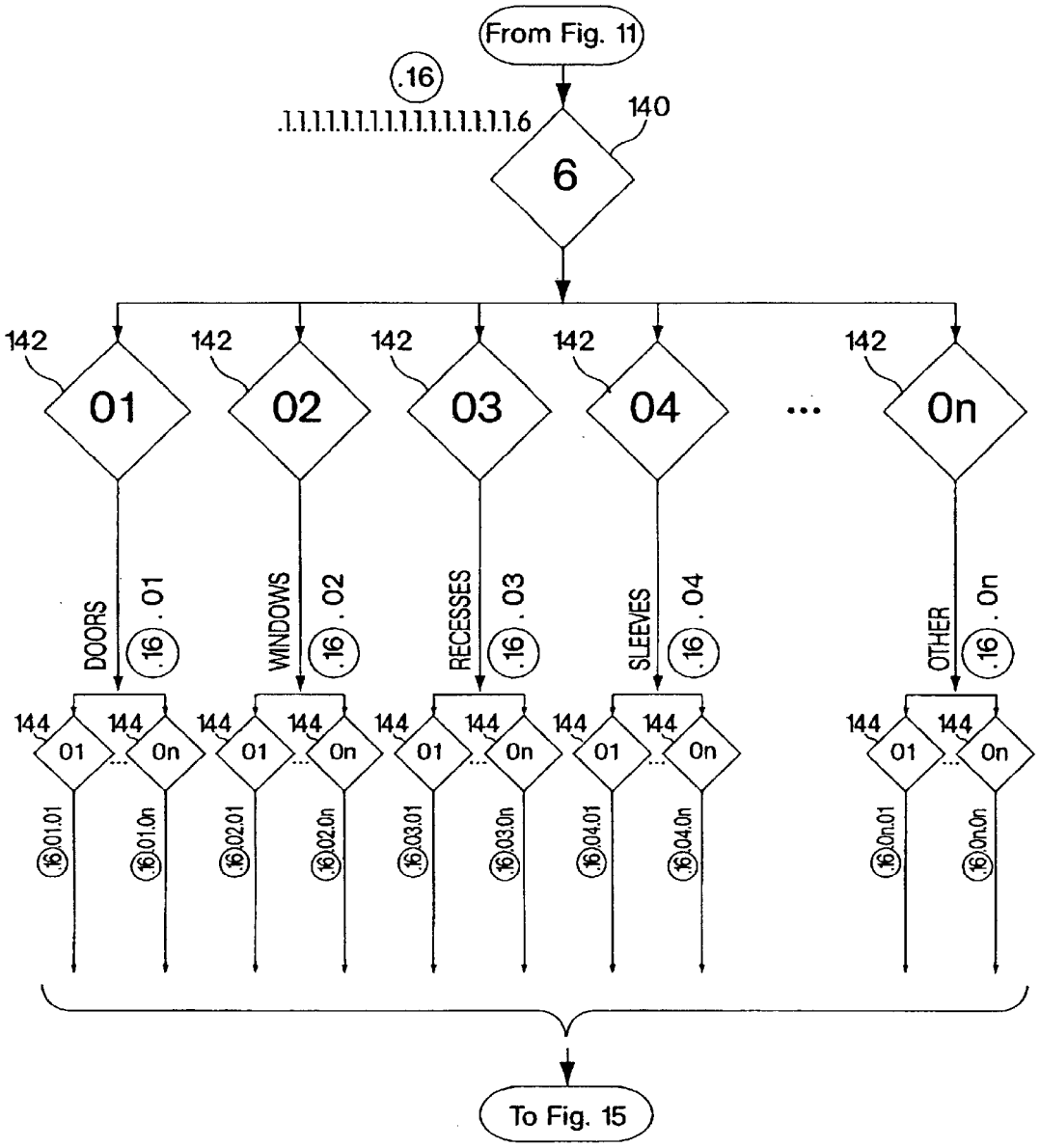
FIG. 14 is a flow chart showing a subdivision of the opening on surfaces into doors, windows, recesses, sleeves or other openings, also showing the subdivision of each of these items into which door, window, recess, sleeve or other item its number is.

Referring now to FIG. 14, "6" in subdividing block 140 indicates that openings on surfaces is intended. Subdividing blocks 142 from "01" to "0n" refer respectively to doors, windows, recesses, sleeves and other items. Subdividing block 144 at the $16^{th}$ reference numeral position at (.01) (.01–.0n) indicates which door, window, recess, sleeve or other item is intended.

Figure 15:
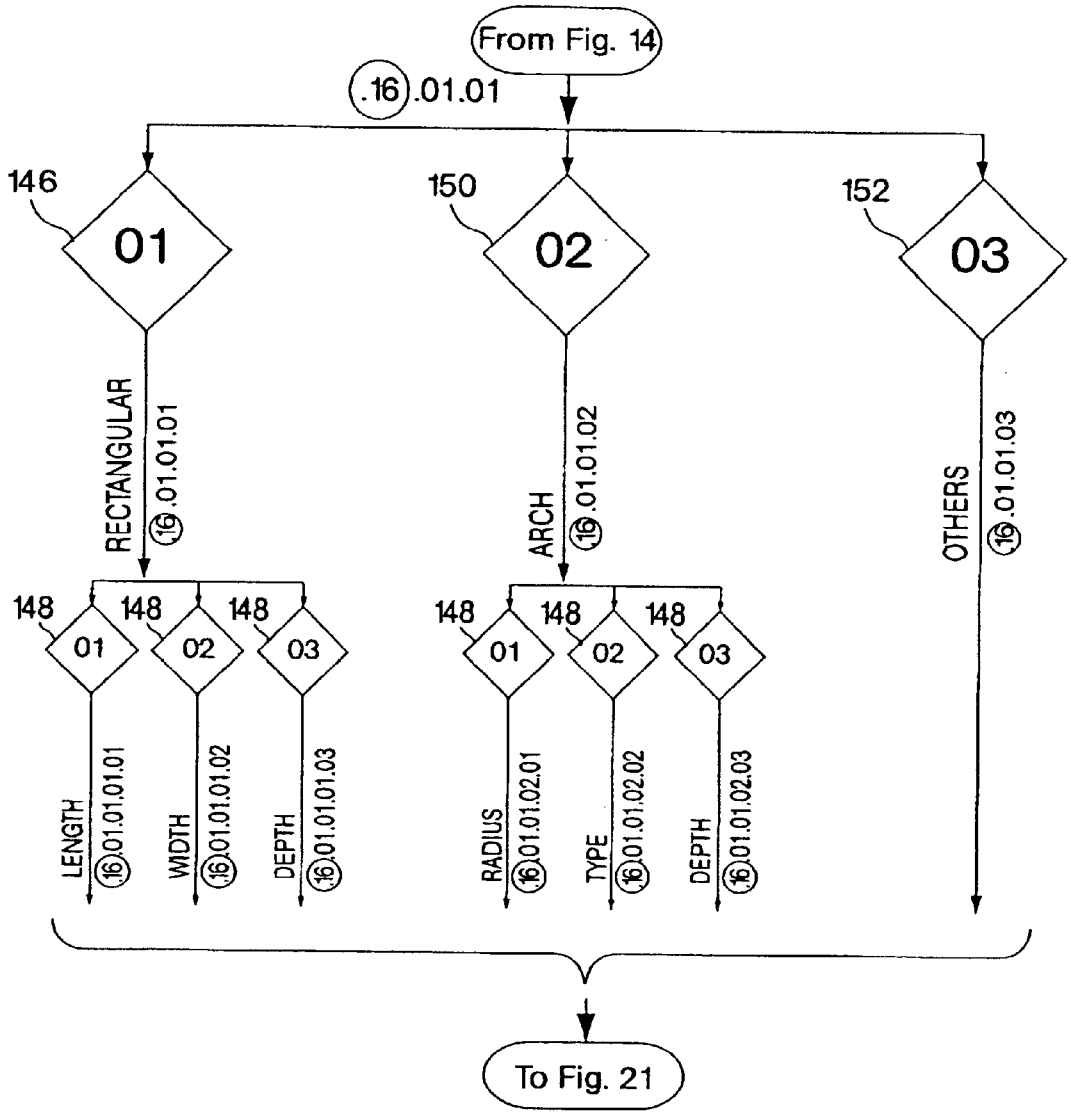
FIG.15 is a flow chart showing the subdivision of the openings, whether the configuration of the opening is rectangular, arch, or other shape, with the rectangular shape being defined by length, width and depth, with the arch being defined as a radius type and depth, and with the other types of components being identified appropriately.

Referring now to FIG. 15, the nomenclature ".01" in subdividing block 146 indicates that a door is intended. Whether or not this door is rectangular or not is specified in the $16^{th}$ reference numeral position at 01.01.01, with the length, width or depth of such rectangular structure illustrated by subdividing block 148 in the $16^{th}$ reference numeral position by .01.01.01(.01–.03).

The "02" legend in block 150 indicates that the structure is an arch, with subdividing block 148 defining the arch by its radius type, and depth. This is accomplished in the $16^{th}$ reference numeral position by 01.01.02(.01–.03).

Figure 16:
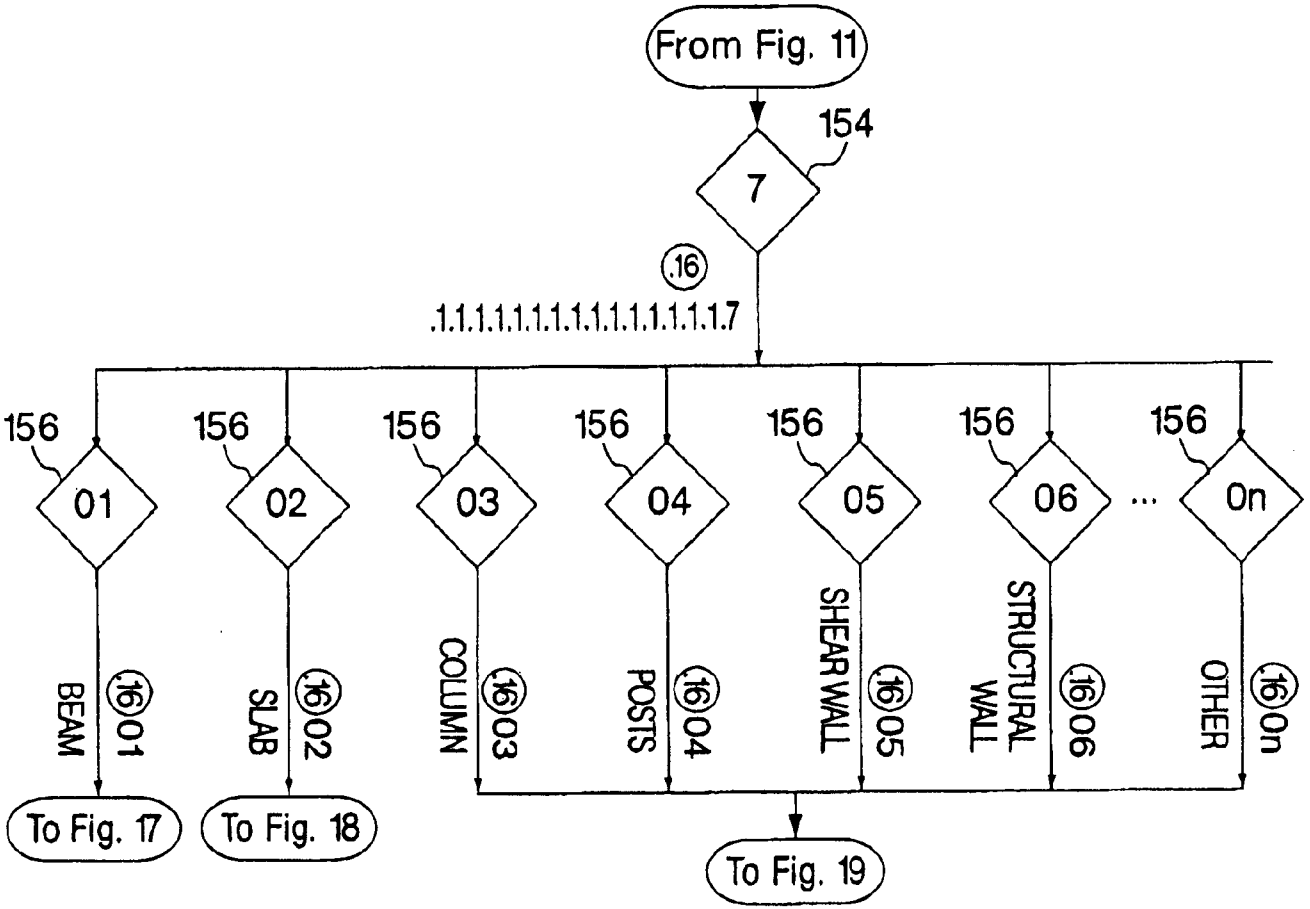
FIG. 16 is a flow chart showing a subdivision of structural information into beams, slabs, columns, posts, sheer walls, structure walls and other types of low bearing components.

Referring now to FIG. 16, as to structural information as indicated by "7" in subdividing block 154, structural information is identified as being a beam, slab, column, post, sheer wall, structural wall or other item in subdividing block 156 in the $16^{th}$.01 reference numeral position.

Figure 17:
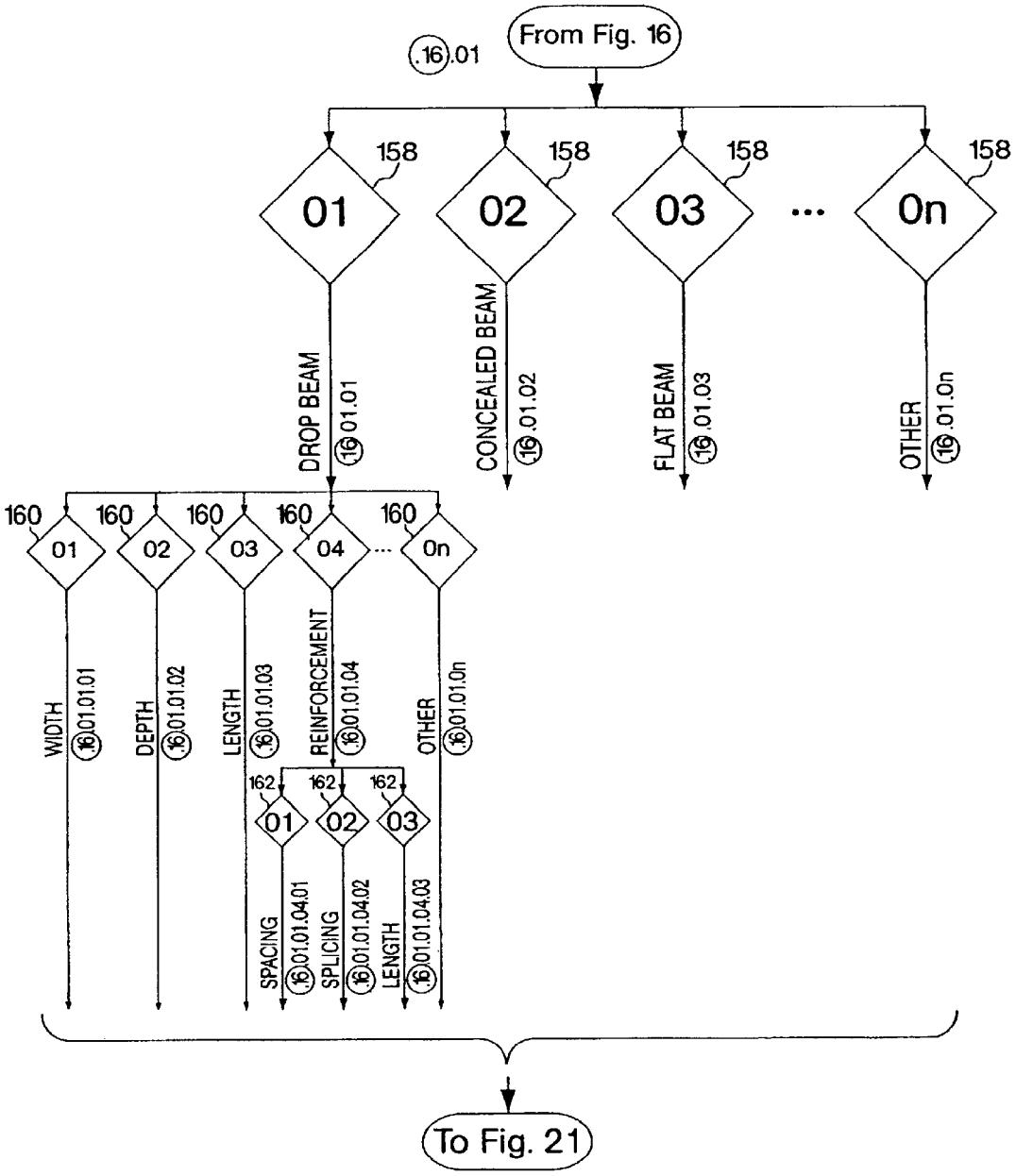
FIG. 17 is a flow cart showing the subdivision of beams into drop beams, concealed beams, flat beams and other types of beams, with each of the beams being further subdivided dimensionally in terms of width, depth, length, reinforcement and other characteristics, with reinforcements being further subdivided into spacing, splicing and length.

Referring now to FIG. 17, the $16^{th}$ .01 reference position indicates a beam is intended. The nomenclature "01", "02", "03" and "0n" in subdividing block 158 indicates what type of beam is intended, namely a drop beam, a concealed beam, flat beam, or other type of beam as illustrated.

As illustrated in subdividing block 160, the characteristics of a particular beam are indicated as to its width, depth, length, and reinforcement or other in the $16^{th}$ reference numeral position as (.01.01.01).

Moreover, as illustrated by subdividing block 162, as to reinforcement, the spacing, splicing, or length is specified in the $16^{th}$ reference numeral position as .01.01.04(.01–.03).

It will be appreciated that the specification of the beams in terms of the 160 and 162 positions is repeated for concealed beams, flat beams, or other types of beams (not shown).

Figure 18:
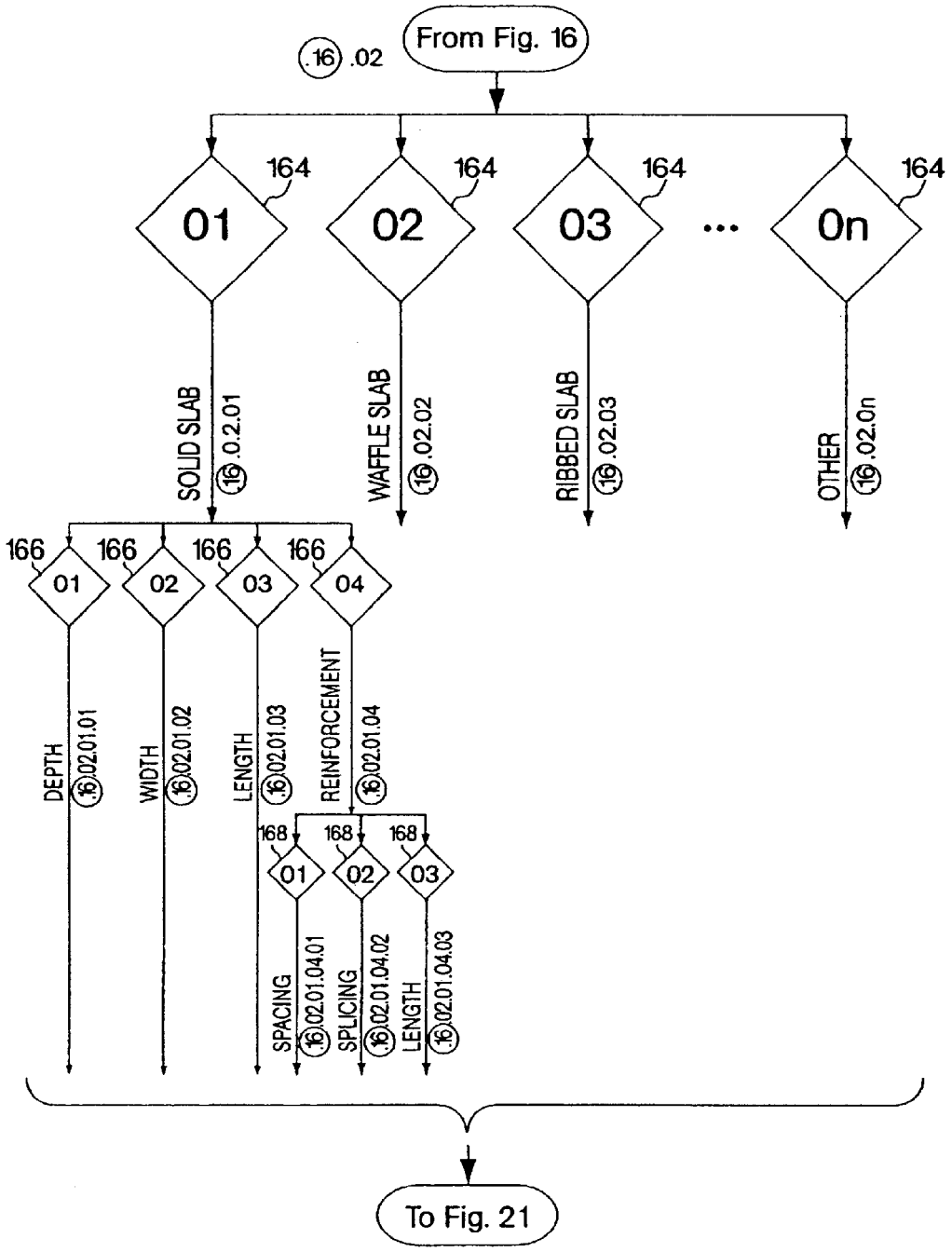
FIG. 18 is a flow chart showing the subdivision of slabs into solid slabs, waffled slabs, ribbed slabs, and other slabs, with each of the solid slabs being further characterized and subdivided in terms of width, length, and reinforcement, with the reinforcement again being subdivided into spacing, splicing and length.

Referring now to FIG. 18, for slabs, which is indicated by .02, what type of slab is intended is illustrated by subdividing block 164 in which block "01" refers to a solid slab, "02" refers to a waffle slab, "03" refers to a ribbed slab, and so forth.

Subdividing block 166 specifies the depth, width, length and reinforcement of a particular slab at .02.01.01, whereas as to reinforcement, and as before, subdividing block 168 refer to the type of reinforcement, including spaces, splicing and length by .02.01.04.01.

This type of characterization characterizes waffle slabs, ribbed slabs and other types of slabs as will be appreciated.

Figure 19:
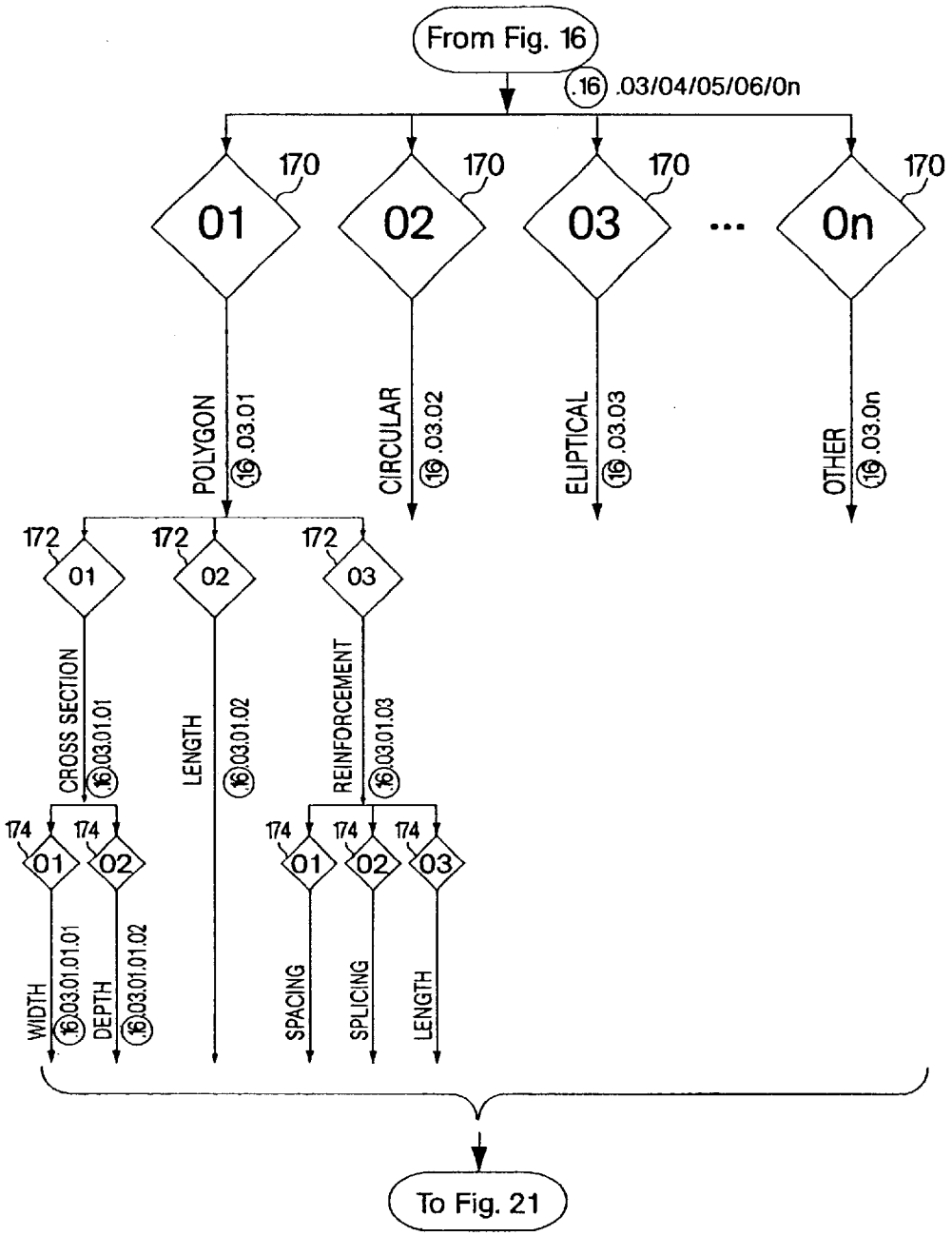
FIG. 19 is a subdivision of the characteristics of a column, post, sheer wall, structural wall, or other structure subdivided into whether or not the shape of the structure is a polygon, circular, elliptical, or other shape, with the polygon structure being further subdivided into cross-sectional dimensions, length and reinforcement, with the cross section being further identified by width and depth, with the polygon also being described in terms of length, and further with the reinforcement being further subdivided into spacing, splicing and length.

Referring now to FIG. 19, as indicated by the designation 03/04/05/06/0n, what is selected is the column, post, shear wall, structural wall or other wall so as to be able define its shape. Here, as illustrated at subdividing block 170, "01" refers to a polygonally shaped object, "02" refers to a circular shaped object, "03" relates to an elliptically shaped object, etc. The shape is defined by (.03.01), whereas subdividing blocks 172 and 174 define the cross section length and reinforcement at .03.01(.01–.03), with the width and depth or spacing, splicing and length carried in the by .03.01.01.01.

Figure 20:
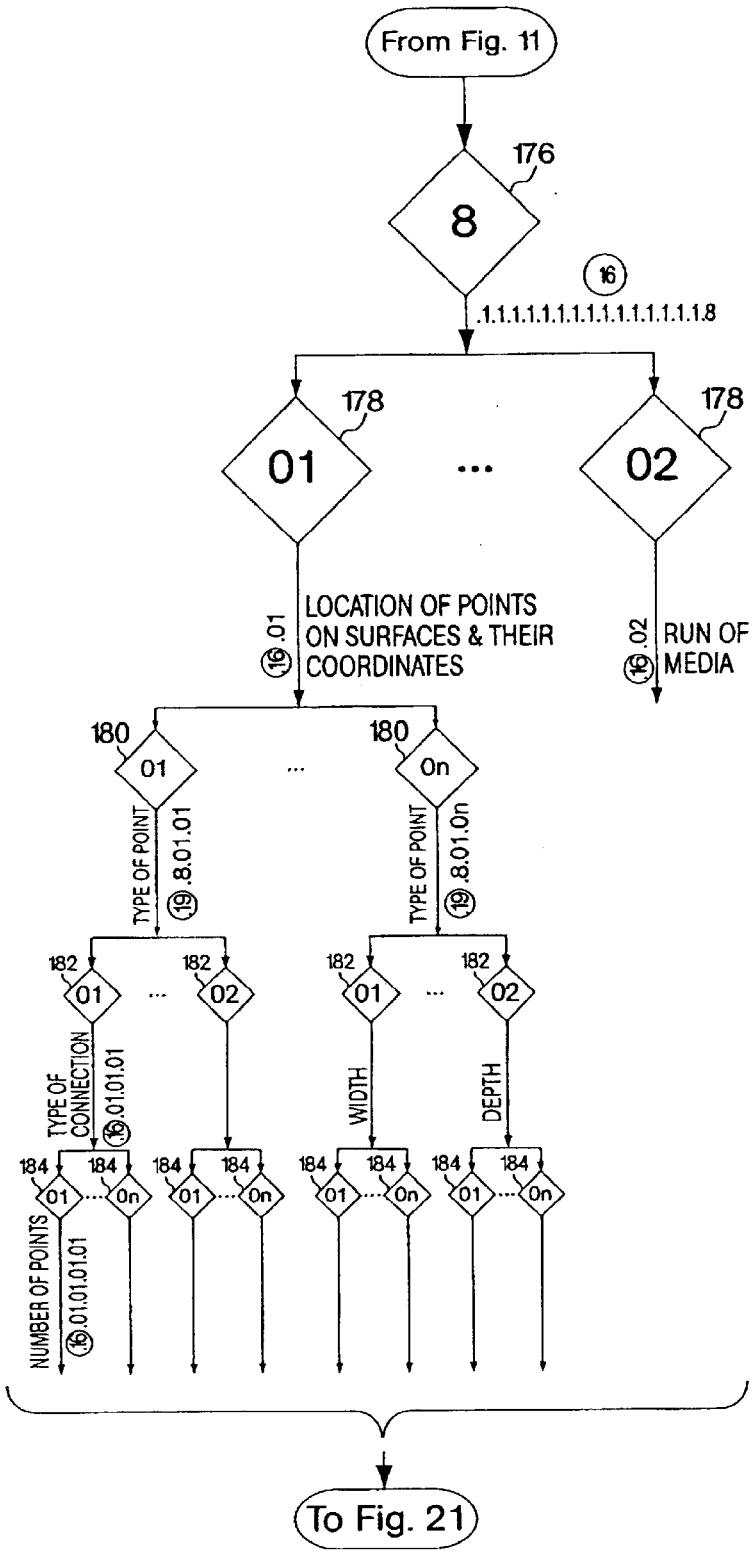
FIG. 20 is a flow chart of the subdivision of all other trade engineering information into location of points on surfaces and their coordinates, and the run of media, with the location of points on surfaces and their coordinates being further subdivided into the type of point, the type of connection, the width, and depth, and the number of points as illustrated.

Referring now to FIG. 20, all other trade engineering information as illustrated by subdividing block 176 is subdivided at blocks 178 into location of points on services and their coordinates or run of media in the $16^{th}$ reference numeral position by (.01–.02). As illustrated by subdividing blocks 180, the type of point is specified, whereas at subdividing blocks 182, the type of connection is specified. The number of points is specified at 184.

As will be appreciated, having gone through all of the flow charts from up to FIG. 20, the end product is the complete specification of all of the building blocks for the structure to be built, with all of the pertinent information being specified in terms of a reference numeral string in which the reference numerals in each of the positions indicate a particular piece of information.

Figure 21:
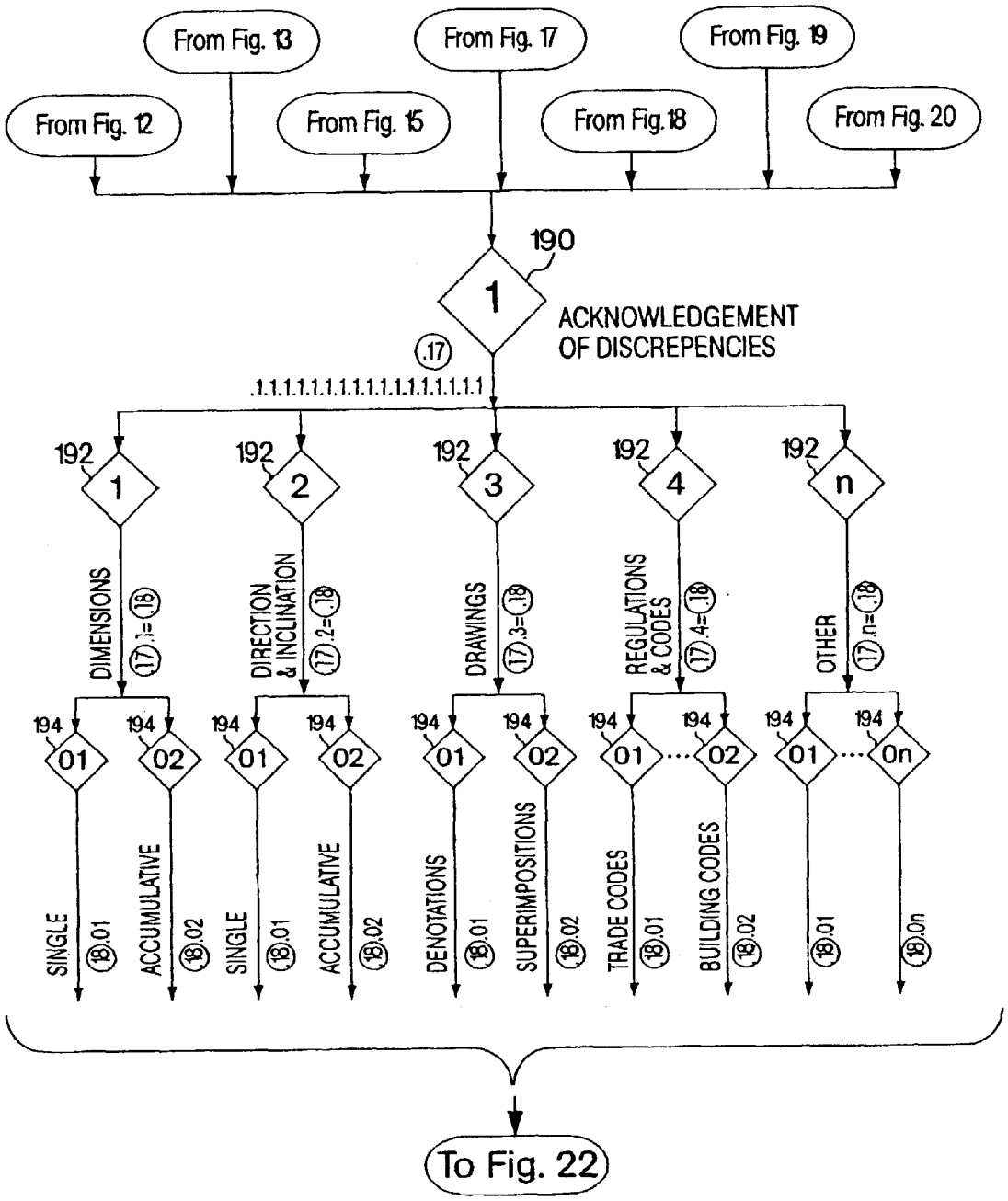
FIG. 21 is a flow chart showing the accumulation of all of the identifying information from FIGS. 12, 13, 15, 17, 18, 19 and 20, to permit the detection and acknowledgment of discrepancies in terms of dimension, direction and inclination, drawings, regulations and codes, and other defining characteristics, thereby to identify the discrepancies.

After having completely defined all of the building elements of the structure corresponding to the construction drawings and giving them reference numerals, it is incumbent upon the subject system to detect and acknowledge discrepancies associated with the original construction drawings. In order to do this, as illustrated in FIG. 21 a subdividing block 190 acknowledges discrepancies in terms of dimensions, direction and inclination, drawings, regulations and codes and other items which indicate discrepancies. As illustrated by subdividing blocks 192, labeled "01", "02", "03", "04" and "0n", discrepancies in terms of the aforementioned characteristics are noted at the $17^{th}$ reference numeral position, with subdividing blocks 194 indicating respectively whether a dimension is in error either singularly or in an accumulated fashion, whether the direction and inclination is either single or in an accumulated fashion, whether the drawings have denotations which are in error or superimpositions which are in error, or whether the trade regulations and codes relate to either trade codes or building codes. This is done by in the $18^{th}$ reference numeral position by (.01–.0n) so as to be able to designate the discrepancies through the utilization of the reference numerals.

Figure 22:
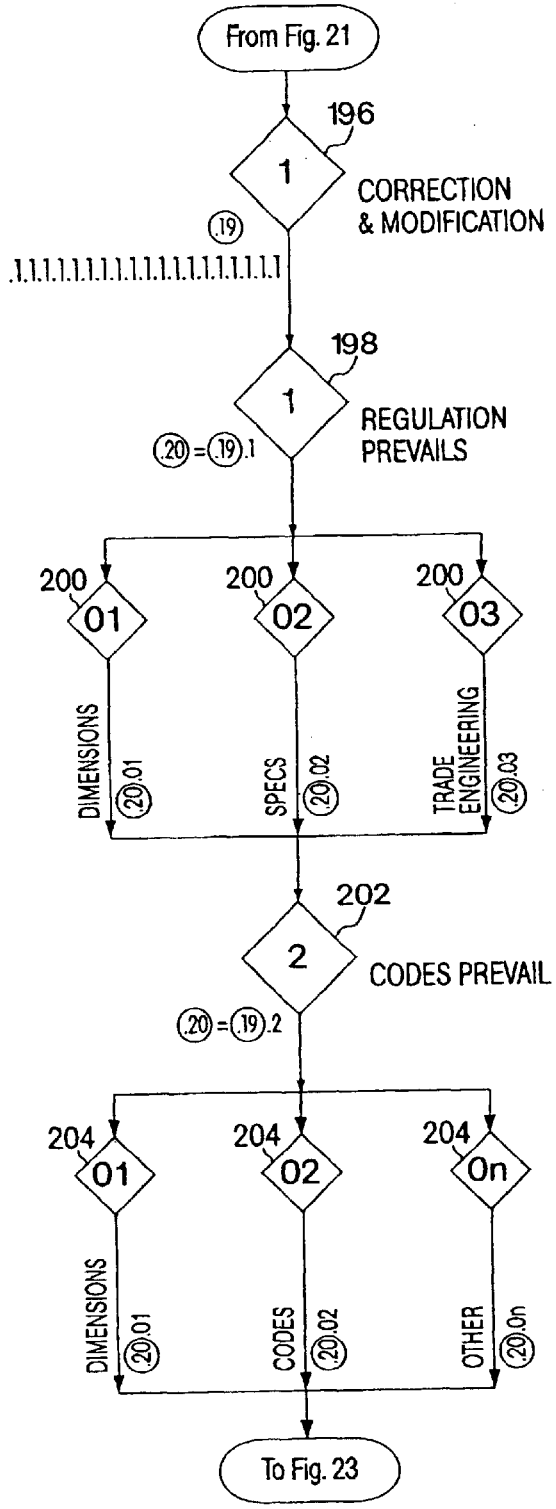
FIG. 22 is a flow chart showing the correction and modification to correct for the deficiencies detected in FIG. 21, also indicating a decision block requiring that codes and regulations prevail in terms of dimensional codes, specification codes, or trade engineering codes, followed by a second decision block indicating that codes prevail in terms of dimensional, codes and other information.

Referring now to FIG. 22, correction and modification is accomplished by subdividing block 196 which applies an appropriate correction through the designation of the reference numeral in the $19^{th}$ position. Thereafter, as illustrated by subdividing block 198, that the regulation prevails is indicated through the reference numeral in the $20^{th}$ position which as illustrated by subdividing blocks 200 relates to dimensions, specifications or trade engineering considerations carried in the $20^{th}$ position as (.01–.03).

Thereafter as illustrated by subdividing block 202, a check of whether or not a code prevision prevails is denoted by a numeral "2" in the $20^{th}$ position, with the particular code to prevail illustrated in subdividing block 204 to designate whether the code requires revision of dimensions, codes, or other items. These revisions are carried in the $20^{th}$ reference numeral position as (.01–.03).

Figure 23:
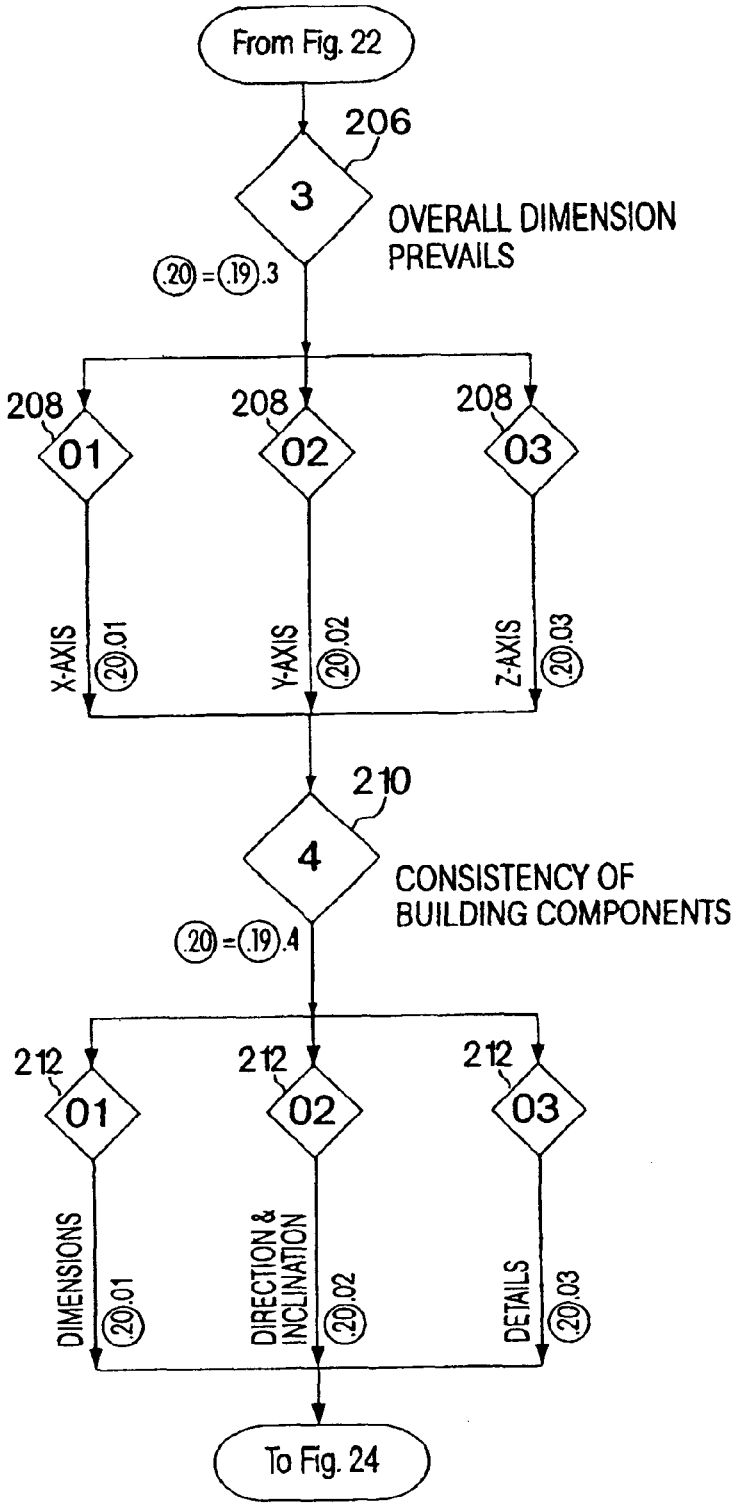
FIG. 23 is a flow chart showing a decision block in which overall dimension prevails in terms of X axis, Y axis and Z axis dimensions, followed by a decision block in which corrections are taken as a whole, and then filtered down to corrections of the particular building elements in terms of dimensions, direction and inclination and other details.

Referring now to FIG. 23, as can be seen by subdividing block 206, overall dimensional considerations prevail, with the dimensions being indicated by subdividing blocks 208, such that the dimensions which prevail are on the X-axis, Y-axis and Z-axis as specified by the $20^{th}$ reference numeral position by (.01–.03).

Thereafter as illustrated by subdividing block 210, consistency as it relates to the assembling of all of the elements of the building is denoted in the $20^{th}$ reference numeral position, with subdividing blocks 212 indicating what dimensions, direction and inclinations or details must be altered to achieve the required consistency amongst the building elements. This is done in the $20^{th}$ reference numeral position by (.01–.03).

Figure 24:
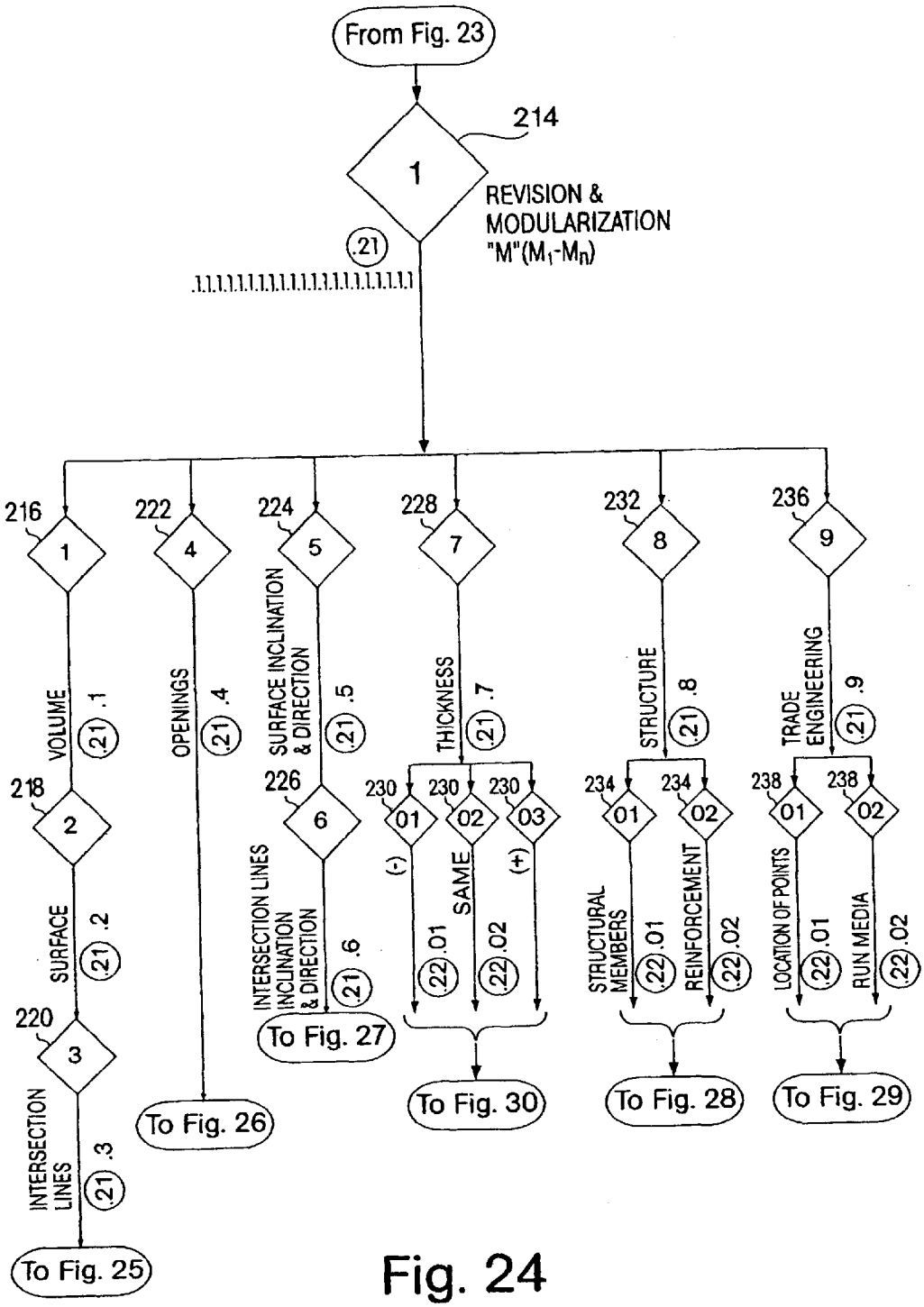
FIG. 24 is a flow chart showing a revisions and modularization decision block in which the dimensions are corrected in accordance with the particular modular components available, so as to adjust the dimensions to be able to fit the particular modules utilized for the formworks, thereby generating revisions to the volume, surface, intersection lines, openings, surface inclination and direction, intersection lines, inclination and direction, thickness, structure, and trade engineering information in accordance with the information required by the subdivision thereof.

Referring now to FIG. 24, as illustrated by subdividing block 214, revision required for changing the information to match a particular modularization scheme involving predetermined modular elements or units is designated in the $21^{st}$ reference numeral position. This is the point at which all of the information which has been corrected is now revised once again to permit modular formworks to be used. In order to correct the building elements so they can be manufactured through the use of modular formworks, as can be seen by subdividing blocks 216, 218 and 220, the information is revised as to changes in volume, changes in surfaces, and changes in intersection lines. This is contained by the particular reference numeral in position 22 such that volume changes are indicated by ".1", surface changes by ".2", and intersection line changes by ".3".

It should be noted that for all the modular elements for the formworks, there is a certain constant "M" which is the smallest unit accommodated by the modular elements, whereby assembly of the modular elements produce a dimension which is a multiple of the constant "M".

For instance if a room is to have a wall which in horizontal direction is to be 12 feet 7¾ inches as specified in the construction drawings, assuming that M=1" then the wall dimension must be revised to either 12 feet 7 inches or 12 feet 8 inches. This choice depends on other limitations such as codes, prevailing important dimensions or structural considerations and so forth.

The larger the value of M, the smaller the number of choices the architect has. Thus if M=1 foot, while the subject system will revise the original construction drawings to fit the modular system, the choices may not be satisfactory or even possible.

In the modular formworks of U.S. Pat. No. 5,833,872 an M approximately 1 inch is entirely practical and imposes negligible limitations. Thus the revision steps connect the original dimensions in accordance with a standard set of rules.

Taking, for instance the modular panel, these can be manufactured in convenient 2 foot wide panels. To accommodate intermediate dimensions, a number of smaller panels are available, for instance, 1 foot wide. To put together a 12 foot 7 inch formwork assembled panels, one uses two corner panels, each 8 inches in width, four 2 foot panels, one 1 foot panel, seven 3 inch channels to attach panels to each other, which yields a total width of 12 feet 1 inches. To obtain another 6 inches one uses an overlapping apertured plate.

As illustrated by subdividing block 222, changes in the openings, be they door openings, switch plate openings, or other types of openings, are contained in position 22 by the reference numeral ".4", thereby specifying that openings are to be addressed.

Subdividing block 224 designates that a surface inclination and direction change needs to be made with this change being designated in the $22^{nd}$ reference numeral position by ".05", with subdividing block 226 designating changes in intersection lines, inclination and direction as indicated by reference numeral at position 22 by ".06".

As indicated by subdividing block 228, changes in thickness are specified by subdividing blocks 230 either to be less than, the same or more than the original dimension, with this information being contained in the $22^{nd}$ reference numeral position by (.01–.03).

As illustrated by subdividing block 232, changes in the structure can be specified, with subdividing blocks 234 indicating whether structural members or reinforcement elements are to be changed. This information is carried in the $22^{nd}$ position by (.01–.02).

As can be seen, subdividing block 236 relates to changes in trade engineering information, which is carried in the $22^{nd}$ reference numeral position, with subdividing blocks 238 referring to changes in location of points or run media. This information is carried in the $22^{nd}$ position at (.01–.02).

Figure 25:
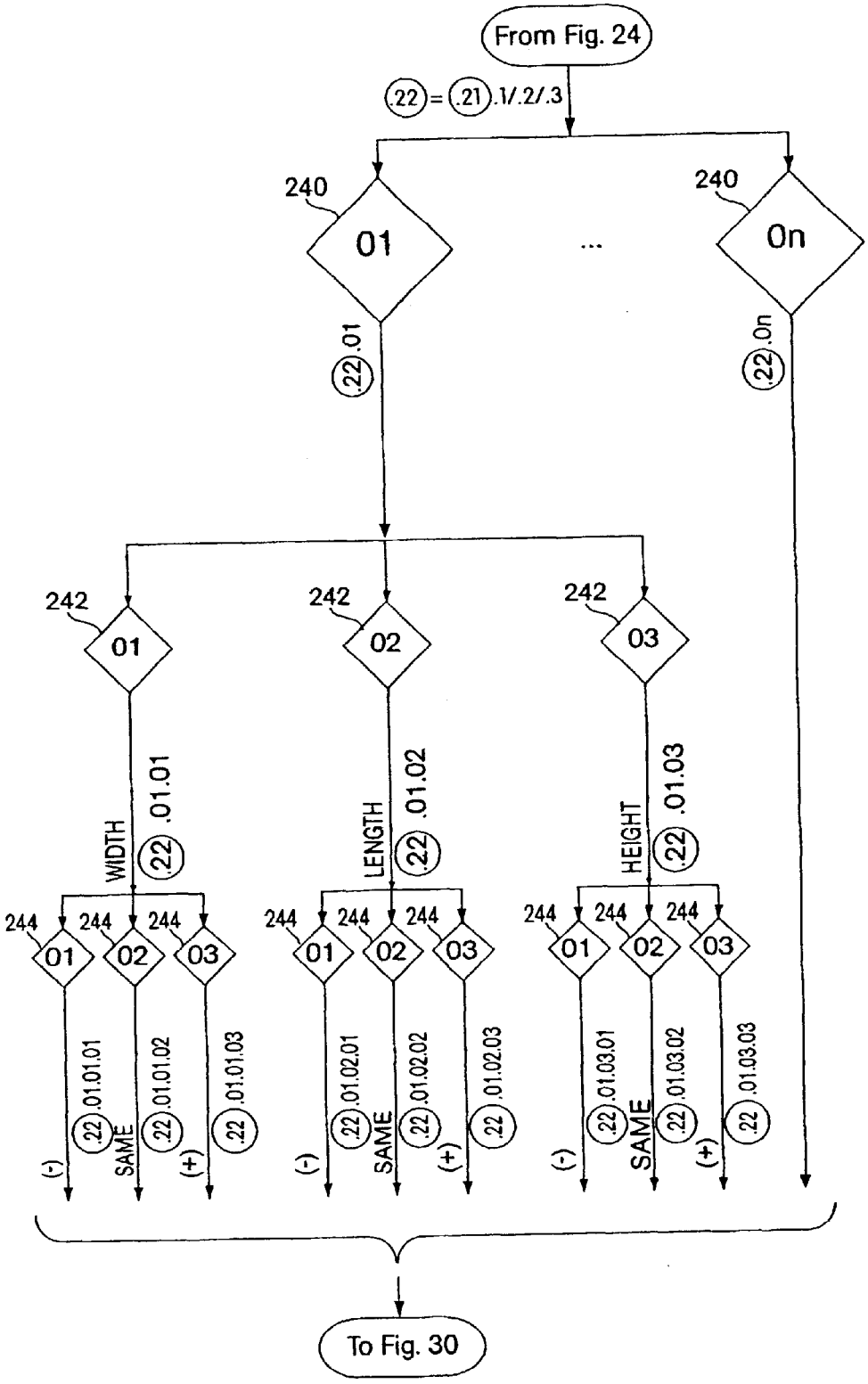
FIG. 25 is a flowchart showing subdivision of the volume, surface and intersection lines to identify which volume is intended.

Referring now to FIG. 25, subdividing blocks 240 further specify which volume, surface or intersection line is intended, with subdividing blocks 242 specifying the width, length or height change required. This is done in the $22^{nd}$ reference numeral position by (.01.01). Subdividing blocks 244 specify whether the particular dimension involved is less than, the same or greater than the originally specified dimension, with this information being carried in $22^{nd}$ reference numeral position by (.01.01.01). It will be appreciated that the subdividing blocks having to do with width also applied to length and height as well.

Figure 26:
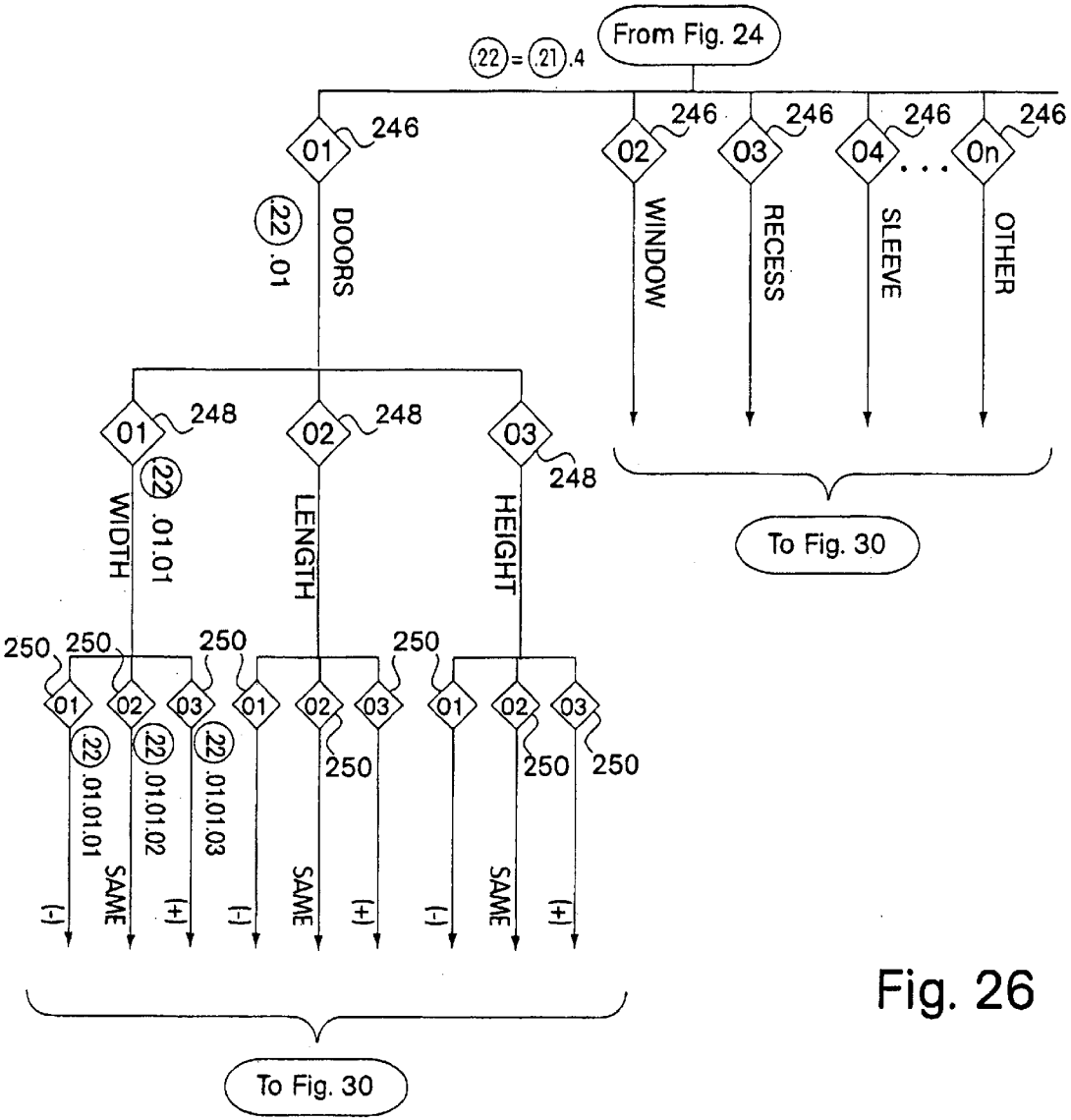
FIG. 26 is a flow chart showing the openings associated with FIG. 24, indicating identification of doors, windows, recesses, sleeves, and other items, along with the new height, length and width associated therewith.

Referring now to FIG. 26, changes in the openings are related by subdividing blocks 246 respectively to doors, windows, recesses, sleeves and other openings, with subdividing blocks 248 designating the width, length and height of a particular door opening, and with subdividing blocks 250 designating whether these particular dimensions are the same, less than or more than those specified in the original construction drawings.

As can be seen, a change in length width and height is denoted in the reference numeral position at (.01.01), whereas the change required is denoted by .01.01.01. The same type of changes can be effectuated at similar reference numeral position for windows, recesses, sleeves and other item.

Figure 27:
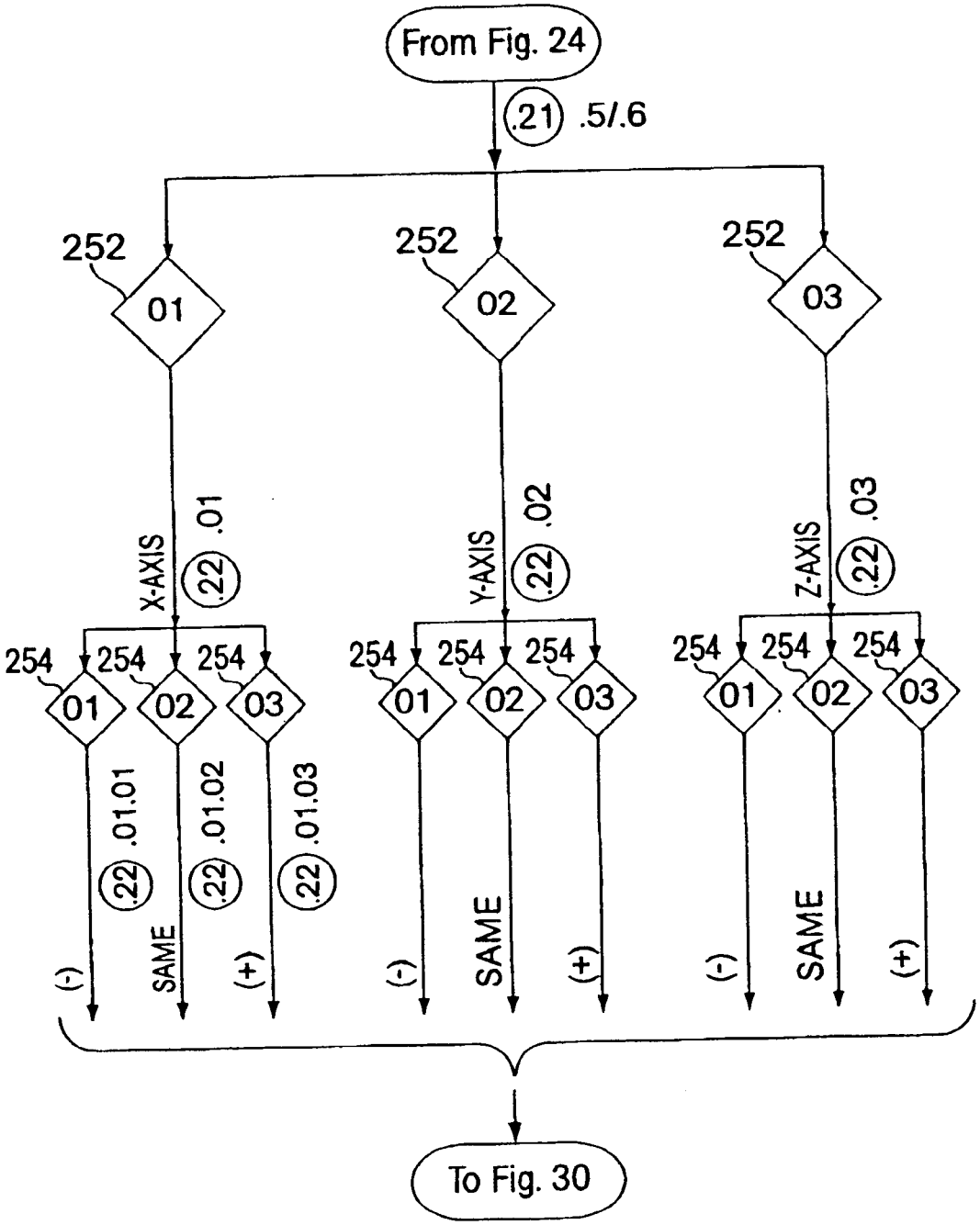
FIG. 27 is a flow chart showing subdivision of the surface inclination and direction, along with intersection lines inclination and direction for the X, Y and Z axes.

Referring now to FIG. 27, changes which are required for surface inclination and direction as well as intersection lines inclination and direction is specified by subdividing blocks 252, with subdividing blocks 254 providing information about whether the change is less than that originally specified, the same or more than that originally specified for the dimension in the X-axis, Y-axis and Z-axis. This information is carried in the $22^{nd}$ reference numeral position by (.01–.03).

Figure 28:
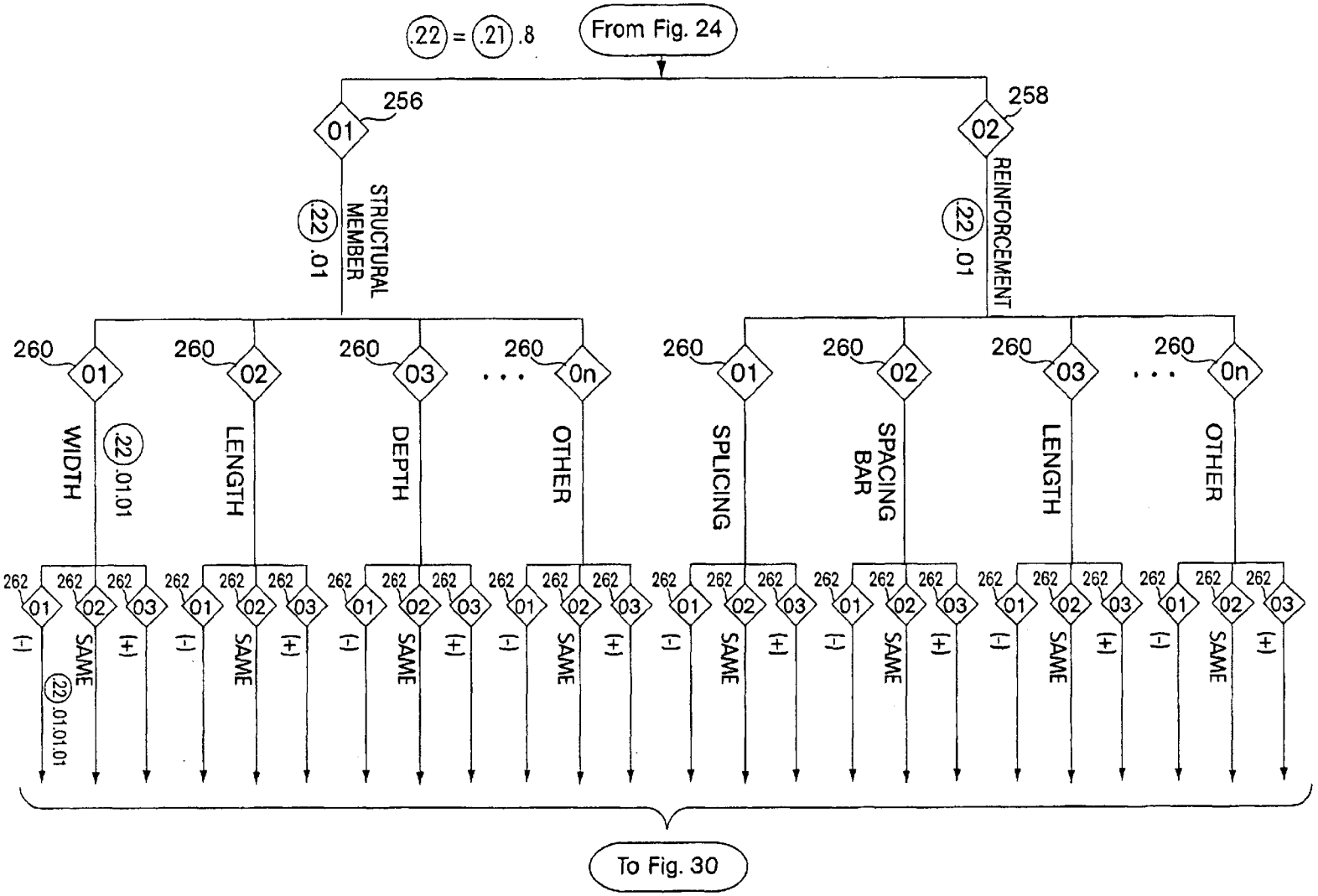
FIG. 28 is a flow chart showing the subdivision of structures into structural members and reinforcement members, along with the length, width, depth, and other characteristics for structural members, splicing, spacing bar, length, and other information with respect to reinforcement members, all adjusted to the new modular dimensions.

Referring now to FIG. 28, subdividing block 256 identifies a structural member to be changed whereas subdividing block 258 indicates a change in a reinforcement member or element. As indicated by subdividing blocks 260, changes respectively in structural members and reinforcement members as to width, length, depth and other; or splicing, spacing bar, length and other are specified in the $22^{nd}$ reference numeral position by (.01.01). Thereafter, as illustrated at 262, these subdividing blocks indicate for the various characteristics whether or not the characteristics are the same as designated, less than or more than that which is designated in the original construction drawings.

Figure 29:
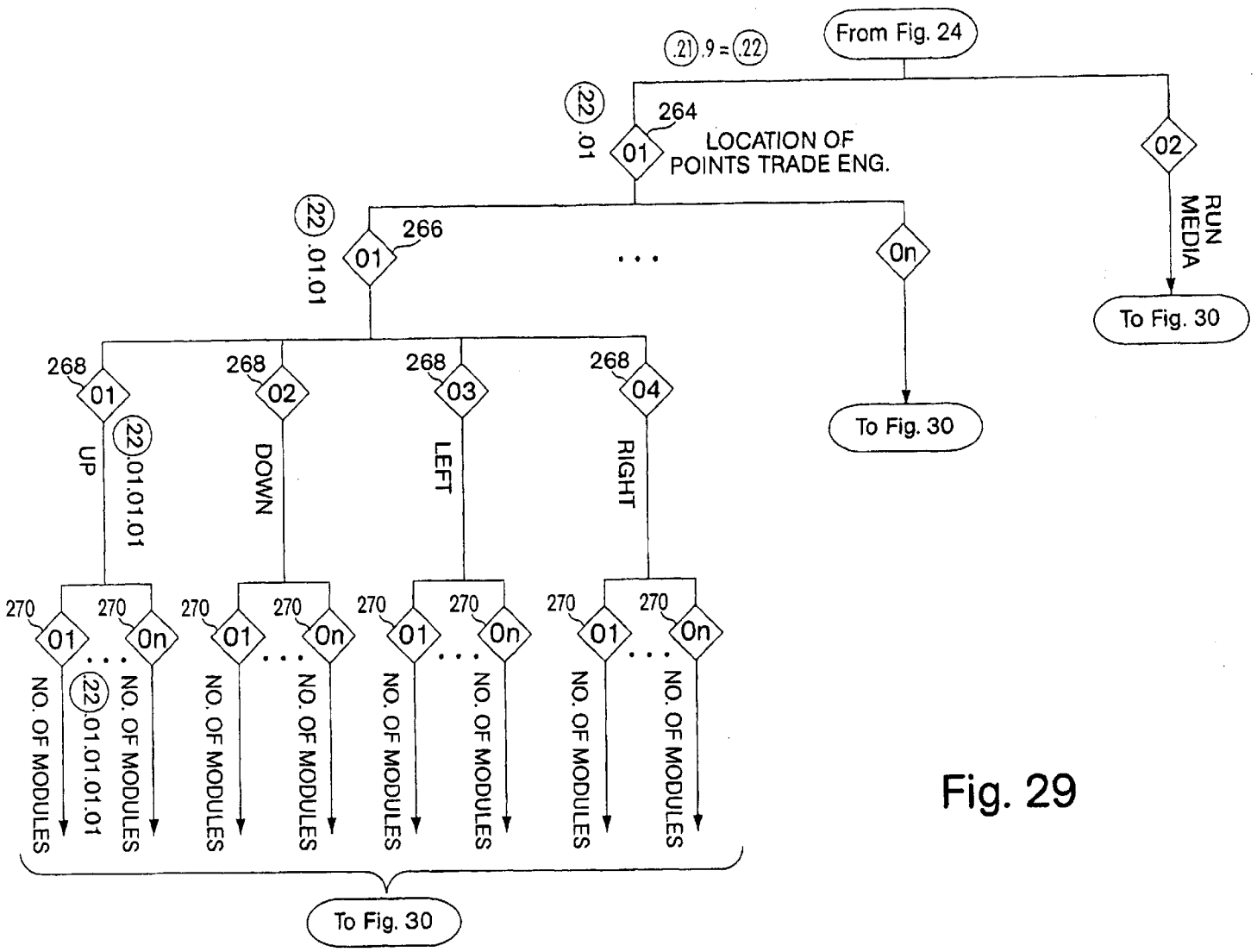
FIG. 29 is a flow chart showing the subdivision of the trade engineering into location points and media run, follow by further subdivisions required for adjusting the location of points and media runs to the modular system required.

Referring now to FIG. 29, as illustrated by subdividing block 264, changes in the location of points with respect to the trade engineering drawings are specified in the $22^{nd}$ reference numeral position by (.01). Subdividing block 266 specifies which points are indicated, whereas subdividing blocks 268 give a selection of the nearest aperture in a module which is to be utilized for location purposes in building up the formworks. What this means is that it is possible to select which of the apertures in a given formworks module is the one to be selected for positioning purposes.

Subdividing blocks 270 indicated how far up, down, left or right the aperture is to be which is selected. Thus for instance, the original construction drawings require a particular point to be at one location, but this location is not at a location of an aperture in a formworks module, then by the process described above, an aperture can be selected which will permit the utilization of the particular formworks modular element.

The number of apertures up, down, left or right is specified in the $22^{nd}$ reference numeral position by (.01.01.01).

Figure 30:
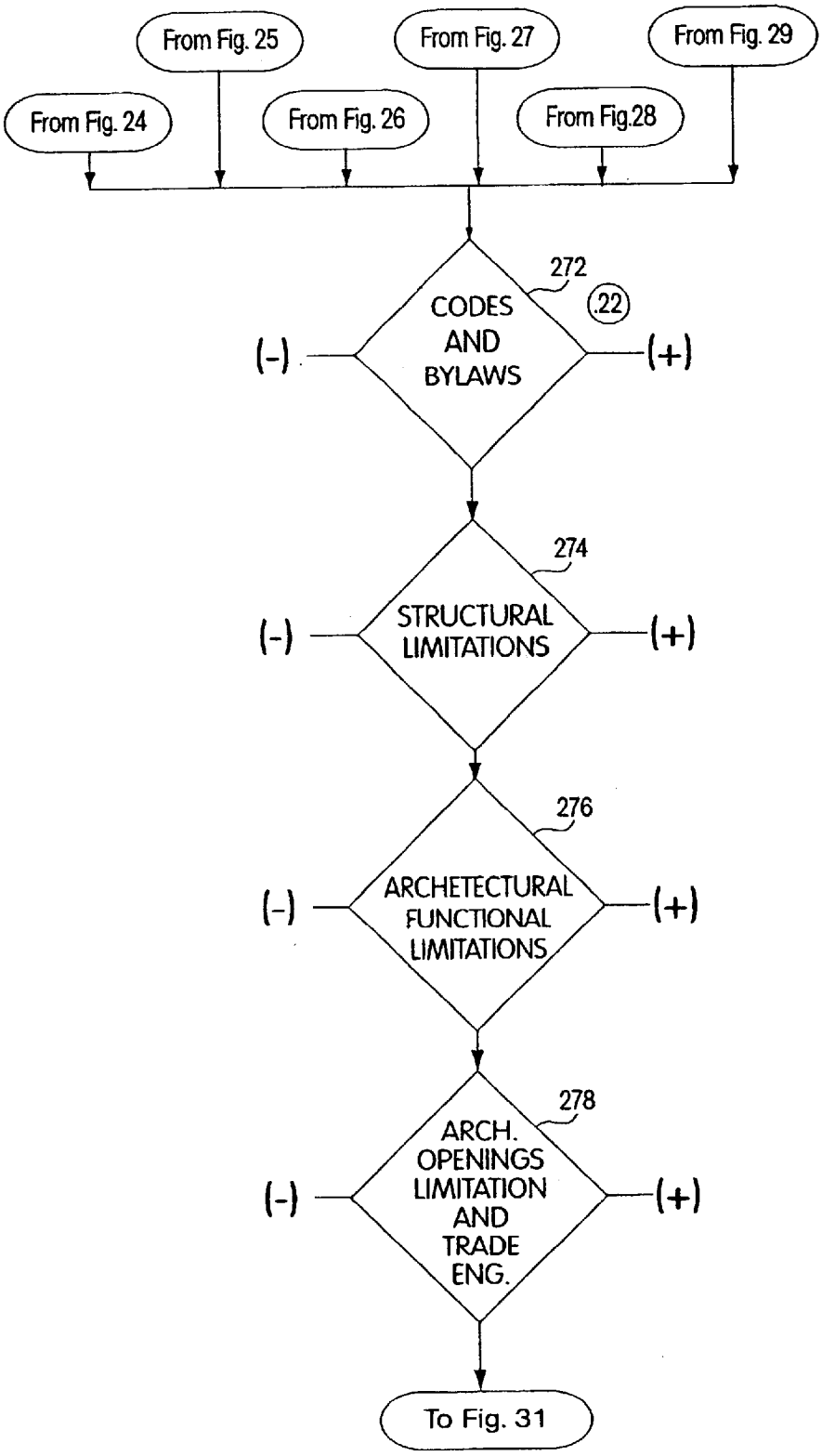
FIG. 30 is a flow chart showing the inputting of all of the corrected information, followed by decision blocks as to codes and bylaws, structural limitations, architectural functional limitations, architectural opening limitations, and trade engineering considerations to adjust the information according thereto.

Referring now to FIG. 30, all of the changes required to permit the utilization of a modular formworks are now specified. Because the modular formwork elements have a regular array of apertures therein, utilization of the modular formworks system is made possible through only minor changes in dimensions between that which was originally specified in the original construction drawings and that which is dictated by the modular items themselves.

Once having derived information which directly transforms the original construction document information into that which is constructable or erectable through the modular system, then as illustrated by subdividing block 272, additional changes can be made which are dictated by codes and bylaws, whereas as illustrated at 274, changes can be made in accordance with structural limitations. Moreover, as illustrated at 276, changes in architectural functions can be input at this point, whereas as illustrated at 278, architectural openings and trade engineering limitations can be input into the system. It will be noted that at this point changes can be made to a modularized set of data as opposed to the original set of data, giving more flexibility to the architect or engineer.

Figure 31:
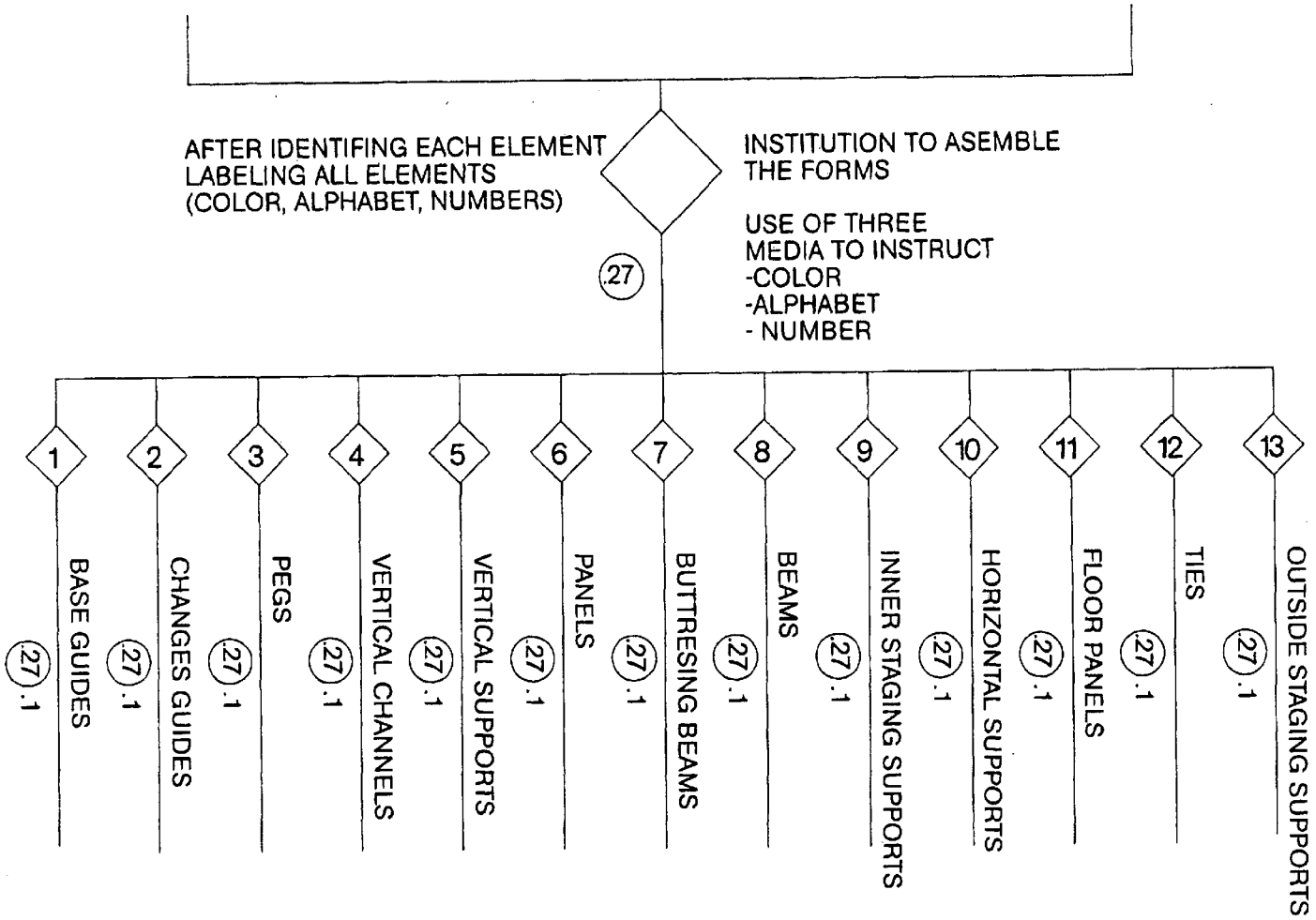
FIG. 31A is a flow chart giving identification to the elements in terms of color or alphanumeric characters to permit ease of assembly, with the alphanumeric and color-coding utilized to identify modular components, including base guides, base gentles, pegs, vertical channels, vertical supports, panels, buttressing beams, beams, inter-staging supports, horizontal supports, floor panels, tiles and outside staging supports.
FIG. 31B is a subdivision of the base guides, corner components, segments, or other components, followed by identification of which of the number of comer is specified.
Figure 31A:
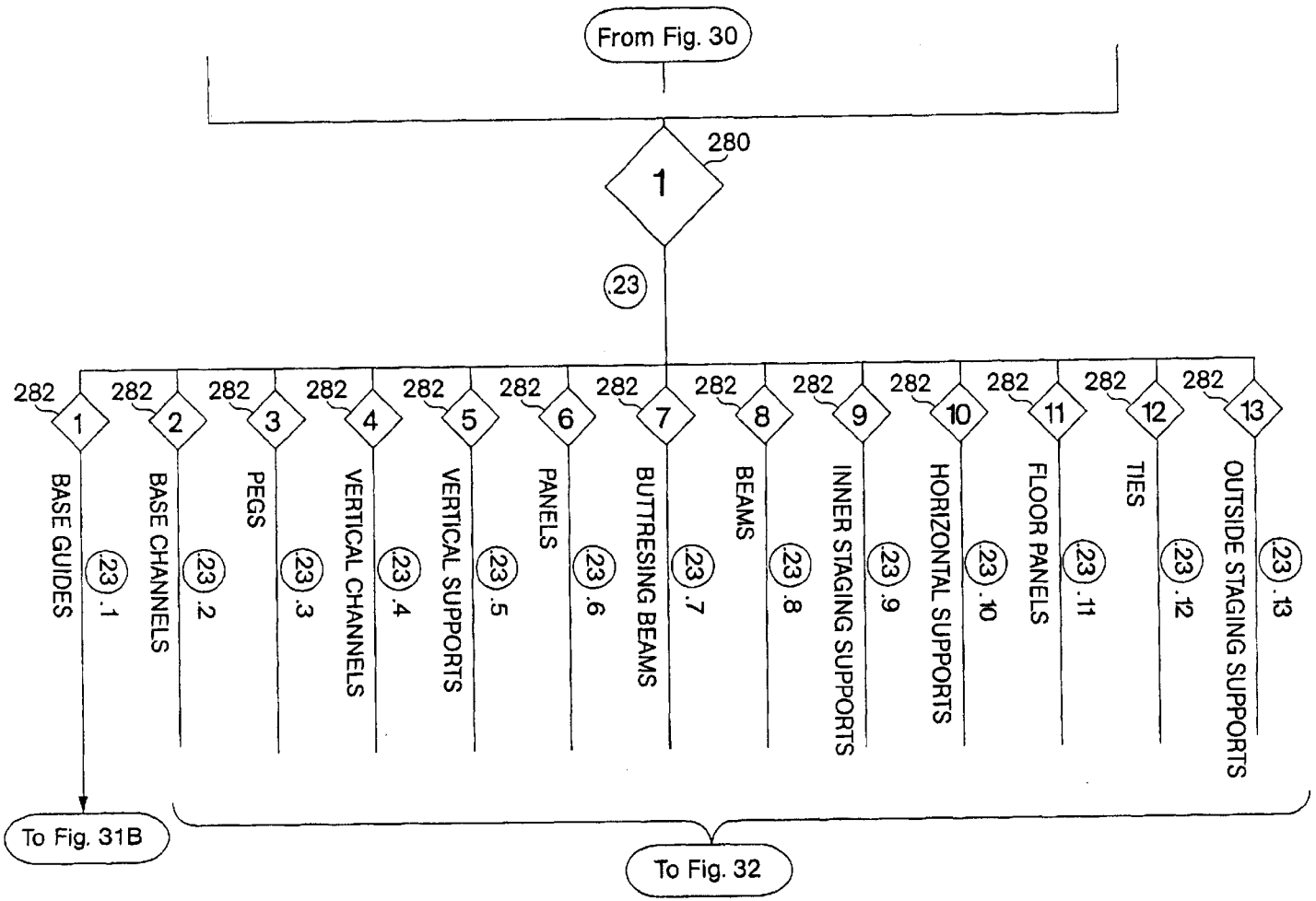

Referring now to FIG. 31A, in order to provide suitable instructions for the artisan to be able to erect the formworks, as illustrated in 280, each of the basic modular components is labeled with an alphanumeric indicator or a color, with the particular formwork element being specified by subdividing blocks 282 to be for instance base guides, base channels, pegs, vertical channels, vertical supports, panels, buttressing beams, beams, interstaging supports, horizontal supports, floor panels, ties, or outside staging supports. These particular modular elements are labeled by virtue of the numeral in position 24.

Figure 31B:
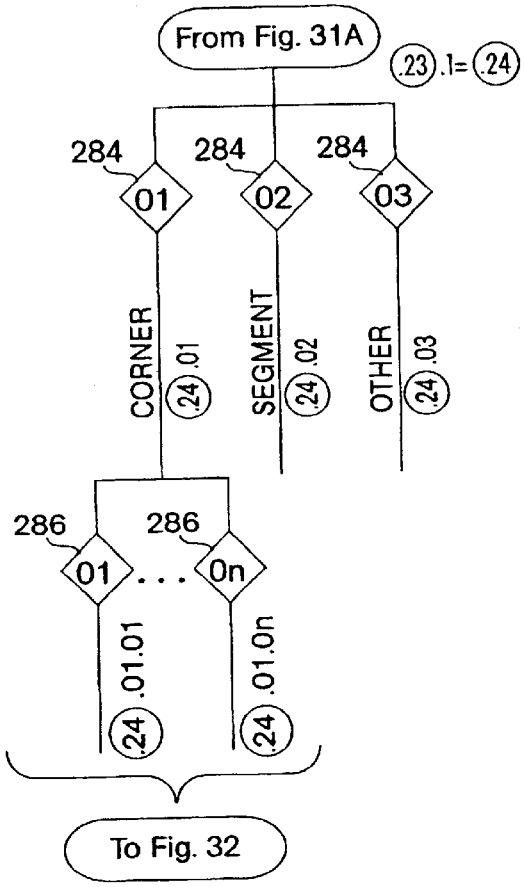

Referring now to FIG. 31B as to base guides, the particular corner segment or other element is specified by subdividing block 284, with subdividing blocks 286 specifying which comer element is intended at position 24 by (.01.01).

Figure 32:
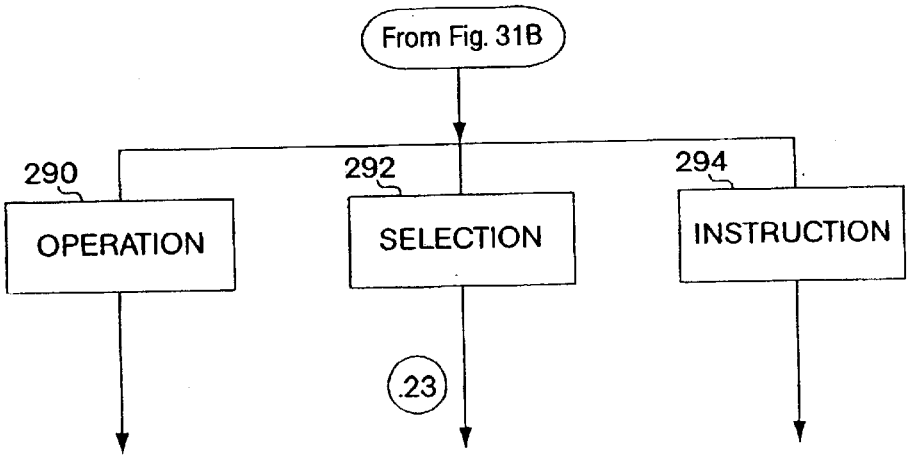
FIG. 32 is a flow chart showing the specification of the operation intended in order to construct the modular formwork the selection of the modular components and an instruction set for specifying the erection of the modular components.

Referring now to FIG. 32, having designated by alphanumeric means or color-coding the particular modular element intended, it is now incumbent upon the system to provide instructions to the artisan as to the order of assembly herein referred to as operation 290, the selection of the particular modular elements to be used 292, and an assembly instructions 294 before pouring of the concrete.

A typical example of the instructions given to an artisan follows:

It will be appreciated that in order to give an artisan proper instructions as to how to build the formworks for a particular structure, all that the artisan needs to know is which modular elements to select, and how to hook them together so that the formworks will provide the appropriate walls or other structures. In one example, a room can be created in terms of laying the walls of the room. The first task in the laying of the walls of a room is dictated by the operation portion of the instructions, which is basically to lay the bottom lines of the walls. In order to lay the bottom lines, one also has to select which of the modular elements is to be employed for the wall. For instance, in one example, referring now to FIG. 35, a comer base guide 330 is selected of a particular type, for instance labeled by VIC.

One also needs a number of segment base guides 306, for instance designated by V1W1SB.

The panels and modular elements are attached together by red pair pegs 342 in the embodiment indicated by PP(Red)

342 or combined pegs CP(Blue) 332. By combined pegs is meant that a plate for instance has a number of upstanding pegs thereon.

Also required are comer pegs 356, with the pegs designated PL(Green). In a room, there are four comer base channels 354 required, designed V1CB, whereas 14 segment base channels 308 may be required, labeled V1W1CB. A listing of the modular elements required appears below in Table III.

TABLE III

| SELECTION | TYPE | NUMBER |
|---|---|---|
| Corner Base Guides | V1C | 4 |
| Segment Base Guides | V1W1SB | 24 |
| Individual Pegs | IP (Yellow) | 14 |
| Combined Pegs | CP (Blue) | 10 |
| Corner Pegs | PL (Green) | 4 |
| Pair Pegs | PP (Red) | 8 |
| Segment Base Channels | V1W1CB | 14 |
| Corner Base Channels | VICB | 4 |

Having selected the particular modular elements required for the formworks, a typical instruction would be to lay the comer base guides VIC (1–4) at four comers of the room. These comers are attached with comer pegs (PL-Green). Next connect to the comer base guides and segment base guides V1W1SB(1–14) with pegs (PP-Red) at holes in row A and attached with pegs (IP-Yellow) at (K,L,M) and attach with (CP-Blue) at (G,H,I).

Next connect segment base guides to each other to form lengths and widths of the room by combined pegs (CP-Blue) and by (PP-Red) pegs.

Thereafter, lay corner base channels V1CB, four in number, at four corners on the top of corner guides using the existing corner pegs (PL-Green). Subsequently lay segment base channels, fourteen in number, on top of the base guides using existing pegs (PP-Red), (IP-Yellow), (CP-Blue).

The second operation is to lay the wall panels. In this portion of the instructions, vertical channels labeled V1W1VC, 36 in number are selected, along with 12 corner panels labeled V1W1CP. There are 42 wall panels labeled V1W1WP and 36 vertical supports V1W1VS, along with 108 ties TA, and 40 horizontal supports V1W17HS. There are 120 plugs PL to be utilized and 20 buttressing beams BBF, along with 28 inter-staging elements INS. These elements are listed in Table IV.

TABLE IV

| SELECTION | TYPE | NUMBER |
|---|---|---|
| Vertical Channels | V1W1VC | 36 |
| Corner Panels | V1W1CP | 12 |
| Wall Panels | V1W1WP | 42 |
| Vertical Supports | V1W1VS | 36 |
| Ties | TA | 108 |
| Horizontal Supports | V1W1HS | 40 |
| Plugs (Color) | PL | 108 |
| Buttressing Beams | BBF | 20 |
| Inner Staging | INS | 28 |

All wall connections to a first level and followed by continuing to appropriate further levels until the ceiling is reached. Connect corner panels, four in number, on existing pegs (PL-Green) and (PP-Red). Then connect vertical channels, 18 in number, on combining pegs (CP-Blue). Then connect vertical supports, 18 in number on combining pegs (CP-Blue). Then connect horizontal supports, 30 in number to vertical supports, ten in number at connections holes 20, and ten in number at connections holes 26.

Connect buttressing beams, ten in number, to horizontal pipes at the indicated holes.

Next connect the wall panels Number 1–14, starting from a corner and moving left, with the wall panels being carried by and connected to the channels. Wall panels are connected on top of each other and are connected by matching color, with the plugs being 28 in number, and at locations A26 of wall panel V1W1WP #1 and A1 of wall panel V1W1WP #15.

Finally, repeat the same procedure to the next levels, e.g., levels $2^{nd}$ and $3^{rd}$, until reaching the ceiling.

With respect to the laying of a ceiling, one selects 12 ceiling beams labeled CB, six horizontal pipes labeled HP, forty floor panels labeled FP, and sixty floor plugs, labeled FL. This selection process is illustrated by Table V:

TABLE V

| SELECTION | TYPE | NUMBER |
|---|---|---|
| CEILING BEAMS | CB | 17 |
| HORIZONAL PIPE | HP | 18 |
| FLOOR PANELS | FP | 19 |
| FLOOR PLUGS | FL | 60 |

As to the instructions to laying the ceiling, first lay ceiling beams CB, 17 in number, on horizontal supports VW1W1HS connected to the wall panel at connections K20 and K25. There are 12 in number. Then connect horizontal pipes HP, 18 in number, on ceiling beams CB, 17 number, at location L12, with yellow plugs (PL-Yellow). Then connect buttressing beams BBF, which are 14 in number, to the horizontal pipes, which are 18 in number. Finally, lay floor panels FP, which are 19 in number on the ceiling beams CB which are 17 in number by plugs (FL-green) which are 21 in number.

The result is a formworks for pouring the walls and ceiling of a particular room in a particular building.

Figure 33:
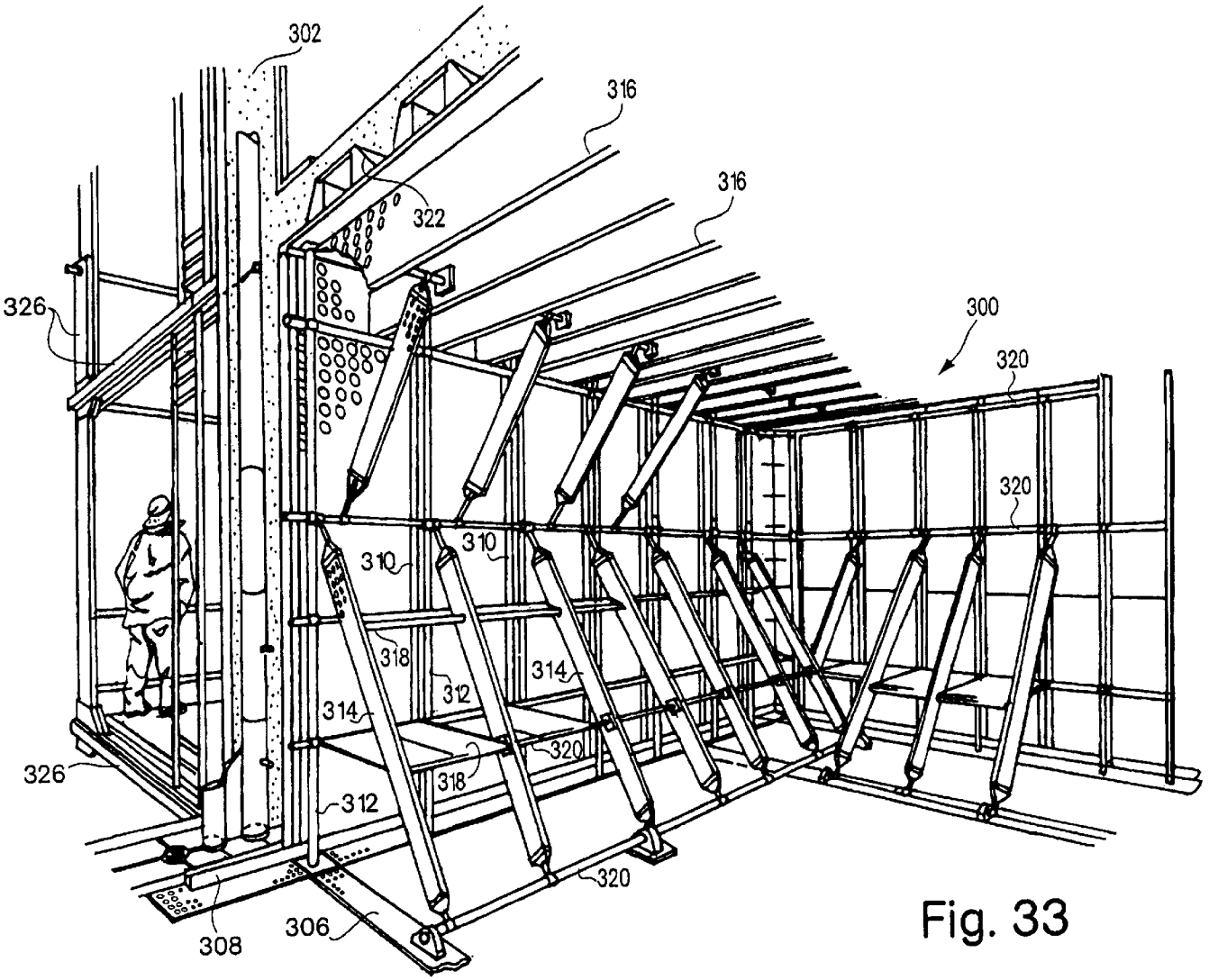
FIG. 33 is a diagrammatic representation of a modular formworks, illustrating the modular elements used

Having described a method for the specifying of modular formwork elements to be utilized in the erection of formworks and referring now to FIG. 33. formworks 300 is constructed to permit the pouring of concrete 302 between modular panels 304 which serve on their interior surfaces to contain the concrete until hardening. The modular formworks is erected through the utilization of base guides 306, base channels 308, vertical channels 310, vertical supports 312, buttressing beams 314, beams 316, inner-staging 318, horizontal supports 320, and outside staging supports 326, all of which positioned through the utilization of mating plugs and apertures as described in the aforementioned patents.

It the purpose of the subject method to be able to specify the modular elements making up the modular formworks so that a building or other structure specified by original construction drawings can be erected through the utilization of the modular formworks.

Figure 34:
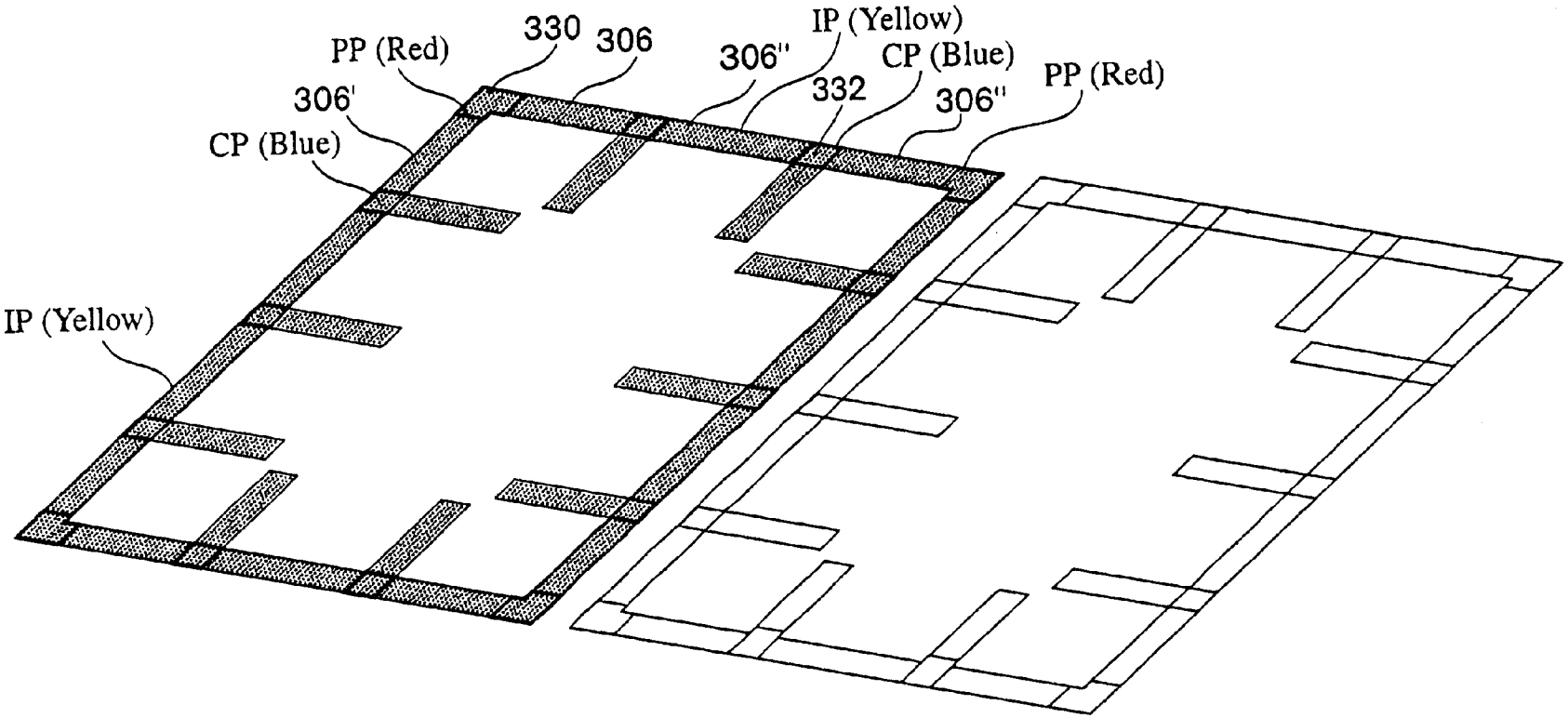
FIG. 34 is a diagrammatic representation of the floor for a room to be built showing the layout of base guides and other modular elements.

As mentioned in connection with FIGS. 32–38, instructions are given to the artisan in terms of specifying which modular component is to be connected to another modular component through the utilization of the aforementioned plugs in the designated apertures. As illustrated in FIG. 34, base guides 306 are mated with other base guides 306 through the utilization of a comer base guide 330, all of which are positioned and held in place by a combination of apertures and pegs.

As can be seen, the base guides in FIG. 34 describe a rectilinear room with base guides not only defining the perimeter but also extending into the interior of the room so as to permit anchoring the buttressing beams thereto.

It is the purpose of the instructions to specify which modular element is to be used in which position and to specify which colored pegs are supposed to be mated with colored apertures so that an artisan of limited abilities can erect the formworks without sophisticated measuring techniques and extensive experience.

Here it can be seen that one of the modular elements is labeled (lP-Yellow), whereas a upstanding peg pegboard combination of pegs and a plate is to be positioned at the point labeled (CP-Blue). Moreover as illustrated at (PP-Red) the combination upstanding peg and plate is positioned between the base guide and the comer base guide to appropriately align the two. Note also that IP yellow base guides are connected as illustrated at 306" via corresponding (CP-Blue) combination peg and plate 320 to adjacent base guide 306'" with a (PP-Red) combination peg plate being utilized as before for the opposite comer.

Figure 35:
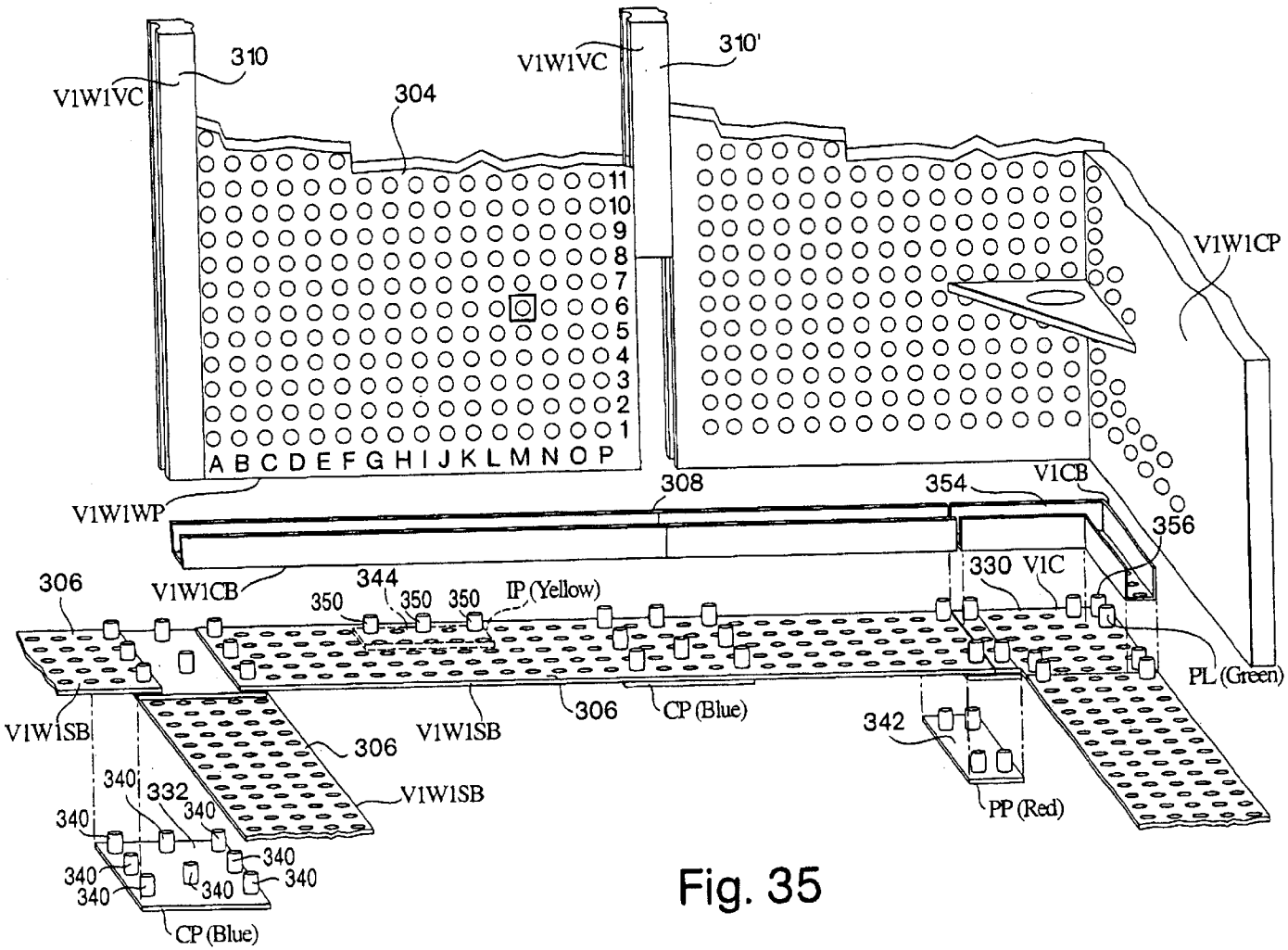
FIG. 35 is a diagrammatic representation showing the joining of modular elements, illustrating alpha/numeric and color coding to facilitate assembly.

More particularly and referring now to FIG. 35 the (CP-Blue) combination peg and plate 332 is shown beneath base guide 306, here labeled V1W1SB, so as to position this base guide with base guides 306 due to the projection of pegs or plugs 340 through the appropriate apertures which are also color coded and one embodiment. Likewise the (PP-Red) combination peg plate 342 extends upwardly between mating apertures so as to join the mating sections described in connection with FIG. 34.

Here it is noted that the (IP-Yellow) combination peg and plate 344 is utilized to extend up through base guide 306 and into base channel 308 here labeled V1W1CB. Note also that pegs 350 from the (IP-Yellow) combination peg and plate extend up through mating apertures in panel 304 so as to locate not only the base channel with respect to the base guide but also the panel as well. The mating of these pegs locates the vertical channel, 310 labeled V1W1VC with vertical channel 310' also being located in a similar manner through the collection of pegs and apertures.

Note also that a base channel comer 354 labeled V1CB is positioned by the corresponding pegs here PL green and given a reference character 356.

What will be appreciated is that the erection of the modular formworks can be easily specified using both alpha-numeric indicia on the modular elements or components as well as color coding to prevent mistakes in the positioning of the various elements.

Figure 36:
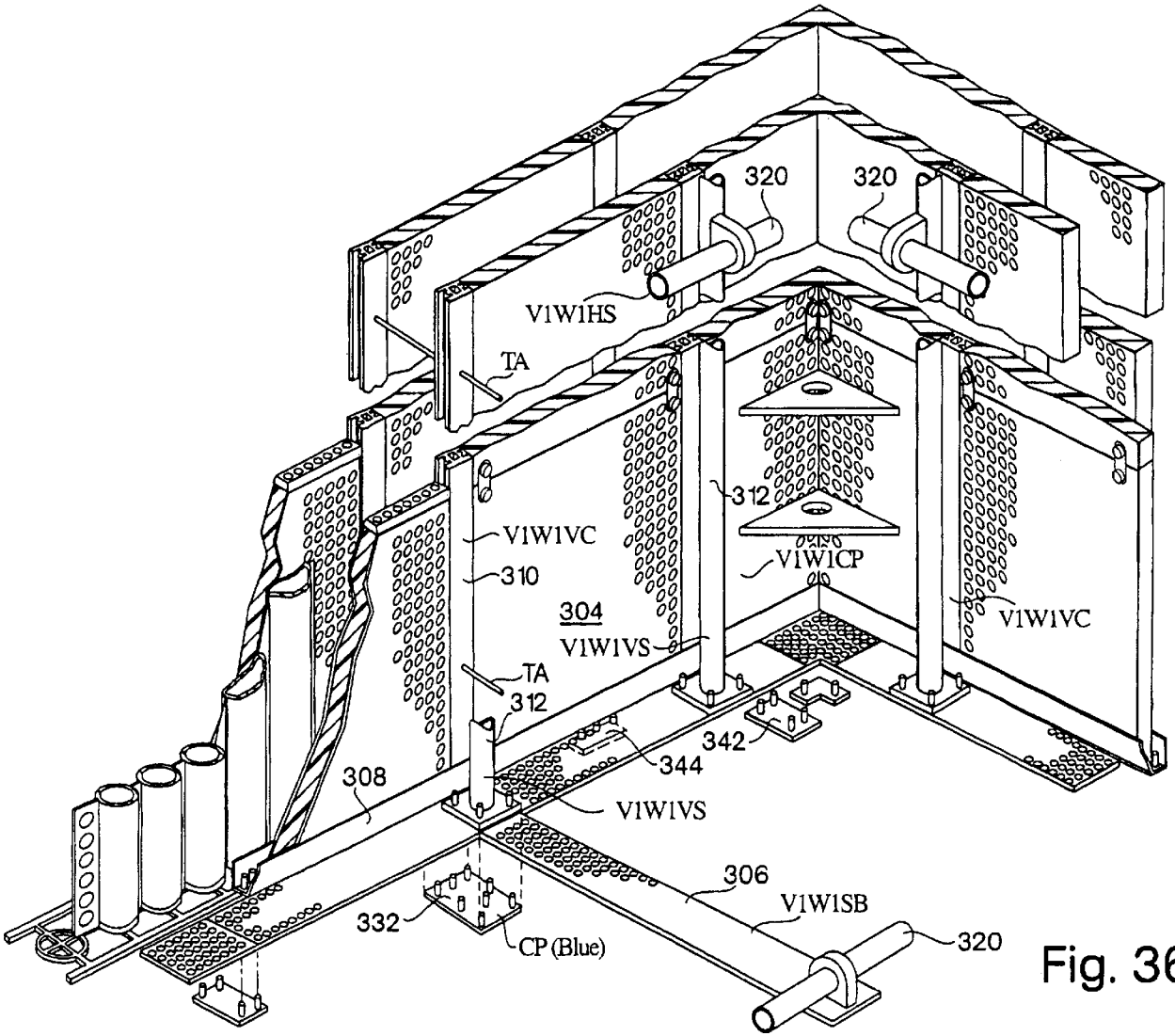
FIG. 36 is an isometric and sectional drawing showing the erection of formworks to form a corner of a room using modular formwork elements.

Referring now to FIG. 36, the completed formwork structure is illustrated with the various formwork indicia indicating the particular modular components utilized in the erection of the formwork. Here it will be appreciated that like reference characters between FIGS. 35 and 36 are utilized to identify like components.

Figure 37:
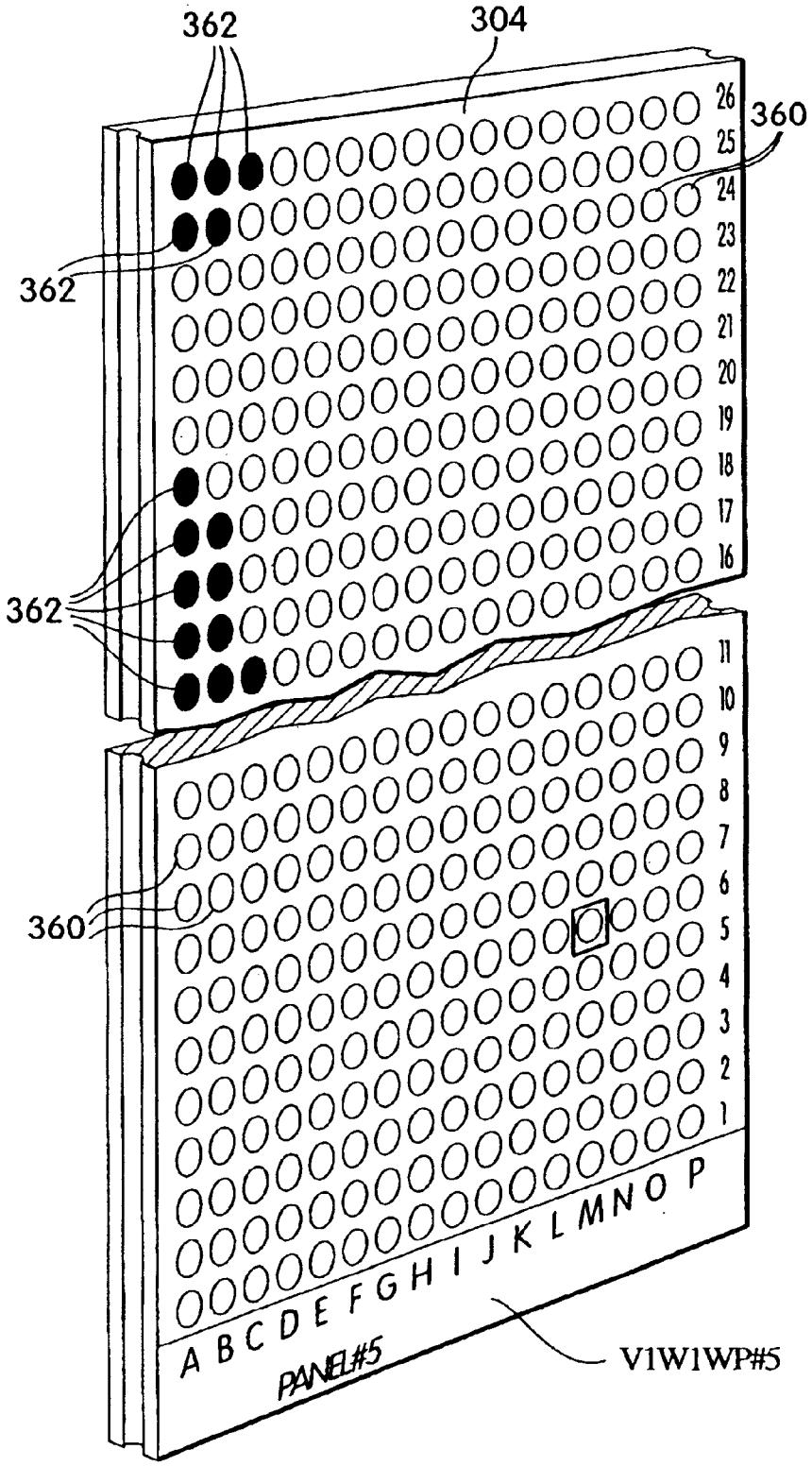
FIG. 37 is a diagrammatic representation of a modular formwork panel showing alpha/numeric and color coding to permit assembly with simplified instructions; and, FIG. 38 is a diagrammatic representation of a portion of the formwork to permit pouring of a ceiling showing the use of alpha/numeric and color coded modular elements.

Referring now to FIG. 37, the color coding and alpha-numeric indicia on a modular element are illustrated. Here panel 304 is shown with an array of rectilinearly disposed apertures 360 some of which are color coded as illustrated by the darkened areas 362.

It will also be noted that along the horizontal base alphabetical indicia are utilized to specify the columns, whereas numeric indicia are utilized on the right hand edge to indicate rows. It will be noted that the panel itself is labeled V1W1WP5 indicating a particular modular component or element.

Figure 38:
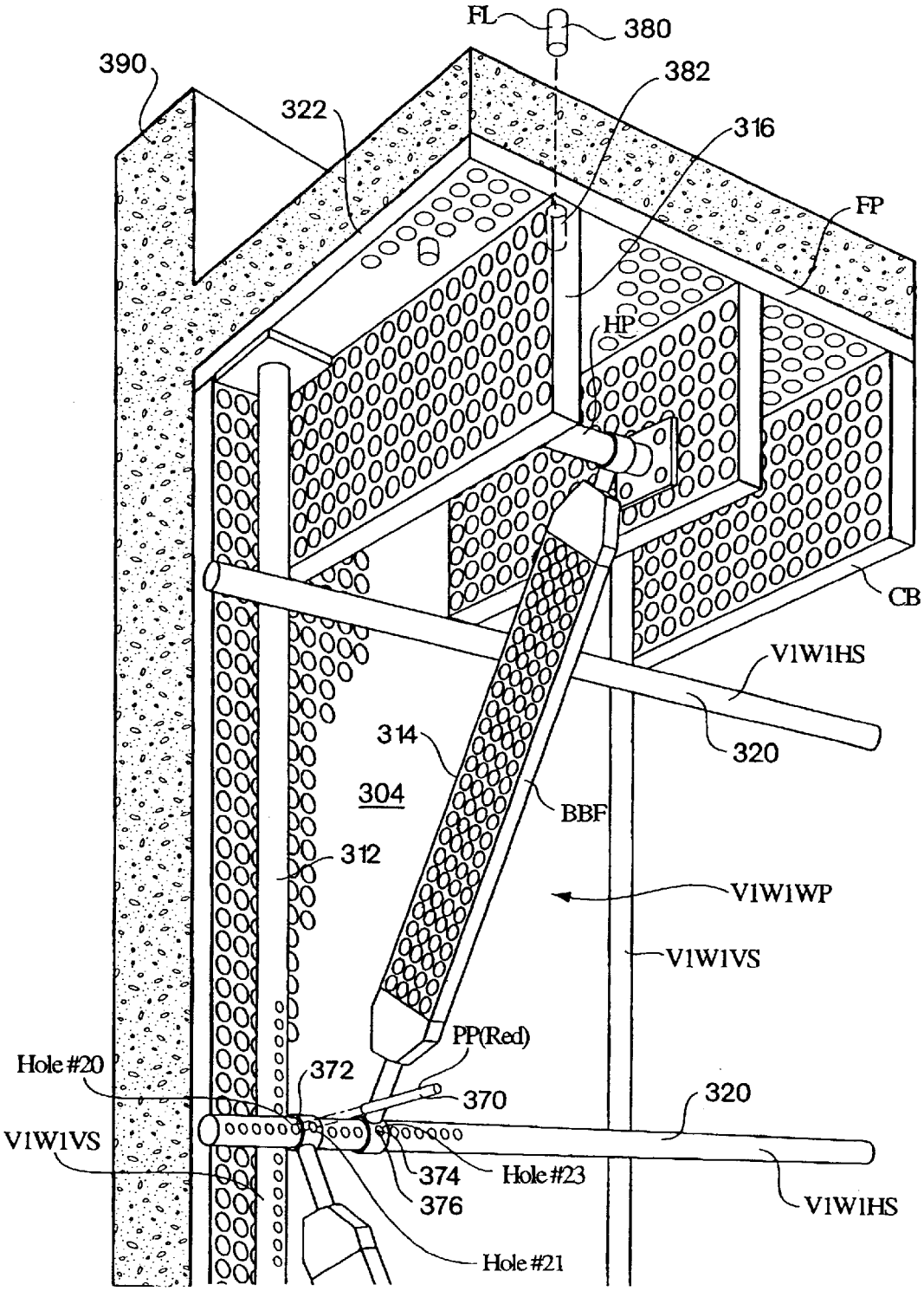

Referring now to FIG. 38, the utilization of a plug in an aperture to position a horizontal support 320 adjacent a vertical support 312 utilizing a (PP-Red) pin 370 in hole number 20 here illustrated at 372 illustrates the positioning of the various modular formwork elements precisely through the utilization of the pin aperture combination which is completely specified in the instruction set to the artisan. Moreover, buttress beam 314 is attached to horizontal support 320 via a collar 374 which has an aperture 376 which specifies hole number 23 on horizontal support 320, in this case V1W1HS. Note also that floor panel 322 is located via a pin 380 to beam 316 in an appropriate aperture therein here illustrated at 382, thereby positioning the floor panel precisely on the beams which are in turn precisely positioned on panel 304 and on horizontal support 320. As can be seen, the modular formwork provided permits the formation of concrete floor and wall here generally illustrated at 390, thereby permitting the erection of a structure in extremely efficient manner.

The instruction set from the subject method not only can specify orientation and position, a particular aperture can be called out for instance for the location of a switch plate or electrical socket. What will be appreciated is that through the utilization of the subject method not only can the modular formwork be completely specified, instructions can be given in a relatively simple manner to an unskilled artisan to erect the formworks through the utilization of the instruction set provided by the subject method.

This completely supplants the conventional system which requires a professional to look at drawings, make measurements, and give instructions to the artisan, with the measurements being reapplied at the site, a time consuming process. Moreover the degree of errors engendered in the conventional method of erecting formworks are eliminated to a large extent due to the pin aperture modular construction of the formworks.

The result is the ability of an architect or engineer to completely design a building without regard to the modular structure and then have the subject system provide instructions to an artisan to fabricate or erect the appropriate formworks such that the architect governs the final structure not the modular system itself.

Having now described a few embodiments of the invention and some modifications and variations thereto, it should be apparent to those skilled in the art that the foregoing is merely illustrated and not limiting, having been presented by the way of example only. Numerous modification and other embodiments are within the scope of one of ordinary skill in the art, and are contemplated as failing within the scope of the invention as limited only by the appended claimed and equivalents thereto.

What is claimed is:

1. A method for assisting in the construction of a building structure utilizing formworks made up of modular components comprising the steps of:

providing original construction drawings having building components and the dimensions thereof specified thereon, applying an ordered set of reference materials to the building components, with the numerals specifying all the necessary information with respect to the building components, modifying the numerals so as to alter the dimensions of the building components specified by the numerals such that the building components are formable through the use of the modular components used to make the formworks, and providing instructions to an artisan how to erect the formworks from the selected modular components corresponding to the altered dimensions from the modifying step, the instructions being coded to specify the modular component intended.

2. The method of claim 1, and further including the step of automatically checking the original construction drawings for errors by comparison of the drawings to predetermined parameters and correcting the drawings in terms of changes to the numerals representing a building component.

3. The method of claim 2, wherein the error is one that relates to a building code violation.

4. The method of claim 2, wherein the error is one that relates to information on the original set of construction drawings which is not in conformity with the predetermined parameters.

5. The method of claim 1, wherein the modifying step includes the step of specifying shape and functional design alternatives for the building structure described by the original construction drawings.

6. The method claim 1, wherein the modifying step includes the step of providing additional information other than different dimensions to be used in the modifying step.

7. The method of claim 1, wherein the providing step includes the step of automatically scanning the original construction drawings and ascertaining from the original construction drawing the building components specified thereby.

8. The method of claim 1, wherein the original construction drawings are carried as a CAD file that specifies the building components for the structure to be built and the dimensions thereof; and wherein the step of automatically scanning includes scanning of the CAD file.

9. The method of claim 1, wherein the coding is alpha/numeric coding.

10. The method of claim 9, wherein the coding is color coding.

* * * * *

UNITED STATES PATENT AND TRADEMARK OFFICE

CERTIFICATE OF CORRECTION

PATENT NO. : 6,438,922 B1
DATED : August 13, 2002
INVENTOR(S) : Ghera et al.

Figure 1B:
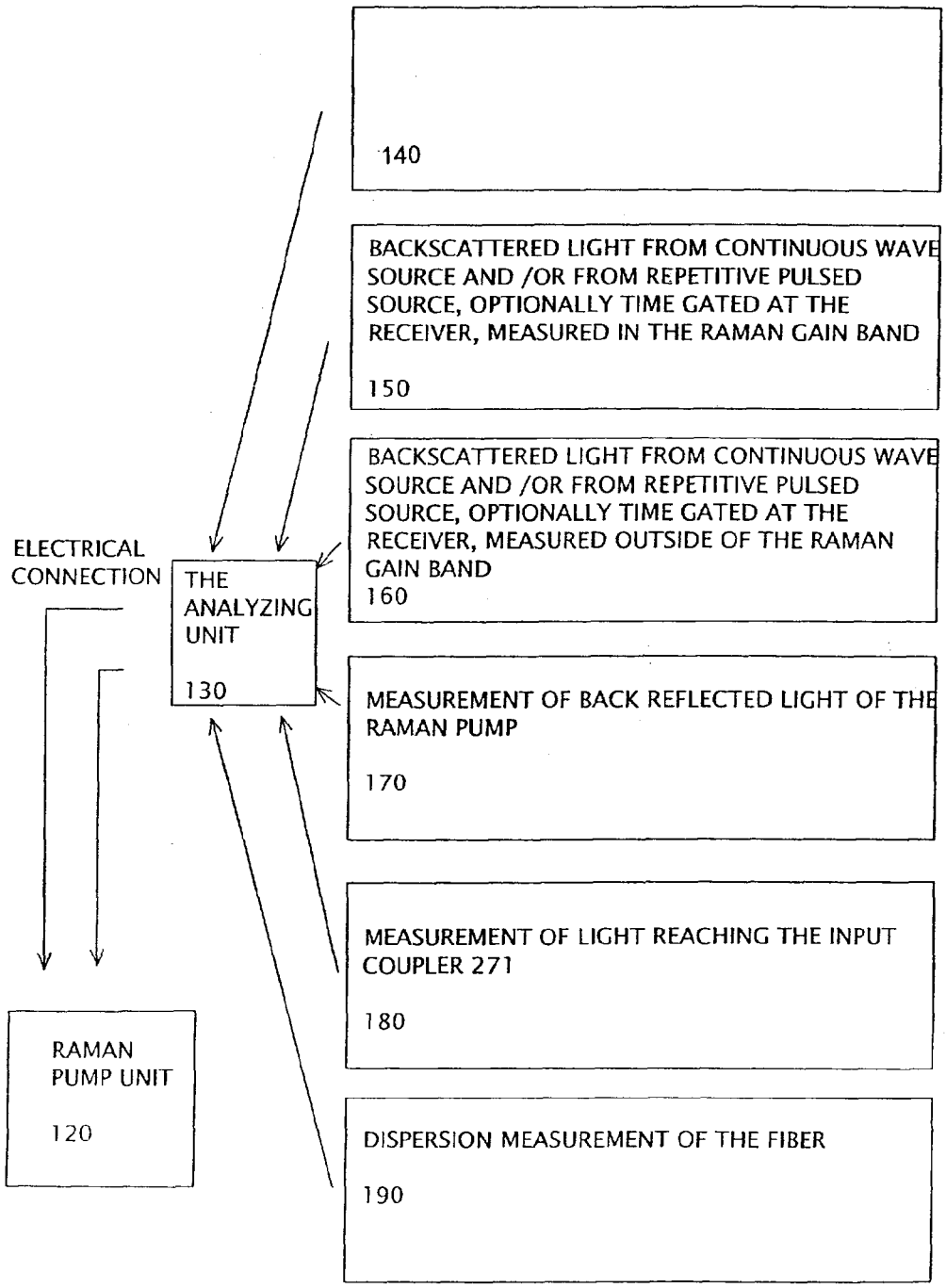
Figure 2:
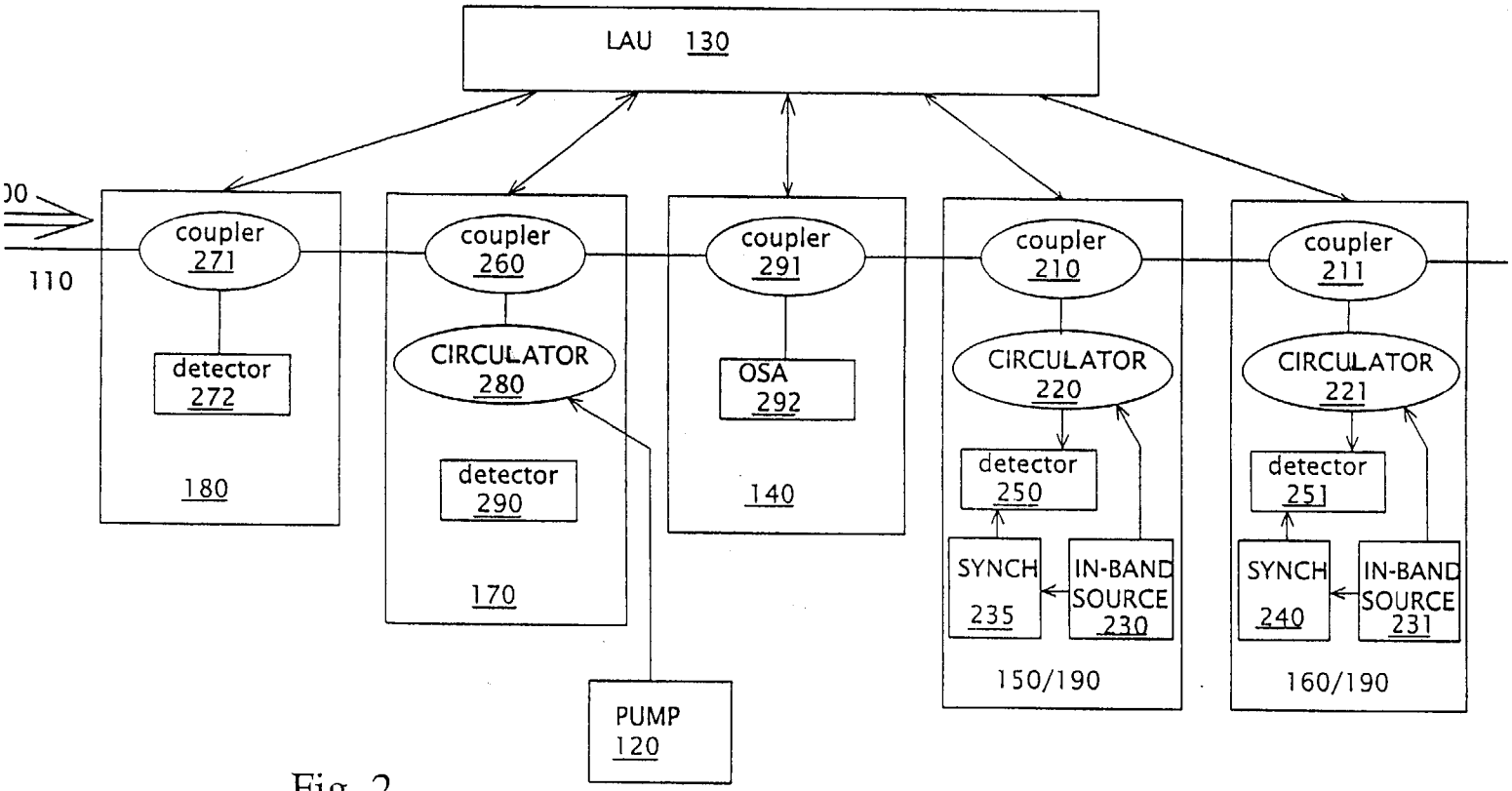

It is certified that error appears in the above-identified patent and that said Letters Patent is hereby corrected as shown below:

The title page, showing the illustrative figure should be deleted, and substituted therefore the new title page with the illustrated figure attached The drawing sheets consisting of figures 1B and 2 should be deleted, to be replaced with the drawing sheets consisting of figures 1B and 2, as shown on the attached sheets.

Signed and Sealed this

Twenty-ninth Day of April, 2003

JAMES E. ROGAN
*Director of the United States Patent and Trademark Office*

(12) United States Patent
Ghera et al.

(10) Patent No.: US 6,433,922 B1
(45) Date of Patent: Aug. 13, 2002

(54) APPARATUS AND METHOD FOR A SELF ADJUSTING RAMAN AMPLIFIER

(75) Inventors: Uri Ghera, Tel Aviv; Doron Moshkovich, Ramat Gan; Ophir Eyal, Ramat Hasharon, all of (IL)

(73) Assignee: REDC Optical Networks Ltd., Tel Aviv (IL)

( * ) Notice: Subject to any disclaimer, the term of this patent is extended or adjusted under 35 U.S.C. 154(b) by 0 days.

(21) Appl. No.: 09/791,685

(22) Filed: Feb. 26, 2001

(51) Int. Cl.[7] ..... H01S 3/00
(52) U.S. Cl. ..... 359/334, 359/337
(58) Field of Search ..... 359/334, 337, 359/341.4

(56) References Cited

U.S. PATENT DOCUMENTS

| | | | |
|---|---|---|---|
| 4,401,362 | A | 8/1983 | Vorkopich |
| 4,516,898 | A | 10/1985 | Dicks |
| 4,599,492 | A | 10/1987 | Mollenauer |
| 5,298,965 | A | 3/1994 | Spirit et al. |
| 5,446,559 | A | 8/1995 | Blank et al. |
| 5,623,508 | A | 4/1997 | Grubb et al. |
| 5,673,280 | A | 9/1997 | Grubb et al. |
| 5,866,206 | A | 10/1999 | Jander |
| 6,038,436 | A | 3/2000 | Kerfoot et al. |
| 6,052,219 | A | 4/2000 | Kidorf et al. |
| 6,081,366 | A | 6/2000 | Kidorf |
| 6,184,464 | B1 | 1/2001 | Kidorf et al. |
| 6,292,298 | B1 * | 9/2001 | Akasaka et al. ..... 359/334 |

FOREIGN PATENT DOCUMENTS

JP WO00/05622 7/1999

OTHER PUBLICATIONS

"Optical Time Domain Reflectometry on Optical Amplifier Systems", Blank et al. Journal of Lightwave Technology vol. 7, No. Oct. 1989 pp. 1549–1555.
"Raman–Assisted Long Distance Optical Time Domain Reflectometry" Electronics Letters, Dec. 89 vol. 25 No. 25 p. 1687–9 Spirit et al.

(List continued on next page.)

*Primary Examiner*—Mark Hellner
(74) *Attorney, Agent, or Firm*—Mark M. Friedman

(57) ABSTRACT

This invention describes an apparatus and method for a self adjusting Raman amplifier for fiber optic transmission lines incorporating a line diagnostic mechanism in order to calculate, control and optimize the operating parameters for the amplifier. This need arises because the amplifier gain medium is the transmission line itself and the amplifier properties depend on the optical fiber properties along the first tens of kilometers of the transmission line from the pump. A Line Analyzing Unit, adjacent to the Raman pump unit, operates before the Raman pump is enabled and during operation, and characterizes the transmission line. The Line Analyzing Unit determines and characterizes the types of optical fibers installed along the transmission line and calculates and optimizes the pump or pumps power in order to achieve optimum gain and gain equalization. The Line Analyzing Unit may also determine if there is an optical loss or reflection in the optical fiber that can be destructive when the high power Raman pump is operating.

27 Claims, 5 Drawing Sheets

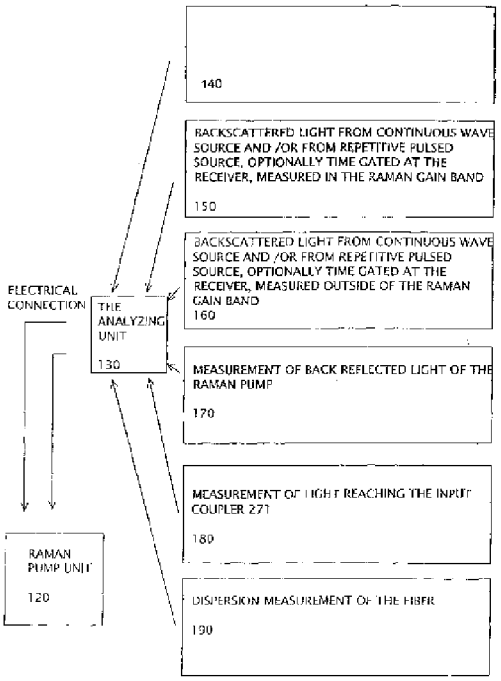

UNITED STATES PATENT AND TRADEMARK OFFICE

CERTIFICATE OF CORRECTION

PATENT NO. : 6,438,922 B1
DATED : August 27, 2002
INVENTOR(S) : Patrick DeLeFevre It is certified that error appears in the above-identified patent and that said Letters Patent is hereby corrected as shown below:

This certificate supersedes Certificate of Correction issued April 29, 2003, the number was erroneously mentioned and should be vacated since no Certificate of Correction was granted.

Signed and Sealed this

Thirteenth Day of May, 2003

JAMES E. ROGAN
*Director of the United States Patent and Trademark Office*